US010561239B2

(12) United States Patent
Game et al.

(10) Patent No.: US 10,561,239 B2
(45) Date of Patent: Feb. 18, 2020

(54) MODULAR CONSOLE FRAME STRUCTURE AND CONSOLE

(71) Applicant: Evans Consoles Corporation, Calgary, Alberta (CA)

(72) Inventors: Richard Game, Calgary (CA); Matko Papic, Calgary (CA); Carlos Renderos, Calgary (CA); Randy Simington, Calgary (CA)

(73) Assignee: EVANS CONSOLES CORPORATION, Calgary, Alberta (CA)

( * ) Notice: Subject to any disclaimer, the term of this patent is extended or adjusted under 35 U.S.C. 154(b) by 0 days.

(21) Appl. No.: 15/686,765

(22) Filed: Aug. 25, 2017

(65) Prior Publication Data

US 2018/0055222 A1 Mar. 1, 2018

Related U.S. Application Data

(60) Provisional application No. 62/380,018, filed on Aug. 26, 2016.

(51) Int. Cl.
*A47B 83/00* (2006.01)
*A47B 87/00* (2006.01)
(Continued)

(52) U.S. Cl.
CPC ..... *A47B 83/001* (2013.01); *A47B 21/02* (2013.01); *A47B 21/03* (2013.01); *A47B 21/04* (2013.01);
(Continued)

(58) Field of Classification Search
CPC ..... A47B 83/001; A47B 21/02; A47B 46/005; A47K 13/12; Y10T 16/546
(Continued)

(56) References Cited

U.S. PATENT DOCUMENTS 349,875 A * 9/1886 Crocker ..... A47B 85/08 312/240
2,860,404 A * 11/1958 Alden ..... B25H 1/02 198/346
(Continued)

FOREIGN PATENT DOCUMENTS

EP 0277531 A1 8/1988
FR 2649742 A1 1/1991
(Continued)

OTHER PUBLICATIONS

Extended European Search Report for corresponding European application No. EP 17188001.6, dated Apr. 24, 2018.

*Primary Examiner* — Joshua K Ihezie
(74) *Attorney, Agent, or Firm* — Notaro, Michalos & Zaccaria P.C.

(57) ABSTRACT

According to an aspect, there is provided a frame module for a console. The frame module comprises first and second spaced apart leg frames and respective upper and lower elongated frame sections extending between and interconnecting the first and second leg frames. The frame module may also comprise an intermediate frame section that is horizontally adjustable along the length of the upper and lower frame sections. Two or more frame modules may be connected to form a console frame structure. The console frame structure may comprise at least one pivot connection between the second leg frame of the first frame module and the first leg frame of the second frame module. For each pivot connection, the console frame structure may also include at least one support member pivotably connected to the first and second frame modules by the pivot connection.

19 Claims, 50 Drawing Sheets

(51) Int. Cl.

| | |
|---|---|
| ***A47B 21/02*** | (2006.01) |
| ***A47B 46/00*** | (2006.01) |
| ***A47B 21/03*** | (2006.01) |
| ***A47B 21/04*** | (2006.01) |
| ***A47B 96/20*** | (2006.01) |

(52) U.S. Cl.
CPC ..... *A47B 46/005* (2013.01); *A47B 87/002* (2013.01); *A47B 96/205* (2013.01); *A47B 2200/0078* (2013.01)

(58) Field of Classification Search
USPC ..... 312/257.1, 265.1, 194, 195, 196, 223.1, 312/223.5, 265.5; 16/365
See application file for complete search history.

(56) References Cited

U.S. PATENT DOCUMENTS 2,928,703 A * 3/1960 Paulsen ..... A47B 27/00 108/9
3,817,191 A * 6/1974 Hansen ..... A47B 3/002 108/79
4,258,963 A * 3/1981 Fusselman ..... A47B 17/065 108/141
5,609,402 A * 3/1997 Kemp ..... A47B 13/06 211/94.01
5,743,603 A * 4/1998 Kelley ..... A47B 21/00 312/195
6,382,747 B1 * 5/2002 Catta ..... A47B 81/061 108/50.02
6,857,712 B1 * 2/2005 Haberman ..... A47B 21/00 108/102
6,990,909 B2 * 1/2006 Gosling ..... A47B 83/001 108/50.02
8,076,574 B2 * 12/2011 Irmer ..... H02B 1/50 174/17 R
8,123,311 B2 * 2/2012 Nilsson ..... A47B 47/0083 312/108
8,172,098 B2 * 5/2012 Eustace ..... A47B 47/021 211/189
8,985,716 B2 * 3/2015 Lundrigan ..... A47B 87/0284 211/189
9,055,811 B2 * 6/2015 Reithler ..... A47B 17/03
9,161,622 B1 * 10/2015 Dressendorfer ..... A47B 83/001
9,717,327 B2 * 8/2017 Papic ..... A47B 13/003
9,924,613 B2 * 3/2018 Pace ..... H05K 7/18
10,188,205 B2 * 1/2019 Eckert ..... A47B 3/002
2002/0017839 A1 * 2/2002 Wei ..... A63F 9/00 312/265.1
2003/0071546 A1 * 4/2003 Gosling ..... A47B 83/001 312/223.3
2005/0115474 A1 6/2005 Chang
2006/0042520 A1 3/2006 Stevens
2007/0228903 A1 10/2007 Liu
2008/0010908 A1 * 1/2008 Mortier ..... H05K 5/0226 52/32
2011/0001406 A1 * 1/2011 Han ..... F16M 11/046 312/236
2012/0241398 A1 * 9/2012 Lam ..... A47G 25/0685 211/85.3
2014/0124468 A1 * 5/2014 Lundrigan ..... A47B 87/0284 211/182
2015/0002006 A1 * 1/2015 Segroves ..... H05K 7/1491 312/236
2016/0330862 A1 * 11/2016 Pace ..... F16M 13/00

FOREIGN PATENT DOCUMENTS

JP H10192100 A 7/1998
WO WO-2015154867 A1 * 10/2015 ..... A47B 3/002

* cited by examiner

MODULAR CONSOLE FRAME STRUCTURE AND CONSOLE

RELATED APPLICATION

This application claims priority to U.S. Provisional Patent Application Ser. No. 62/380,018, filed on Aug. 26, 2016, the entire content of which is incorporated herein by reference.

FIELD OF THE DISCLOSURE

This disclosure relates to modular console systems. More particularly, the disclosure relates to a modular frame structure for a console.

BACKGROUND

Consoles are used in a variety of different applications, including in control rooms, on trading floors, and in operations centers. Consoles are typically used in the place of generic office equipment. Consoles may provide an enhanced human-machine interface by allowing for the positioning of equipment in more useful and efficient positions. Furthermore, consoles may be adapted to support more equipment compared to generic office equipment.

Many traditional consoles struggle with changing user needs. Many existing forms of technical furniture and consoles are custom manufactured, which in terms of design and construction may be expensive and time consuming. This approach is usually necessitated by customer requirements that are often unique in terms of work station size, equipment placement, human engineering and cost considerations. As a result, the completed console structures may not only be very expensive, but may also be difficult to subsequently modify for the reconfiguration of existing equipment or to retrofit new equipment.

Furthermore, many existing systems do not provide a low-cost solution that allows for a high degree of customization in terms of layout of the consoles. In many instances, end users desire a console having custom features. For example, a user may desire a console that is customized to fit a particular room layout. The room could have a curved or sloped wall, one or more support pillars, a multi-level floor, etc. In another example, a user may desire that the configuration of the console be tailored for a specific application, or to hold and support specific equipment. Many existing furniture systems and console systems come in one or a number of standard sizes and shapes in an attempt to provide a "best fit". However, such systems are generally not easily customizable in terms of size, shape or configuration.

As another example, consoles may typically support heavy equipment such as displays etc. Conventional consoles may not be easily customizable to provide additional support in variable locations of the console according to the position and distribution of load on the console.

SUMMARY

According to one aspect, there is provided a console frame structure comprising: first and second frame modules, each said frame module comprising respective first and second spaced apart leg frames and respective upper and lower elongated frame sections extending between and interconnecting the first and second leg frames; at least one pivot connection between the second leg frame of the first frame module and the first leg frame of the second frame module, thereby allowing adjustment of a relative angle between the first and second frame modules; and for each at least one pivot connection, a respective support member pivotably connected to the first and second frame modules by the pivot connection, thereby allowing adjustment of relative angles between the support member and the first and second frame modules.

In some embodiments, the at least one support member comprises at least one of: a floor-engaging foot; and a support arm for supporting a work surface panel.

In some embodiments, each said pivot connection comprises: a respective first pivot hinge piece attached to the second leg frame of the first frame module; a respective second pivot hinge piece attached to the first leg frame of the second frame module, a respective third pivot hinge piece, the corresponding support member comprising the third pivot hinge piece, where the first, second and third pivot hinge pieces are pivotably connected.

In some embodiments, each said pivot connection further comprises a pin pivotably connecting the first, second and third pivot hinge pieces.

In some embodiments: the first hinge piece comprises a first generally horizontal extension having a first generally vertical hole defined therethrough; the second hinge piece comprises a second generally horizontal extension having a second generally vertical hole defined therethrough, the first and second vertical holes being aligned and the pin extending through the holes.

In some embodiments, each of the first and second frame modules further comprises: a respective intermediate frame positioned between the respective first and second leg frames, the intermediate frame being selectively fixable to the at least one of the upper and lower elongated frame sections such that a position of the intermediate frame is adjustable lengthwise along the upper and lower elongated frame sections.

In some embodiments, the console frame module further comprises at least one additional support member pivotably connected to at least one of: one or more of the leg frames; and one or both of the intermediate frames.

According to another aspect, there is provided a console frame module, comprising: first and second spaced apart leg frames; respective upper and lower elongated frame sections extending between and interconnecting the first and second leg frames; intermediate frame positioned between the first and second leg frames, the intermediate frame being selectively fixable to the at least one of the upper and lower elongated frame sections such that a position of the intermediate frame is adjustable lengthwise along the upper and lower elongated frame sections.

In some embodiments: the upper frame section comprises at least one upper beam interconnecting the first and second leg frames; and the lower frame section comprises at least one lower beam interconnecting the first and second leg frames.

In some embodiments, each said at least one upper beam comprises at least one respective elongated port oriented along a length of the upper beam, the intermediate frame being selectively fixable to each said at least one upper beam by fastening hardware received in the respective port of the upper beam.

In some embodiments, each said at least one lower beam comprises at least one respective elongated port oriented along a length of the lower beam, the intermediate frame being selectively fixable to each said at least one lower beam by fastening hardware received in the respective port of the lower beam.

In some embodiments, at least one upper beam comprises first and second horizontally spaced apart upper beams, and the at least one lower beam comprises first and second horizontally spaced apart lower beams.

In some embodiments, the intermediate frame comprises at least first and second spaced apart generally vertical beams, the first and second spaced vertical beams each having respective upper and lower ends, the first beam of the intermediate frame being aligned with the first upper beam and the first lower beam, the second beam of the intermediate frame being aligned with the second upper beam and the second lower beam.

In some embodiments, the intermediate frame further comprises at least one cross beam interconnecting the first and second generally vertical beams of the intermediate frame.

In some embodiments: the upper ends of the first and second beams of the intermediate frame each define a respective recess, the recess in the upper end of the first vertical beam being aligned with and receiving the first upper beam, the recess in the upper end of the second beam being aligned with and receiving the second upper beam.

In some embodiments: the lower ends of the first and second beams of the intermediate frame each defining a respective recess, the recess in the lower end of the first beam being aligned with and receiving the first lower beam, the recess in the lower end of the second vertical beam being aligned with and receiving the second lower beam.

In some embodiments, each of the first and second beams of the intermediate frame comprises at least one respective elongated port oriented along a length of the generally vertical beam for receiving fastening hardware.

In some embodiments, the console frame module further comprises at least one support arm for supporting a work surface panel, each said support arm attached to a respective one of: the first leg frame, the second leg frame, and the intermediate frame.

In some embodiments, the console frame module further comprises at least one floor-engaging foot, each said foot attached to a respective one of: the first leg frame, the second leg frame, and the intermediate frame.

According to another aspect, there is provided console comprising: at least one console frame module as described above or below; at least one work surface panel mounted on the at least one frame module.

In some embodiments, the console further comprises at least one end panel assembly connected to the at least one console frame module.

In some embodiments, each said end panel assembly comprises a respective end panel frame and a respective end panel insert.

In some embodiments, the end panel insert for each end panel assembly is removable and replaceable.

In some embodiments, the console further comprises a slat wall mounted to the at least one frame module.

In some embodiments, the console further comprises a slat rail mounted to the at least one frame module.

Other aspects and features of the present disclosure will become apparent, to those ordinarily skilled in the art, upon review of the following description of the specific embodiments.

BRIEF DESCRIPTION OF THE DRAWINGS

Aspects and embodiments of the disclosure will now be described in greater detail with reference to the accompanying diagrams, in which.

DETAILED DESCRIPTION

Figure 1:
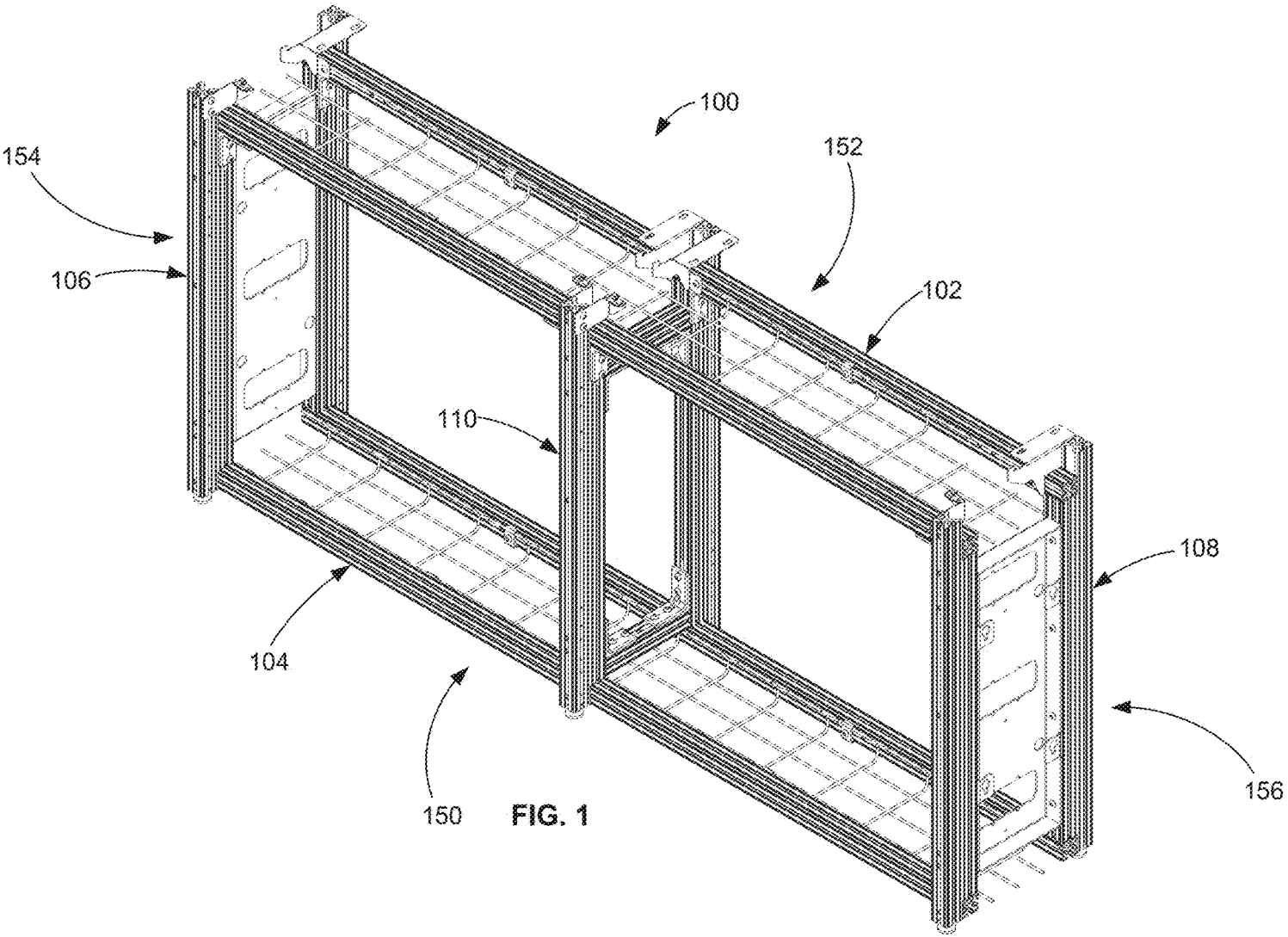
FIG. 1 is a perspective view of a frame module for a console according to one embodiment.

FIG. 1 is a perspective view of a frame module 100 for a console according to one embodiment. The frame module 100 forms a generally rectangular prism or box shape, including an upper top frame section 102, a lower frame section 104, and opposing first and second leg frames 106 and 108. In this embodiment, the frame module 100 also includes an intermediate frame section 110 (although other embodiments may omit the intermediate frame section). The upper frame section 102 and the lower frame section 104 extend between and interconnect the first and second leg frame frames 106 and 108.

FIG. 1 indicates a front 150, back 152, a first sides 154 and a second side 156 of the frame module 100. The term "width" of the frame module 100 as used herein refers to the distance between the first and second sides 154 and 156. The "depth" of the frame module 100 refers to the distance between the front 150 and the back 152. This terminology does not limit the frame module 100 to use in a particular orientation, but is used for ease of description. For example, a work surface panel (not shown) may typically extend forward from the frame module 100, and a user may stand or sit in front of the frame module 100. However, embodiments are not limited to this arrangement. Similarly, the terms "horizontal" and "vertical" do not imply absolutely horizontal or plumb, but are instead used generally. For example, a "vertical" element is not necessarily perfectly vertical, but may be angled and/or may be curved or bent, but still extending in a generally vertical direction. Any dimensions specified in the drawings are also shown by way of example, and embodiments are not limited to such dimensions.

The intermediate frame section 110 is positioned between the first and second leg frames 106 and 108 and provides additional support. The intermediate frame section 110 in this example is in the form of a third leg section, similar to the first and second leg frames 106 and 108. The intermediate frame is selectively fixable to the upper frame section 102 and/or the lower frame section 104 such that the position of the intermediate frame is adjustable lengthwise along the upper and lower frame sections 102 and 104. In other words, the intermediate frame section 110 is horizontally adjustable and may be secured at various positions along the upper and lower frame sections 102 and 104. For example, in this embodiment, the intermediate frame section 110 can slide along the upper and lower sections 102 and 104 when not secured. Fastening hardware (e.g. screws, clamps, clips, bolts, etc.) may be used to secure the intermediate frame section 110 to the upper frame section 102 and/or the lower frame section 104 in a desired position.

By allowing horizontal adjustment of the intermediate frame section, the load bearing ability of the frame module 100 may be customized. For example, if particularly heavy equipment is to be used toward one side of a console including the frame module 100, then the intermediate frame section 110 may be moved toward that side to provide additional structural support. Additionally, the adjustability of the intermediate frame section 110 may allow for customization of storage spaces and equipment arrangement in a console including the frame module 100.

In some embodiments, the frame module 100 may further include one or more additional intermediate frame sections (not shown). The additional intermediate frame section(s) may be fixed in various positions between the first and second leg frames 106 and 108. Each of the plurality of intermediate frame sections may be horizontally adjustable and selectively fixable in various positions.

In some embodiments, a console frame structure may include two or more frame modules that are interconnected. The two or more frame modules may comprise the frame module 100 shown in FIG. 1, for example. Alternatively, the console frame structure may include a single frame module.

Figure 2:
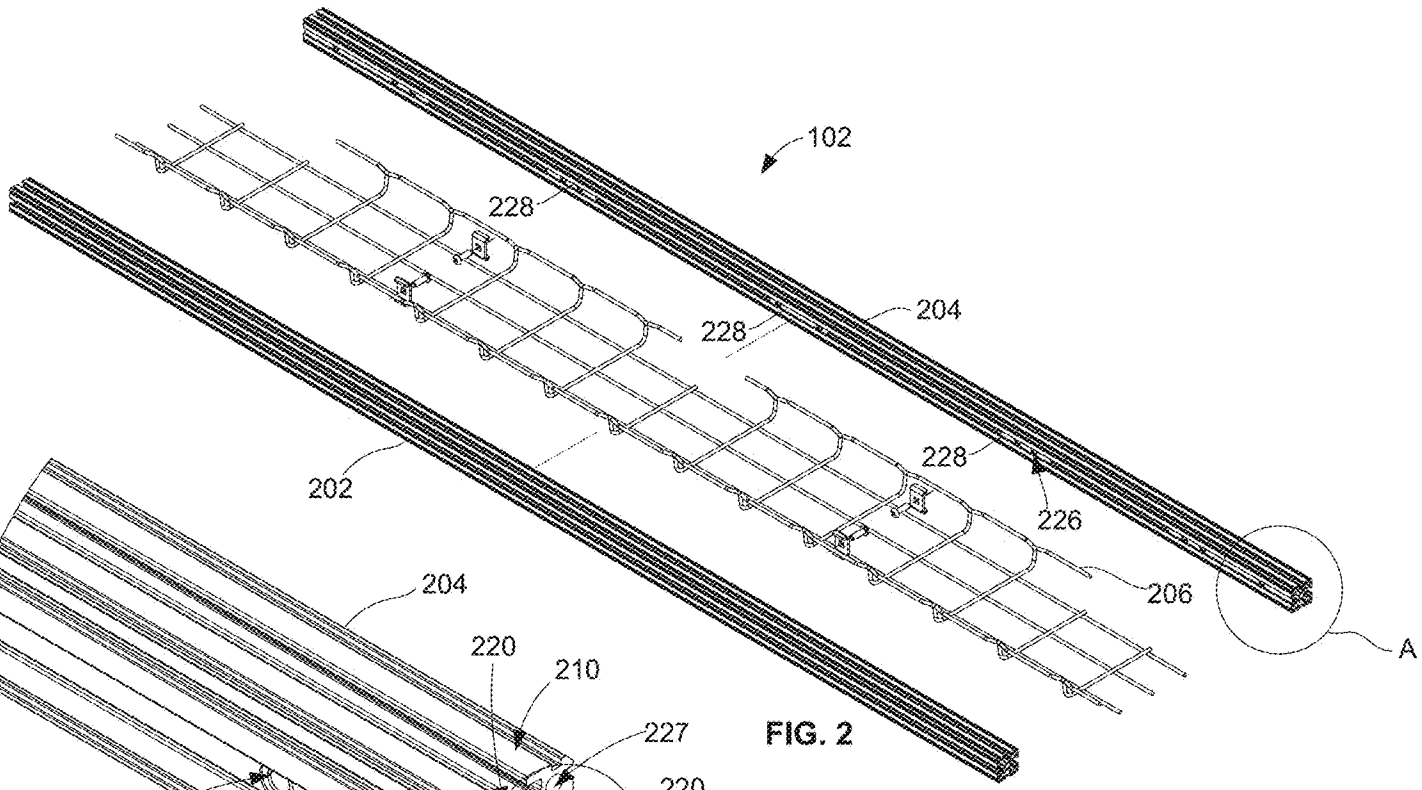
FIG. 2 is an exploded perspective view of an upper frame section of the frame module of FIG. 1.

FIG. 2 is an exploded perspective view of the upper frame section 102 of the frame module 100 of FIG. 1. The upper frame section 102 in this embodiment includes first and second upper beams 202 and 204 that are horizontally spaced apart. Other embodiments may include only one or more than two upper beams. The upper frame section 102 in this embodiment also includes an optional wire basket 206 between the first and second upper beams 202 and 204. The wire basket 206 functions as a cable raceway for management of cables (not shown). Each of the first and second upper beams 202 and 204 in this example is in the form of an elongated extrusion with a generally square shaped cross-sectional profile (although embodiments are not limited to extrusions or to a particular cross-sectional profile shape). The first and second upper beams 202 and 204 may be metal or any other suitable material.

The first and second upper beams 202 and 204 are horizontally oriented and generally parallel to each other in this embodiment, although embodiments are not limited to this configuration. For example, the first and second upper beams 202 and 204 may be angled from horizontal, curved, and/or non-parallel in other embodiments, depending on the desired shape of the frame module. Embodiments are also not limited to the first and second upper beams 202 and 204, and an upper frame section in other embodiments may include one or more panels, rails, or other suitable support structures rather than beams.

Figure 3:
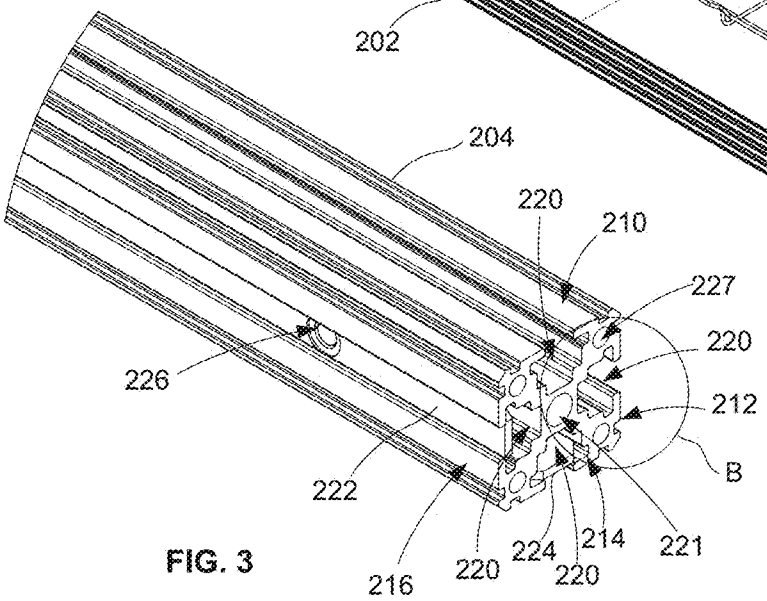
FIG. 3 is an enlarged view of the portion of an upper beam within the circle marked "A" in FIG. 2.

FIG. 3 is an enlarged view of the portion of the second upper beam 204 within the circle marked "A" in FIG. 2. The first upper beam 202 has the same structure as the second upper beam 204. As shown, the second upper beam 204 has four elongate sides 210, 212, 214 and 216, each defining a respective port 220 along the length thereof. The ports 220 are in the form of elongate slots for attachment or mounting of various components and equipment. The ports 220 have a profile shaped for receiving bolts, screws or other fastening hardware (as shown in more detail in FIG. 4).

Optional hole 221 extends lengthwise along the center axis of the second upper beam 204. Additional optional holes 227 extend lengthwise through the second upper beam 204. The holes 221 and 227 may also reduce the material required and weight of the extrusion while still providing sufficient structural stability and support.

Figure 4:
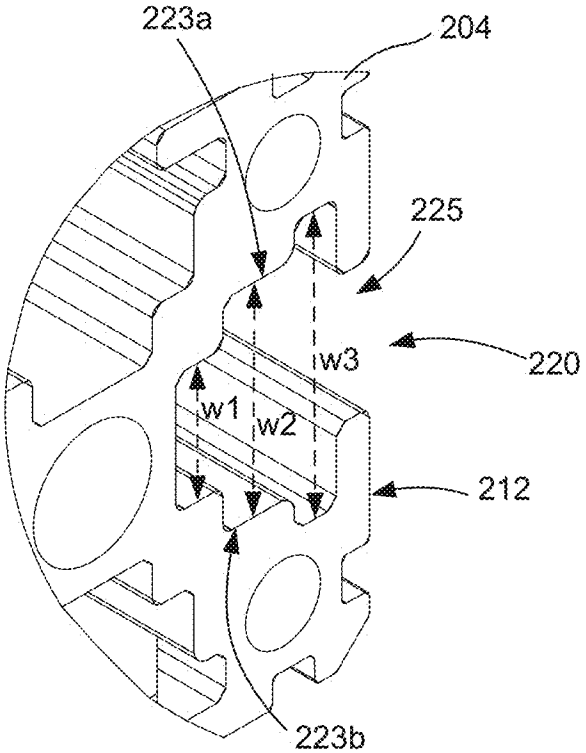
FIG. 4 is a further enlarged partial view of the portion of the upper beam within the circle marked "B" in FIG. 3.

FIG. 4 is a further enlarged partial view of the portion of the second upper beam 204 within the circle marked "B" in FIG. 3. The port 220 in side 212 of the second upper beam 204 is visible. As shown, port 220 defines an opening 225 and stepped side walls 223*a* and 223*b* that provide multiple widths w1, w2 and w3 within the port 220. The width w3 is wider than the opening 225. The remaining ports 220 shown in FIG. 3 have a similar structure. The profile of the ports 220 may allow bolt heads, nuts, attachment strips or other hardware to be received and held within the ports 220. The shape, structure and arrangement of the ports 220 is shown by way of example and embodiments are not limited to this particular implementation.

The ports 220 in the first and second upper beams 202 and 204 are used for attaching various components and/or equipment to the frame module 100, as well as attaching the first and second upper beams 202 and 204 to the first and second leg frames 106 and 108 and the intermediate frame section 110. Turning back to FIG. 3, attachment strips 222 and 224 are shown within the ports 220 of the sides 214 and 216. The attachment strip 222 includes multiple nuts 226 (defining threaded holes) for receiving fastening hardware, such as bolts. The nuts 226 are self-clinching nuts in this example embodiment. The attachment strips 222 and 224 and other attachment strips shown and described herein may be metal (e.g. satin steel).

In FIG. 2, short attachment strips 228 are shown within a port 220 of the first upper beam 202 to facilitate attaching the wire basket 206 to the first upper beam 202. The first upper beam 202 has corresponding strips placed within a port 220 of the side 210. Embodiments are not limited to the number or arrangement of the ports 220 or to the use of attachment strips therein. More or fewer ports may be included, and in different positions.

Additional attachment strips with holes and/or nuts may be used in additional ports 220, and the position of such holes and the position of the attachment strips within the ports 220 may be adjusted, thereby facilitating customization of the frame module 100 and equipment mounted thereto.

Figure 5:
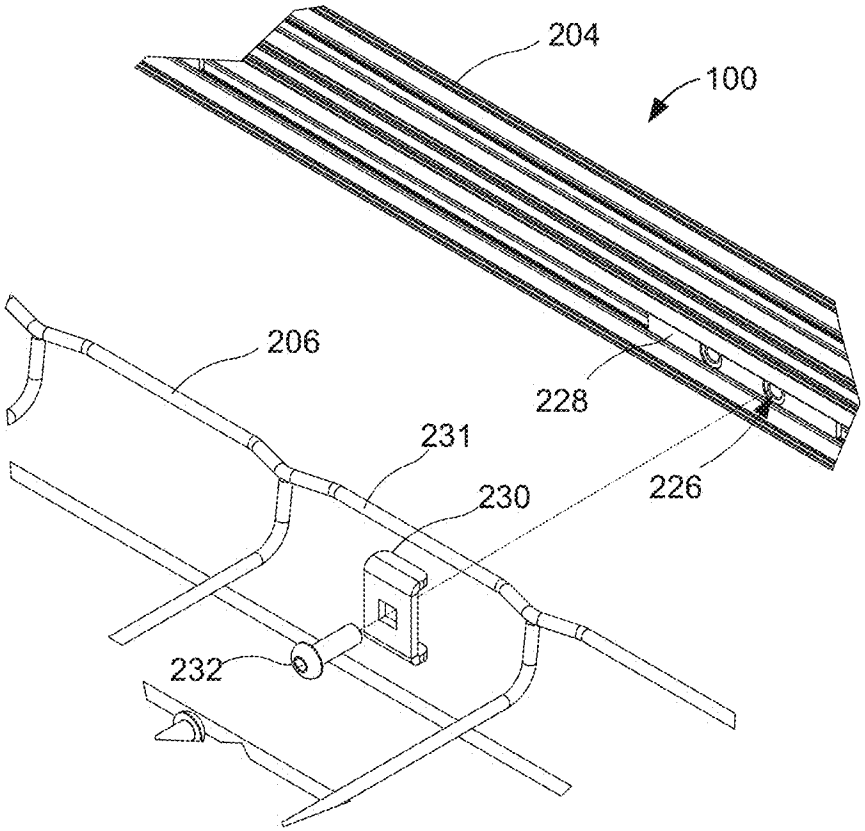
FIG. 5 is a partial exploded perspective view of an upper frame section of FIG. 2.

FIG. 5 is a partial exploded perspective view of the upper frame section 102 of FIG. 2. FIG. 5 shows a bracket 230 that fits over a wire portion 231 of the wire basket 206 and receives screw 232 (or other fastening means). The screw is also received in attachment strip 228 to secure the wire portion 231 to the second upper beam 204. Similar brackets 230 are spaced along the length of the wire basket 206 for securing the wire basket 206 to the first and second upper beams 202 and 204 in this embodiment.

Figure 6:
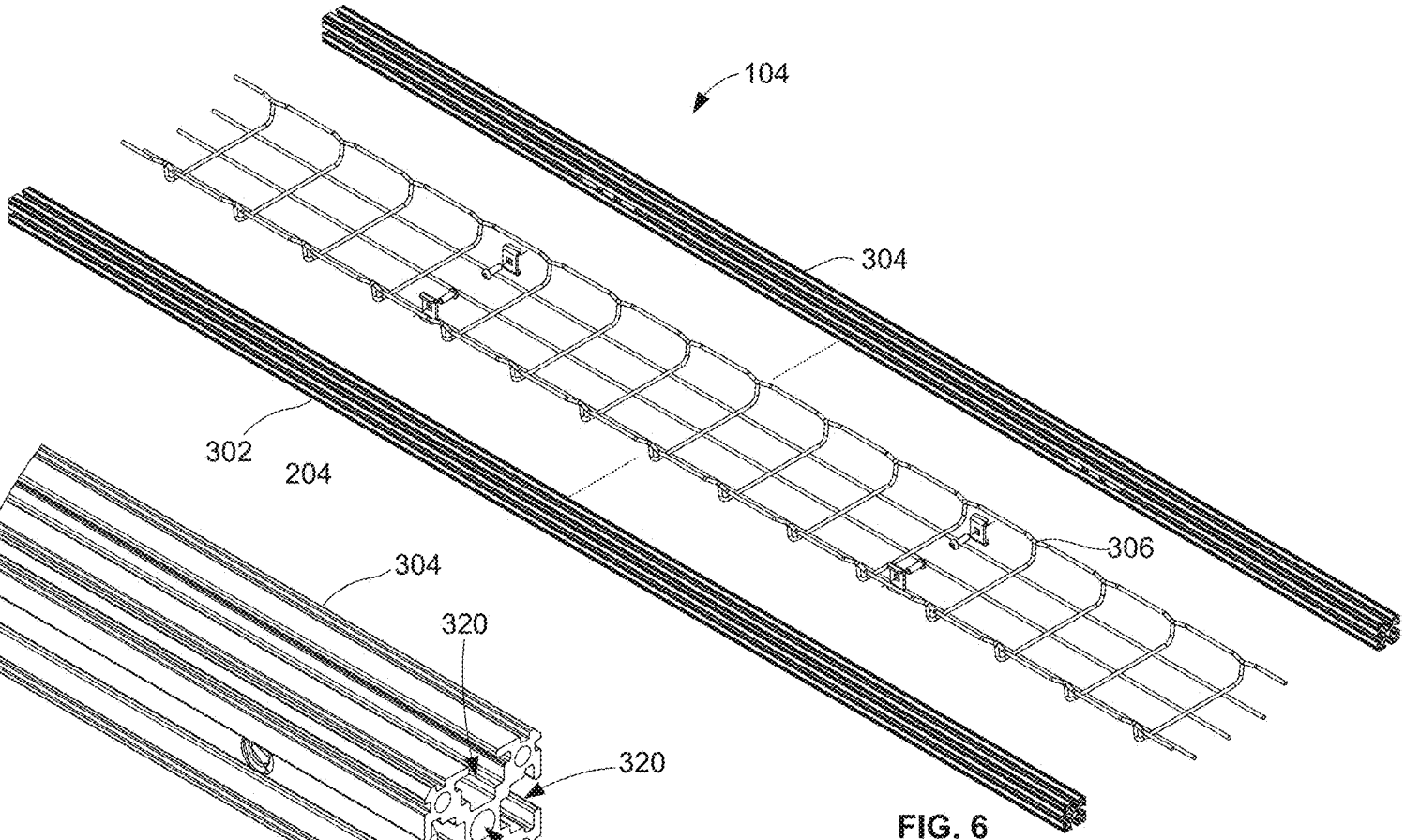
FIG. 6 is an exploded perspective view of the lower frame section of the frame module of FIG. 1.
Figure 7:
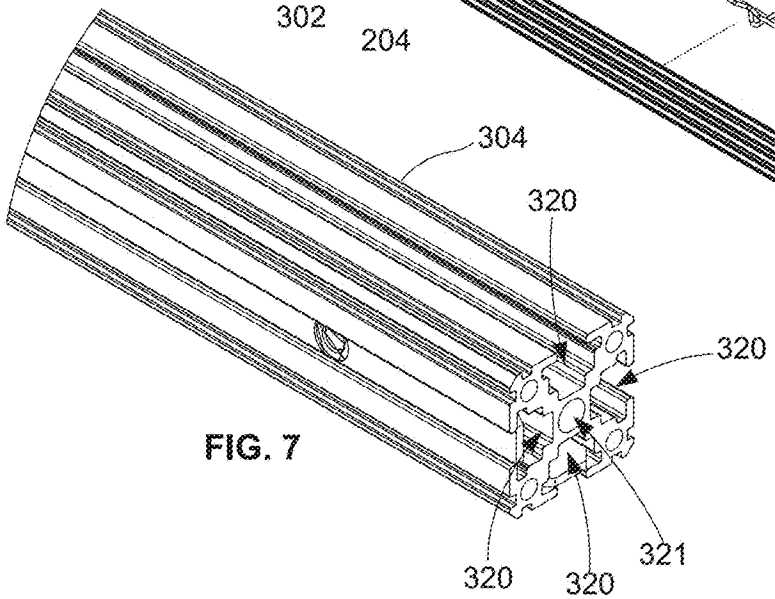
FIG. 7 is an enlarged partial view of a lower beam of the lower frame section of FIG. 6.

FIG. 6 is an exploded perspective view of the lower frame section 104 of the frame module 100 of FIG. 1. The lower frame section 104 in this embodiment includes first and second lower beams 302 and 304, horizontally spaced apart, and an optional wire basket 306 therebetween. The wire basket 306 may function as a cable raceway for management of cables (not shown). Each of the first and second lower beams 302 and 304 is elongated rail-like extrusion with a structure similar to the first and second upper beams 202 and 204 shown in FIG. 2 and including corresponding ports 320 along the length thereof. FIG. 7 is an enlarged partial view of the second lower beam 304 showing ports 320, which are similar to the ports 220 of the upper frame section 102 discussed above (shown in FIGS. 3 and 4). The first lower beam 302 has similar ports 320 and hole 321. The first and second lower beams 302 and 304 may be extrusions, such as metal extrusions (although this is not required). The first and second lower beams 302 and 304 are vertically aligned with the upper frame section 102 (shown in FIG. 1).

Figure 8:
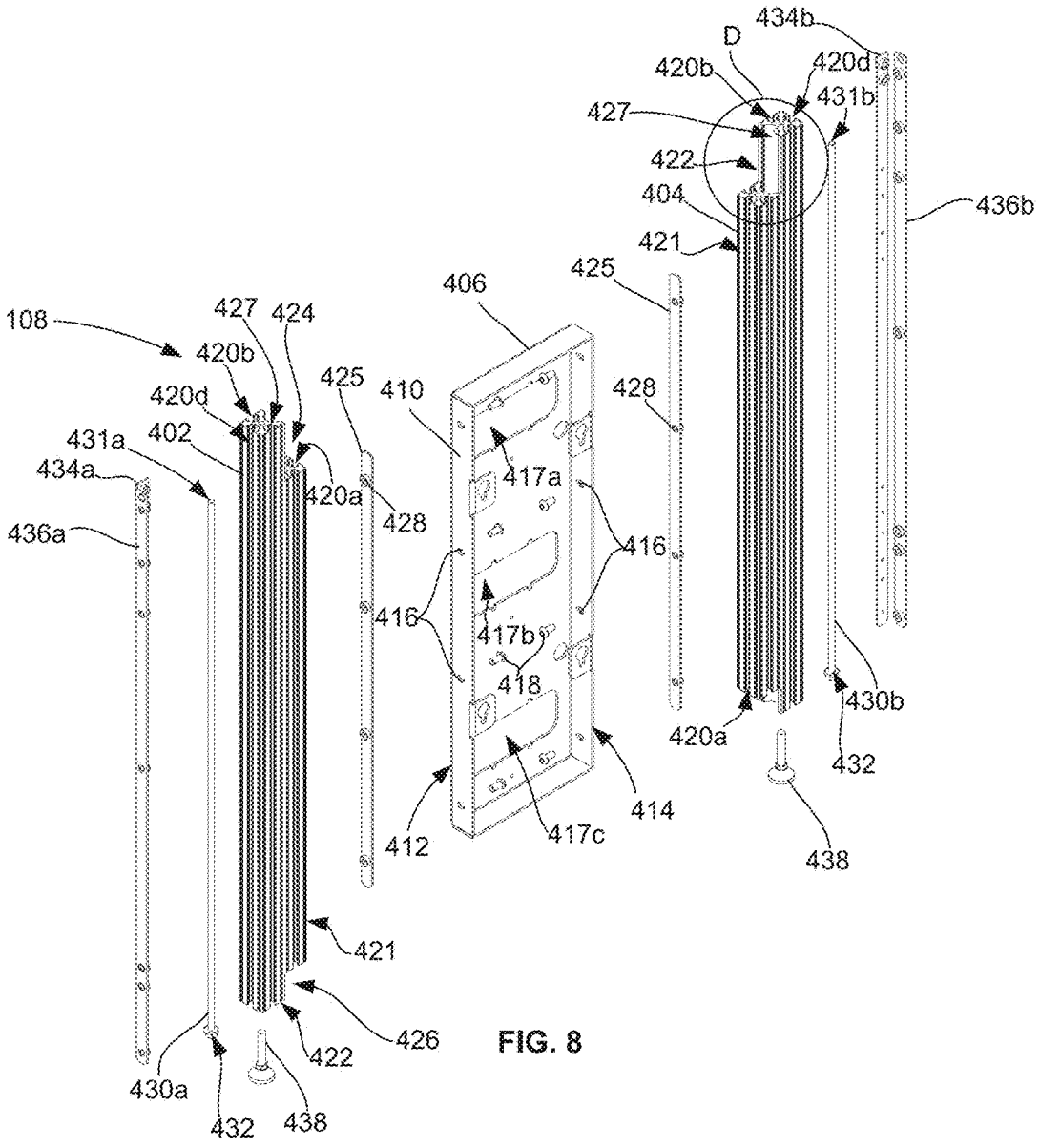
FIG. 8 is an exploded perspective view of a leg frame of the frame module of FIG. 1.

FIG. 8 is an exploded perspective view of the second leg frame 108 of the frame module 100 of FIG. 1. The first leg frame 106 mirrors the second leg frame 108 in structure. The second leg frame 108 comprises opposing and mirrored first and second vertical beams 402 and 404 and a frame panel 406 attached therebetween. The example frame panel 406 is generally rectangular with a wall 410 about its periphery.

The wall 410 forms opposing first and second sides 412 and 414, which define spaced apart holes 416 for receiving screws 418 or other fastening hardware to secure the frame panel 406 to the vertical beams 402 and 404. The frame panel 406 also defines optional openings 417*a*, 417*b* and 417*c* which may provide access or passageway for equipment, cables, etc. The structure and shape of the leg frame 108, including the frame panel 406 may vary depending on the intended equipment and use of the console.

In this example, each of the vertical beams 402 and 404 comprises a respective first beam section 421 and a respective second beam section 422 adjacent to the first vertical beam section 421. This structure of the vertical beams 402 and 404 is optional, and other structures may be used. Embodiments are also not limited to beams formed as extrustions.

The first and second vertical beam sections 421 and 422 each have a form similar the upper beams 202 and 204 and lower beams 302 and 304 shown in FIGS. 2 to 7. The first and second vertical beam sections 421 and 422 may be integrally formed or may be separately formed and then attached together. In this embodiment, the first and second vertical beam sections 421 and 422 are an extrusion (e.g. metal extrusion). The first vertical beam section 421 is shorter than the second vertical beam section 422 such that the second vertical beam section 422 extends above and below the first vertical beam section 421, thereby defining a recess in the form of an upper corner notch 424 and another recess in the form of a lower corner notch 426.

Figure 9:
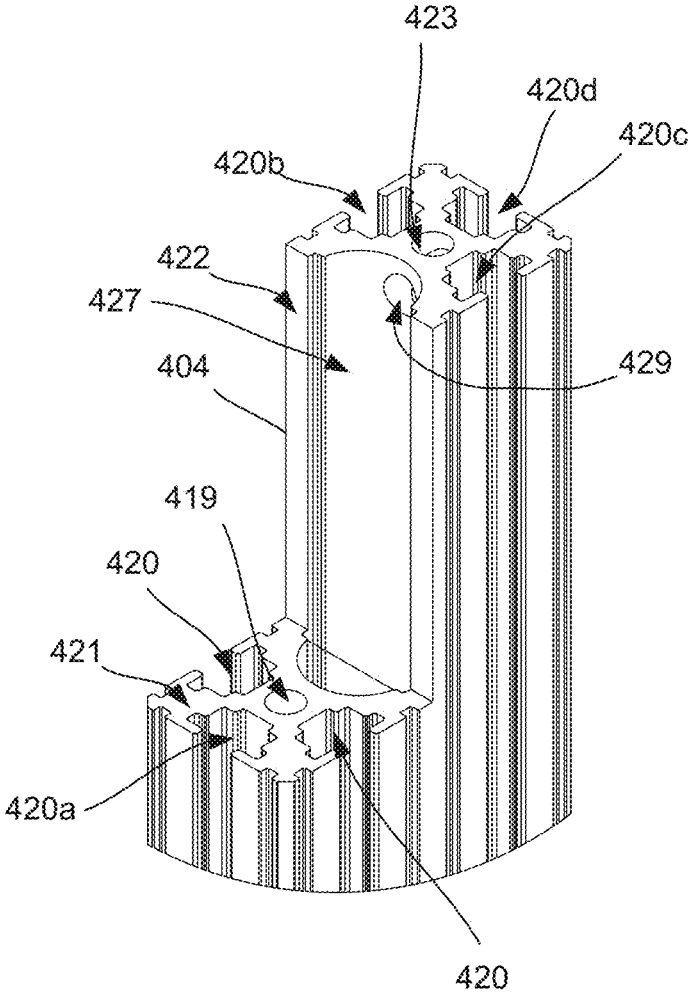
FIG. 9 is an enlarged view of the portion of a vertical beam within the circle marked "D" in FIG. 8.

The first and second vertical beam sections 421 and 422 define outer, lengthwise ports 420 similar to the ports 220 and 320 of the upper beams 202 and 204 and lower beams 302 and 304 shown in FIGS. 2 to 7. The first and second vertical beam sections 421 and 422 also define holes 419 and 423 respectively along their center axis. The ports 420 and holes 419 and 423 are shown more clearly in FIG. 9. FIG. 9 is an enlarged view of the portion of the second vertical beam 404 within the circle marked "D" in FIG. 8. As also shown in FIG. 9, a horizontal hole 429 extends between the port 420*d* and the groove 427.

Turning again to FIG. 8, the second leg frame 108 further includes mounting or stringer strips 425 that are received in the inward facing ports 420*a* in the first and second vertical beams 402 and 404 respectively. Threaded holes 428 in the attachment strips 425 receive the bolts 418 to secure the vertical beams 402 and 404 to the frame panel 406. Other fastening means may also be used in other embodiments. The ports 420 may allow attachment hardware various types and sizes and types to be used for attaching and/or mounting components. For example, holes and/or nuts in attachment strips (such as strips 425 shown in FIG. 8) may vary in size, number and placement to accommodate metric or imperial sized hardware and to align components being attached/mounted.

Rods 430*a* and 430*b* are received in holes 419 of the vertical beams 402 and 404 respectively. The rods 430*a* and 430*b* each have a respective bolt head or nut at lower end 432. The rods 430*a* and 430*b* are threaded at their upper ends 431*a* and 431*b*. Each rod 430*a* and 430*b* is longer than the first vertical beam section 421. The rods 430*a* and 430*b* are also received in holes (not shown) in the upper beams 202 and 204 and lower beams 402 and 404 to attach the leg frame 108 to the upper beams 202 and 204 and lower beams 402 and 404 as shown in FIG. 1. The threaded upper ends 431*a* and 431*b* of the rods may be secured directly to the upper beams 202 and 204 (e.g. by threaded holes) or may extend through the upper beams 202 and 204 and receive nuts (not shown), for example.

FIG. 8 also shows attachment strips 434*a*, 434*b*, 436*a* and 436*b*. The attachment strips 434*a* and 434*b* are received in ports 420*b* (also shown in FIG. 9) of the vertical beams 402 and 404 respectively. The attachment strips 436*a* and 436*b* are received in the outward facing ports 420*d* of the vertical beams 402 and 404 respectively. Similar strips (not shown) may be received in other ports 420 (such as in port 420*c* shown in FIG. 9).

Each second vertical beam section 422 defines a respective inward facing groove 427 that is opposite to the outward facing port 420*d*.

Floor-engaging, adjustable levelers or feet 438 are attached to lower ends of the first and second vertical beams 402 and 404 (e.g. via holes 423).

Figure 10:
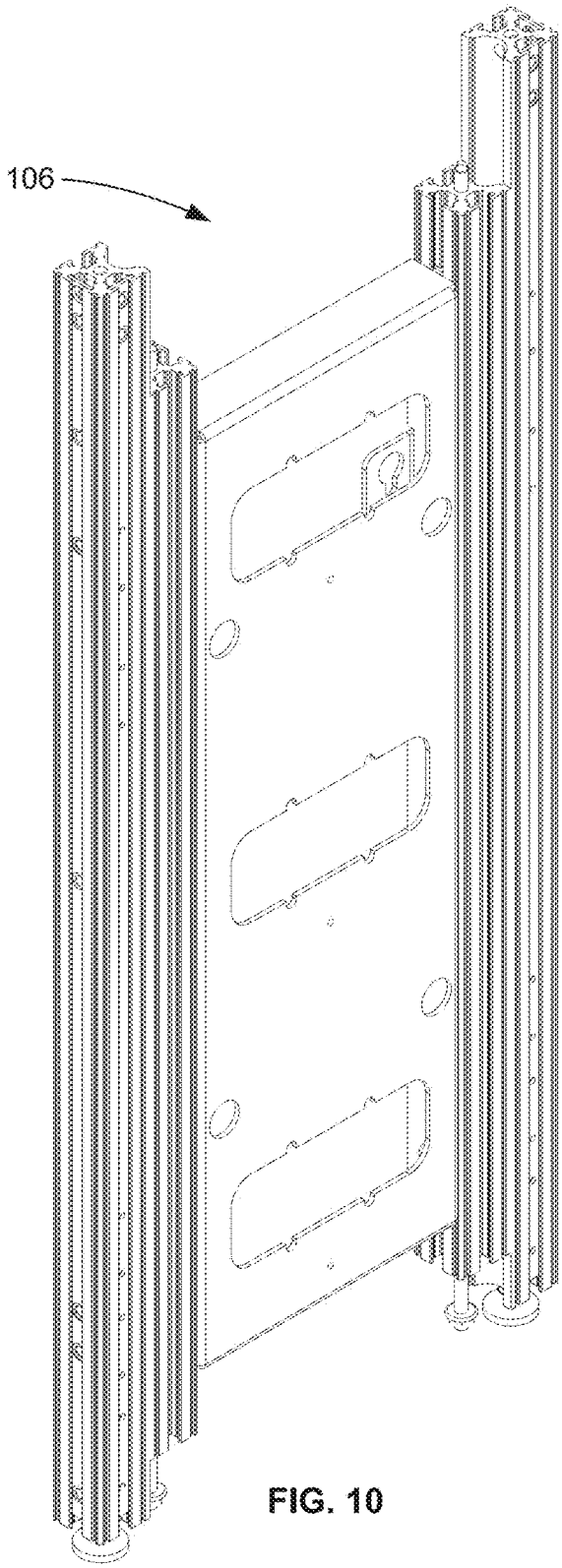
FIG. 10 is a perspective view of the leg frame of FIG. 8, as assembled.

FIG. 10 shows the first leg frame 106 as assembled. As mentioned above, the first leg frame 106 mirrors the structure of the second leg frame 108 of FIGS. 8 and 9.

Figure 11:
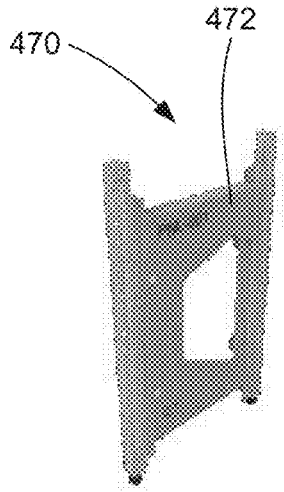
FIGS. 11 and 12 are perspective views of example leg frames according to further embodiments.
Figure 12:
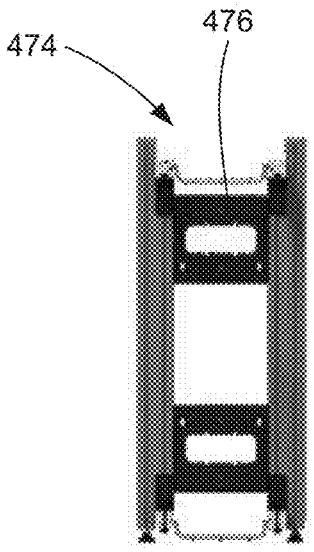

FIG. 11 shows an alternative leg frame 470 with another example frame panel 472. FIG. 12 shows another alternative leg frame 474 with yet another example frame panel 476. Embodiments are not limited to the specific leg frame structure shown in the drawings, and leg frames may be customized according to desired functionality and appearance. Embodiments described herein are not limited to leg frames comprising spaced apart vertical beams with panels or other frame elements therebetween. For example, a leg frame may comprise a single panel, beam, or loop-shaped element that engages the ground in other embodiments.

Figure 13:
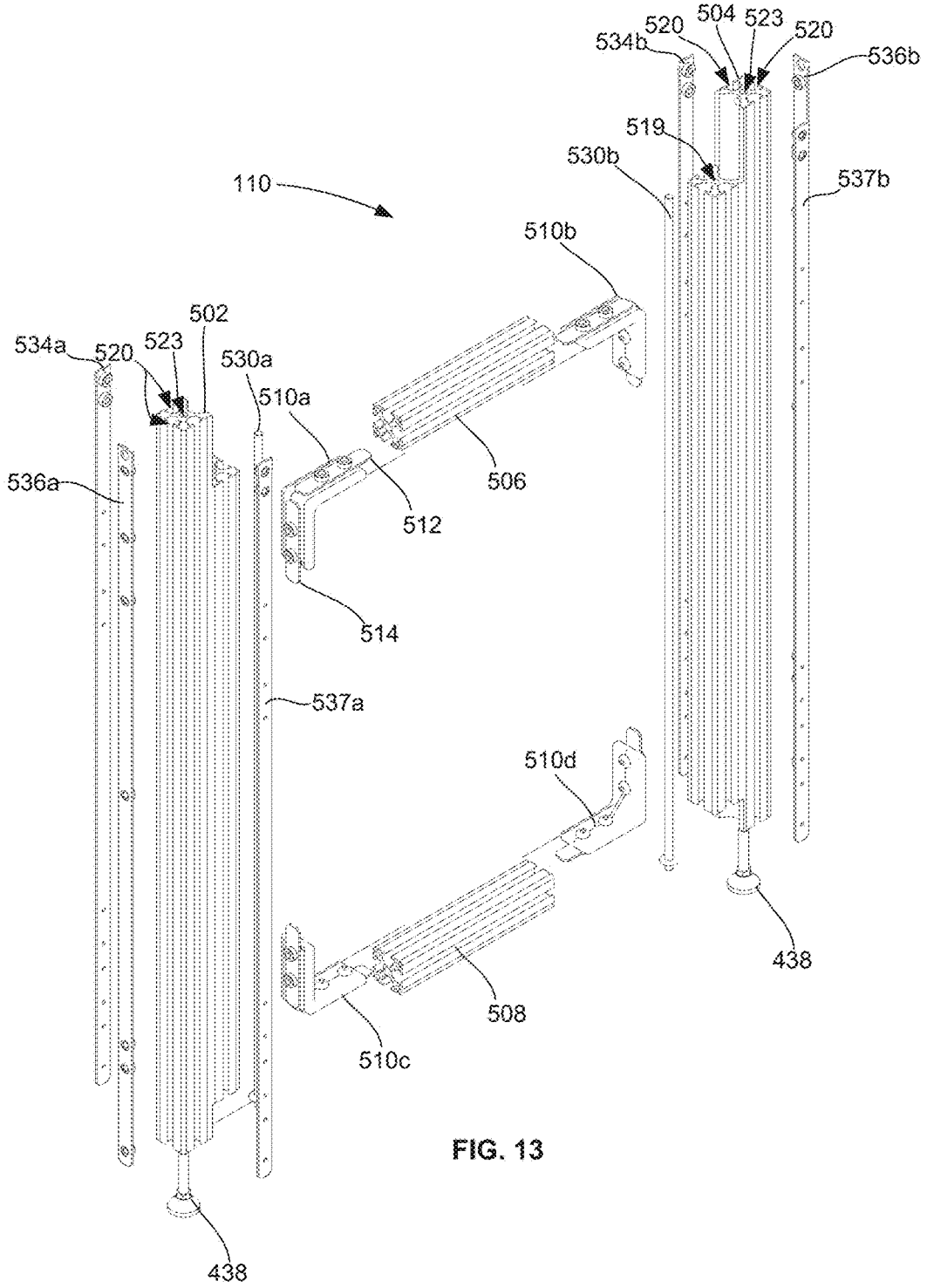
FIG. 13 is an exploded perspective view of an intermediate frame section of the frame module of FIG. 1.

FIG. 13 is an exploded perspective view the intermediate frame section 110 of the frame module 100 of FIG. 1. The intermediate frame section 110 includes opposing first and second vertical beams 502 and 504 that are similar in structure to the first and second vertical beams 402 and 404 of the leg frames 106 and 108 shown in FIGS. 8 to 10 and described above (including corresponding ports 520 and holes 519 and 523). The intermediate frame section 110 further includes upper and lower cross beams 506 and 508 interconnecting the first and second vertical beams 506 and 508. The cross beams 506 and 508 are attached to the first and second vertical beams 502 and 504 via L-shaped brackets 510*a*, 510*b*, 510*c* and 510*d* (which each include respective strips 512 and 514 for insertion in the corresponding ports of the first and second vertical beams 502 and 504 and cross beams 506 and 508 respectively). The brackets 510*a*, 510*b*, 510*c* and 510*d* in this example match the outer side profile of the beams to which they attach. The cross beams 506 and 508 have cross sectional profiles that match the upper beams 202 and 204 and the lower beams 302 and 304 described above. The cross beams 506 and 508 may be metal extrusions, for example. Rods 530*a* and 530*b* are received in corresponding holes 519. Attachment strips 534*a*, 534*b*, 536*a*, 536*b*, 537*a* and 537*b* are received in corresponding ports 520, similar to the leg frames 106 and 108 shown in FIGS. 8 to 10.

Figure 14:
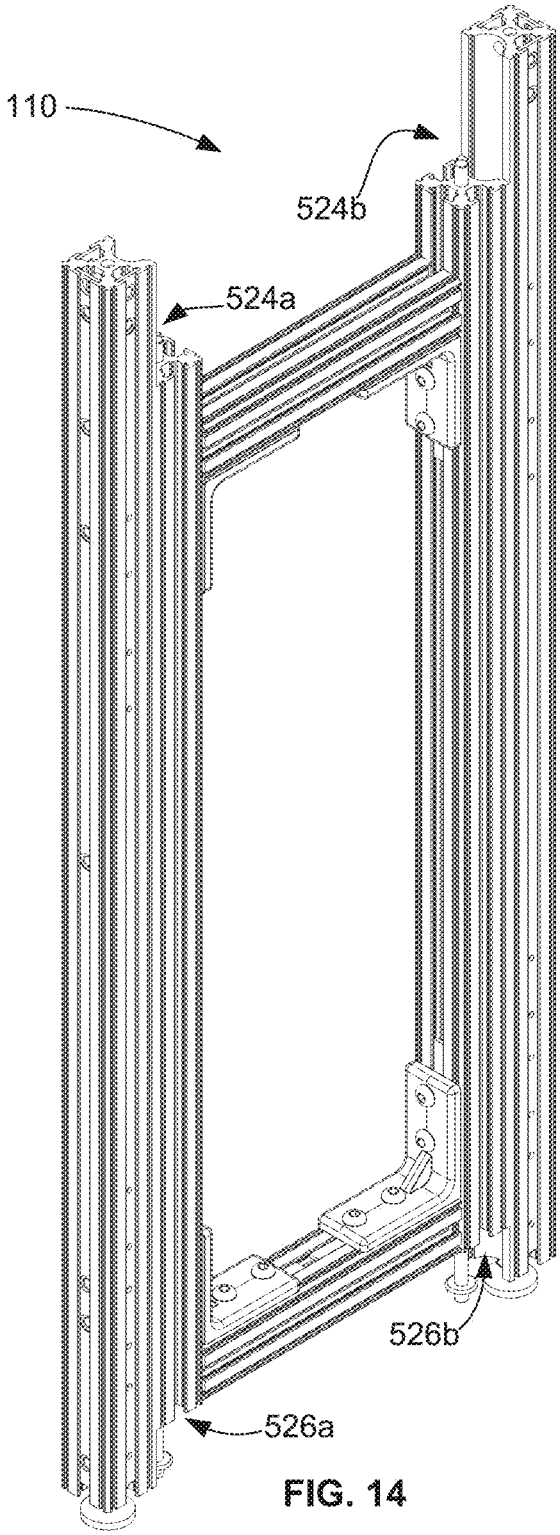
FIG. 14 is a perspective view of the assembled intermediate frame section of FIG. 13.

FIG. 14 shows the assembled intermediate frame section 110 of FIG. 13. Similar to the leg frames 106 and 108 shown in FIGS. 8 to 10, the intermediate frame defines upper corner notches 524*a*, 524*b* and lower corner notches 526*a* and 526*b* in the vertical beams 502 and 504.

Figure 15:
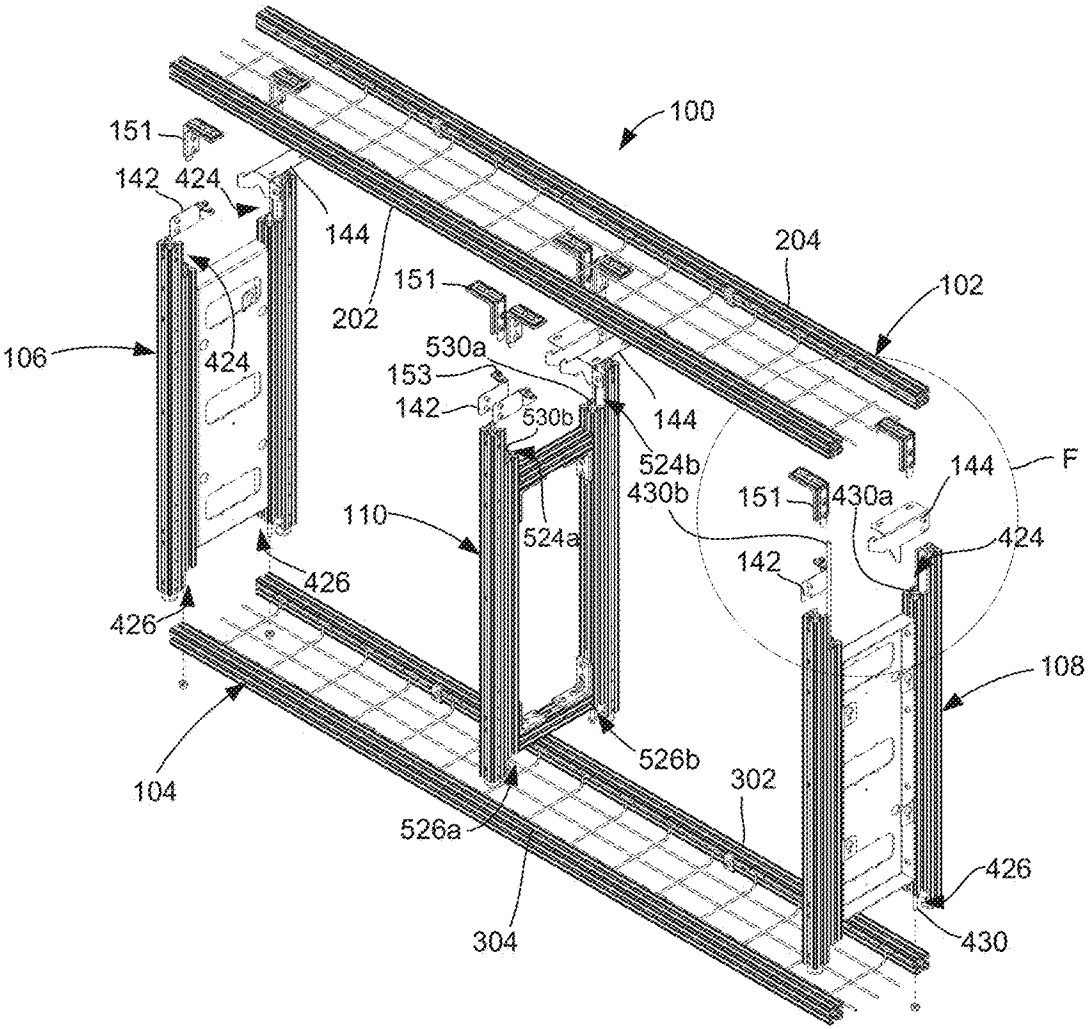
FIG. 15 is an exploded perspective view of the frame module of FIG. 1.

FIG. 15 is an exploded perspective view of the frame module 100 of FIG. 1. The upper beams 202 and 204 are received on the upper corner notches 424 of the leg frames 106 and 108 and on the upper corner notches 524*a* and 524*b* of the intermediate frame section 110. The lower beams 302 and 304 are received in the lower corner notches 426 of the leg frames 106 and 108 and the lower corner notches 526*a* and 526*b* of the intermediate frame section 110. The intermediate frame section 110 may essentially slide along the upper beams 202 and 204 and the lower beams 302 and 304 for horizontal position adjustment. Screws or other fastening hardware (e.g. clamps, bolts, clips, etc.) may selectively secure the intermediate frame section in a desired position. In other embodiments, the intermediate frame section may only engage notched/recesses in one of the upper and lower frame sections. Other methods for providing the horizontal adjustment of the intermediate frame may also be used. For example, a sliding rail/hinge connection may be provided. For example, the intermediate section may include at least one extension engaged in an elongate slot in the upper and/or lower frame sections 102 and 104 in a sliding manner. One or more releasable clips or the like may be used to selectively secure the intermediate frame section 110 to the upper and/or lower frame sections 102 and 104. Other configurations are also possible.

In this example, L-shaped brackets 151 (each similar to the brackets 510*a* to 510*d* in FIG. 13) attach the leg frames 106 and 108 and the intermediate frame section 110 to the upper frame section 102. The rods 430*a*, 430*b*, 530*a* and 530*b* extend through corresponding holes (not shown) in the lower beams 302 and 304 of the lower frame section 104 and into corresponding holes (not shown) in the upper frame section 102. Such corresponding holes in the upper frame section may be threaded and the rods 430*a*, 430*b*, 530*a* and 530*b* may be threaded at the upper ends thereof to engage the corresponding holes. The lower frame section 104 may thereby be fixed to the leg frames 106 and 108 and the intermediate frame section 110 by the rods 430. Rods 530*a* and 530*b* may be removed for repositioning the intermediate frame section 110. In other embodiments, the rods 530*a* and 530*b* may be omitted.

FIG. 15 also shows snap-clip brackets 142 and deck mounting brackets 144. The deck mounting brackets 144 attach to and support a work surface panel or other surface of a console.

Figure 16:
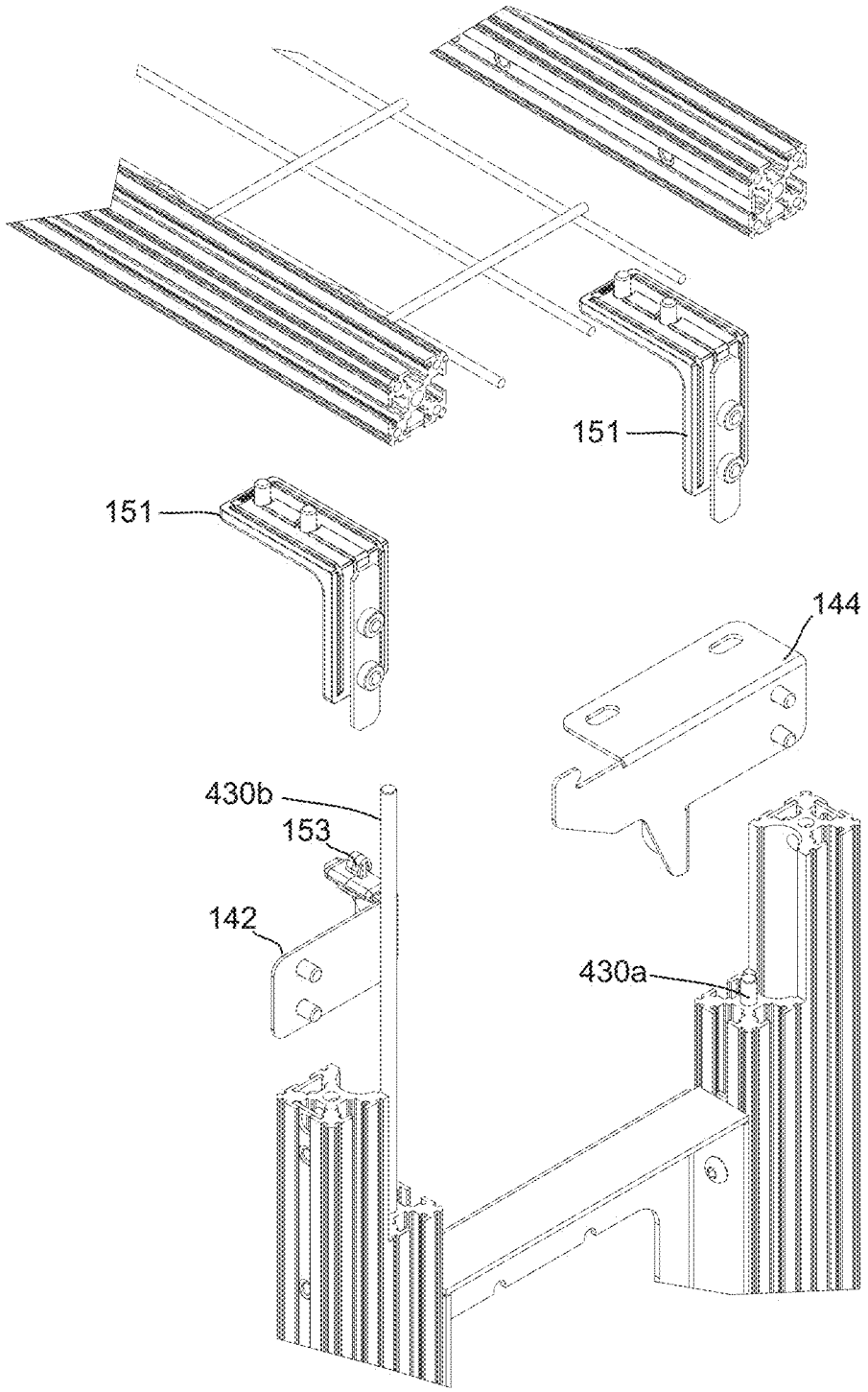
FIG. 16 is an enlarged view of the portion of the frame module within the circle marked "F" in FIG. 15.

FIG. 16 shows an enlarged view of the portion of the frame module 100 within the circle marked "F" in FIG. 15. Details of the L-shaped brackets 151, snap-clip brackets 142 and deck mounting brackets 144 and their arrangement are more clearly visible in this Figure. The snap-clip brackets 142 each have a respective, upward facing snap clip 153.

As will be appreciated, embodiments are not limited to the size, dimensions, relative angles, shape and arrangement of the particular console frame module 100 in FIGS. 1 and 15. Such structural details may vary in other embodiments. The materials used may also vary (e.g. metal, plastic, wood, or a combination thereof).

The frame module 100 described above may be relatively easy and quick to assemble, and may be easily customized for various uses and configurations. The ports 220, 320 and 420 in the various beams of the frame module 100 may allow for mounting equipment and attachment of various elements in a wide variety of positions. Attachment strips with holes/nuts that are received in the ports may be customized depending on particular needs). The ports 220, 320 and 420 may allow metric or imperial hardware to be used for mounting components. The frame may have improved strength and parametric flexibility. Using extrusions for the various beams may allow efficient fabrication. As another example of customization, the frame module may have an expandable depth (e.g. by changing the length of beams or adding additional frame sections/pieces).

Figure 17:
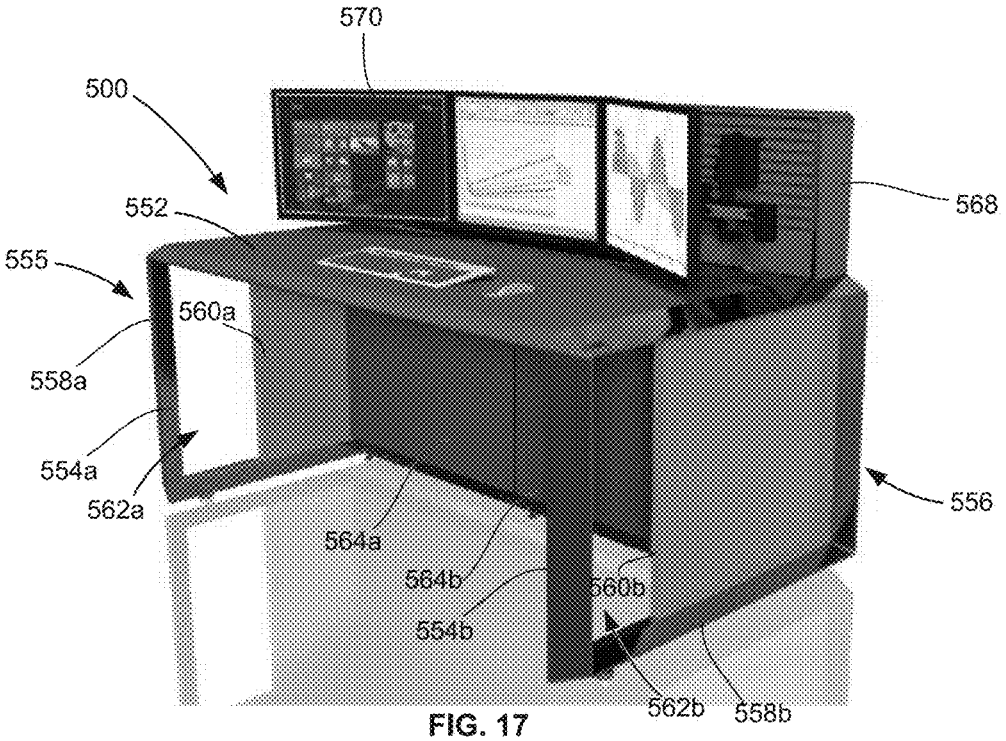
FIGS. 17 and 18 are front and rear perspective views, respectively, of an example console according to some embodiments.
Figure 18:
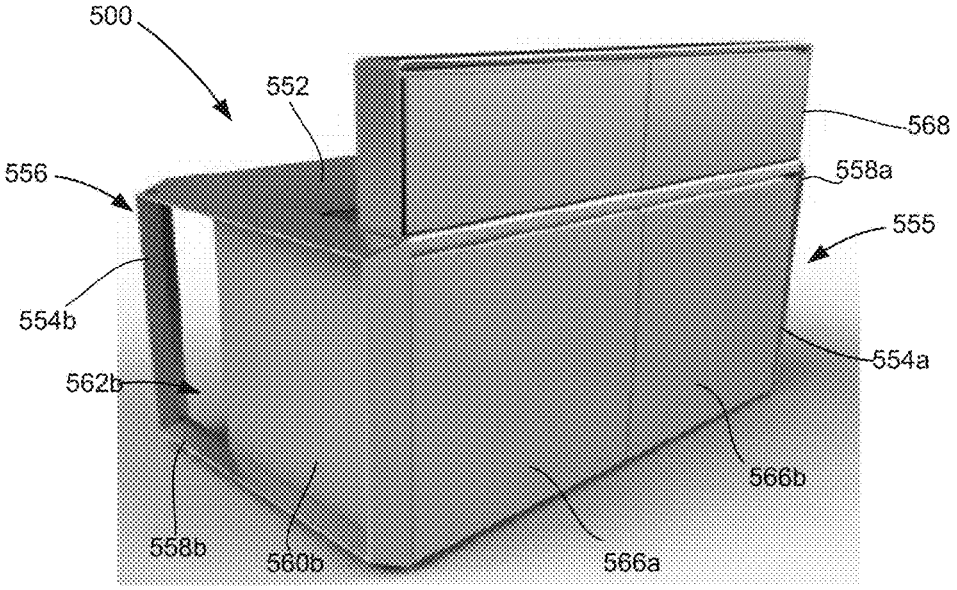

FIGS. 17 and 18 are front and rear perspective views, respectively, of an example console 500 according to some embodiments. The console 500 is built on and includes the frame module 100 shown in FIG. 1, although the frame module 100 is not visible in FIGS. 17 and 18. Furthermore, embodiments are not limited to the specific frame module 100, and other frame module structures may be used.

The console 500 includes a work surface panel 552 mounted to the upper frame section 102 of the frame module 100 (FIG. 1). Optional end panel assemblies 554*a* and 554*b* are mounted at opposite sides 555 and 556 of the console respectively. More specifically, in this embodiment, the end panel assemblies 554*a* and 554*b* are mounted to the first and second leg frames 106 and 108 (FIG. 1) at first and second sides 154 and 156 of the frame module 100 shown in FIG. 1. Each end panel assembly 554*a* and 554*b* includes a respective loop-shaped end panel frame 558*a* or 558*b* and a respective end panel insert 560*a* or 560*b*. Each end panel insert 560*a* and 560*b* is secured within the corresponding end panel frame 558*a* or 558*b*. The end panels may be customizable by allowing multiple different types of inserts to be used in place of the inserts 560*a* and 560*b* shown. In this example the inserts 560*a* and 560*b* are each a laminate insert, but other panel inserts (glass, metal, etc.) may be used. The inserts 560*a* and 560*b* only partially fill the end panel frame 558*a* or 558*b*, thereby leaving a openings 562*a* and 562*b*. Other end panel inserts in other embodiments may completely fill the end panel frames. In still other embodiments, the end panels 554*a* and 554*b* may be omitted. For example, the console 500 may include one or more feet or other floor engaging supports (e.g. mounted to the frame module 100 of FIG. 1), rather than end panel assemblies.

The console 500 in this example includes adjacent front panels 564*a* and 564*b* and adjacent rear panels 566*a* and 566*b*. The front panels 564*a* and 564*b* are attached to and cover the front 150 of the frame module 100 (FIG. 1). The adjacent rear panels 566*a* and 566*b* are attached to and cover the rear 152 of the frame module 100 (FIG. 1). As will be explained in more detail below, the console modules described herein may be configured with various storage spaces. The front panels 564*a* and 564*b* and/or the rear panels 566*a* and 566*b* may be removable or openable to provide access to such storage spaces. For example, the front panels 564*a* and 564*b* and/or rear panels 566*a* and 566*b* may be doors (e.g. connected to the frame module 100 by hinges) and may be reversible. Other panel configurations and/or other outer coverings may also be used.

The console 500 also includes optional slat wall assembly 568 with displays 520 mounted thereto. It will be appreciated that various equipment may be attached to the console 500 by various methods and in various configurations. Embodiments are not limited to the slat wall assembly 569 shown.

In some embodiments, two or more frame modules (such as the frame module 100 shown in FIG. 1) may be connected in series to one other at varying angles. The overall width and shape of the console using the frame modules may, thus, be customized.

Figure 19:
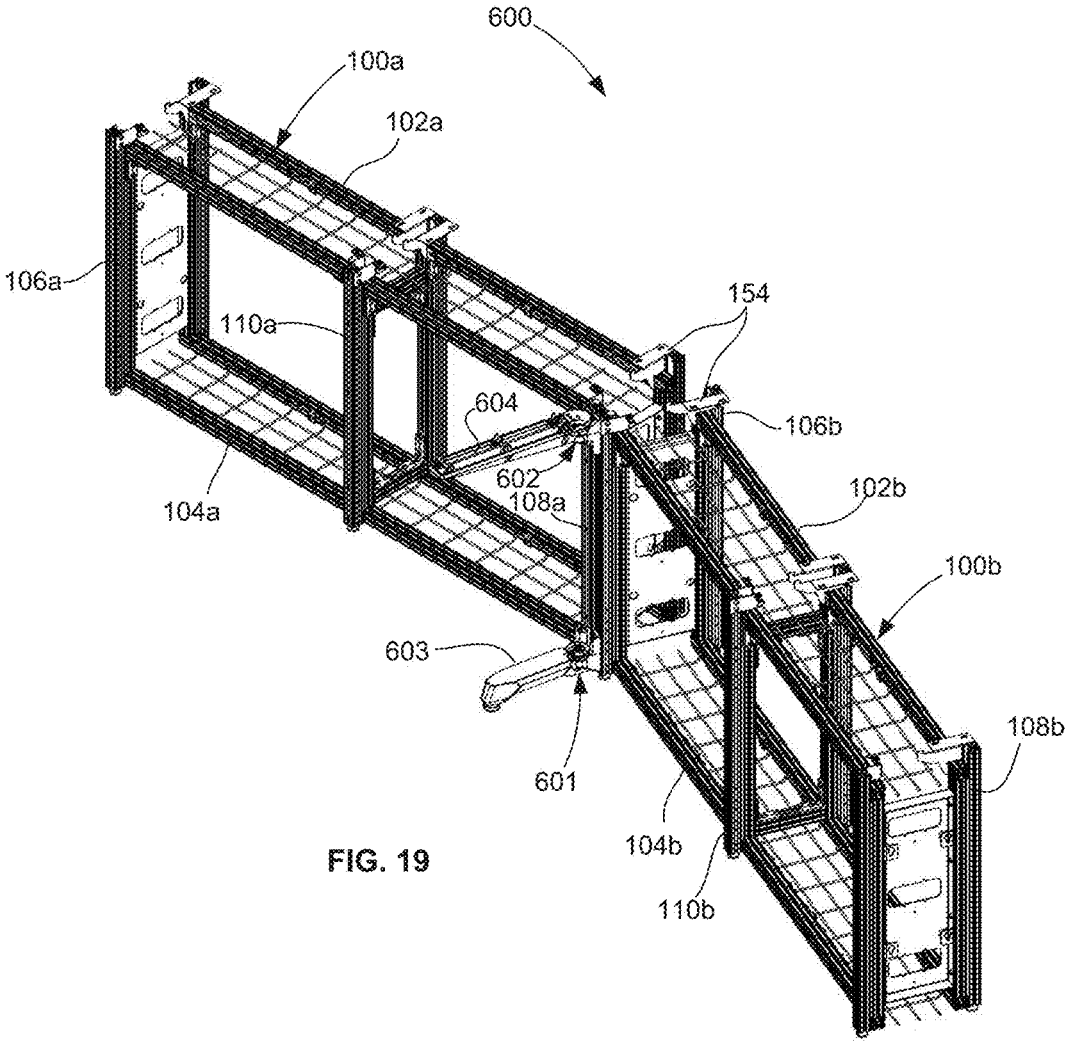
FIG. 19 is a partial perspective view of a console frame structure, including first and second frame modules, according to some embodiments.

FIG. 19 is a partial perspective view of a console frame structure 600 including first and second frame modules 100*a* and 100*b* (each having similar structure as the frame module 100 of FIGS. 1 and 13 in this example). The first frame module 100*a* includes upper frame section 102*a* and lower frame section 104*a*, which interconnect first and second leg frames 106*a* and 108*a*. Intermediate frames 110*a* and 110*b* are also shown. The second frame module 100*b* includes upper frame section 102*b* and lower frame section 104*b*, which interconnect first and second leg frames 106*b* and 108*b*. The first and second frame modules 100*a* and 100*b* are pivotally connected at a second leg frame 108*a* of the first frame module 100*a* and a first leg frame 106*b* of the second frame module 100*b*.

One or more support members may be attached to the first and second pivot connections 601 and 602. In this example, a foot 603 and a first support arm 604 are pivotably connected to the first and second frame modules 100*a* and 100*b*, respectively, by the first and second pivot connections 601 and 602. The foot 603 engages a floor surface (not shown). The support arm 604 is for supporting a work surface panel (not shown). The first and second pivot connections 601 functions as an angle dial that allows generally horizontal rotational/pivoting movement of the first and second frame modules 100*a* and 100*b* and the foot 603 with respect to each other. Similarly, the second pivot connection 602 allows generally horizontal rotation/pivoting movement of the first and second frame modules 100*a* and 100*b* and the first support arm 604 with respect to each other. Thus, the relative angles of the first and second frame modules 100*a* and 100*b* is adjustable, as is the relative angle of the foot 603 and the first support arm 604. Other types of support members may also be attached by pivot connections 601 and 602, and/or the foot 603 and support arm 604 may be omitted. For example, support for a lamp or other lighting element may be attached by one of the pivot connections 601 and 602. Also, more or fewer pivot connections may be used.

The support arm 604 extends forward from the upper ends of the leg frames 108*a* and 106*b* at a height aligned with the deck mounting brackets 144 for supporting one or more work surface panels (not shown). Additional support arms and/or feet may be attached to the frame modules 100*a* and/or 100*b*. For example, one or more feet similar to the foot 603 may be attached to the intermediate frame section 110*a* or 110*b* or to the other leg frames 106*a* and 108*b*.

Figure 20:
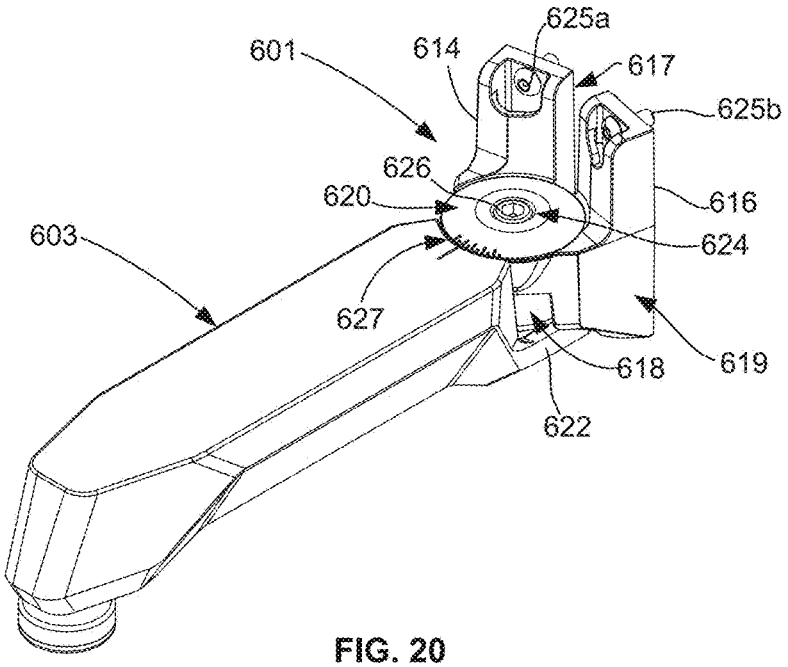
FIGS. 20 and 21 are front and rear views, respectively, of a foot and a first pivot connection of the console frame structure of FIG. 19.
Figure 21:
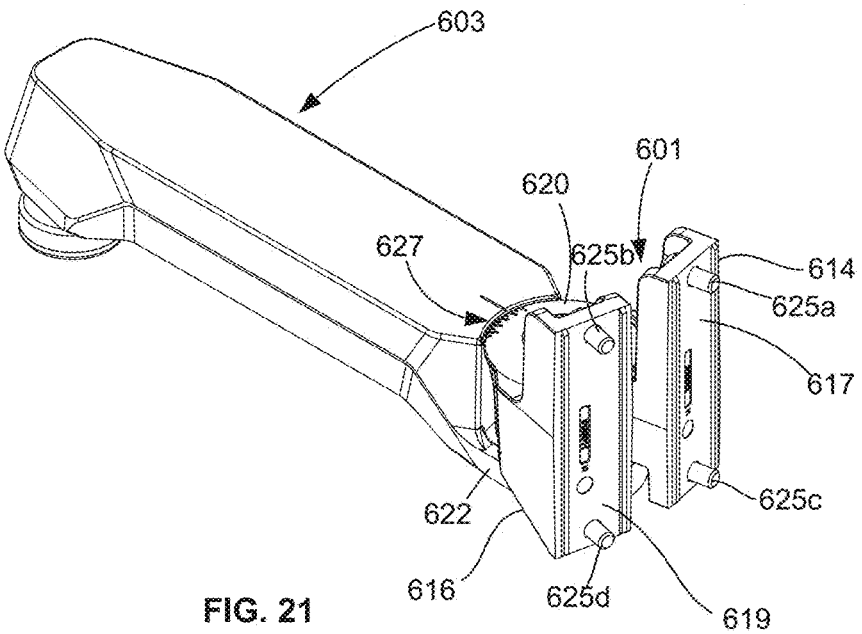

FIGS. 20 and 21 are front and rear views, respectively, of the foot 603 and first pivot connection 601. As shown, the first pivot connection 601 includes a first hinge piece 614 and second hinge piece 616. The first hinge piece 614 includes a bracket portion 617 that attaches to the second leg frame 108*a* of the first frame module 100*a* (FIG. 19). The first hinge piece 614 also includes a generally horizontal extension 618 that is donut-shaped with a generally vertical hole (not visible) therethough. The second hinge piece 616 includes a bracket portion 619 that attaches to the first leg frame 106*b* of the second frame module 100*b* (FIG. 19). The second hinge piece 616 also includes a generally horizontal extension 620 that is donut-shaped with a vertical hole 624 therethough. The donut-shaped extension 620 of the second hinge piece 616 in this example sits on top of the donut-shaped extension 618, and the hole 624 of the second hinge piece 616 vertically aligned with the hole (not visible) in the first hinge piece 614. Embodiments are not limited to the particular pivot connection structure detailed above. Other hinge structures may be used to pivotably connect adjacent frame modules and/or support members. For example, a first pivot hinge may connect the first frame module 100*a* and the second frame module 100*b*, and a second pivot hinge may connect a support member (e.g. foot 603 or support arm 604) to either the first or second frame module 100*a* or 100*b*. Other arrangements are also possible. The shape of individual hinge pieces providing the pivoting movement may also vary, as will be appreciated.

The foot 603 has a flange-like extension 622 positioned under the donut-shaped extension 618 of the first hinge piece 614. A pin 626 extends through the extension 622 of the foot 603 and through the aligned holes 624 in the first and second hinge pieces 614 and 616 to secure the first hinge piece 614, the second hinge piece 616 and the foot 603 together, thereby forming the pivot connection 601. The first and second hinge pieces 614 and 616 and the foot 603 are thus pivotable about the pin 626 with respect to one another.

Optional angle indicator markings 627 on the foot 603 and second hinge piece 616 in FIGS. 20 and 21 provide a visual indication of the angle of the foot 603 relative to the second hinge piece 616.

FIG. 21 also show screws 625*a* to 625*d* that attach the pivot connection 601 to the second leg frame 108*a* of the first frame module 100*a* and the first leg frame 106*b* of the second frame module 100*b* (FIG. 19). However, any suitable means for attaching the pivot connection 601 to two adjacent frame modules may be used.

Figure 22:
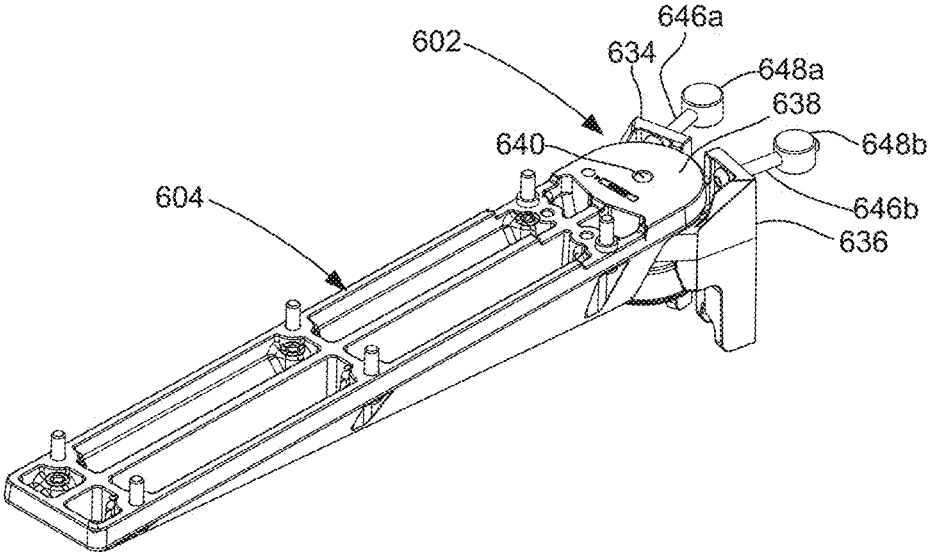
FIGS. 22 and 23 are front and rear views, respectively, of a support arm and a second pivot connection of the console frame structure of FIG. 19.
Figure 23:
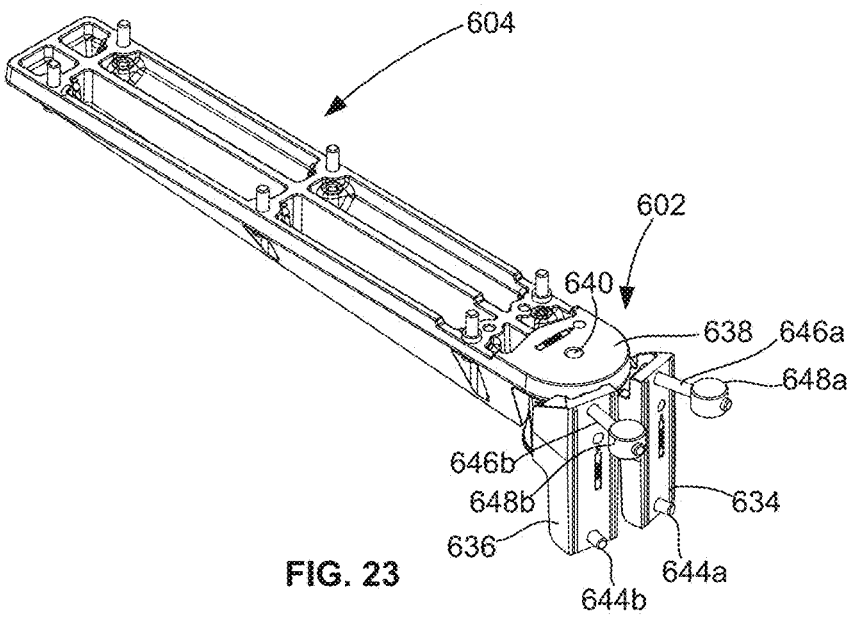

FIGS. 22 and 23 are front and rear views, respectively, of the support arm 604 and second pivot connection 602. As shown, the second pivot connection 602 includes a first hinge piece 634 and second hinge piece 636. The first and second hinge pieces 634 and 636 of the second pivot connection 602 are similar to the first and second hinge pieces 614 and 616 of the first pivot connection in FIGS. 19 to 21, but vertically flipped. Similarly, the support arm 604 includes a horizontal extension 638, and a pin 640 extends through and secures the extension 638 and the first and second hinge pieces 634 and 636 to one another. The first and second hinge pieces 634 and 636 and the support arm 604 are, thus, pivotably connected.

In this embodiment, second pivot connection 602 attaches to the first and second frame modules 100*a* and 100*b* by means of screws 644*a* and 644*b*, as well as first and second bolts 646*a* and 646*b*. First and second cylindrical block members 648*a* and 648*b* attach to the bolts 646*a* and 646*b* as shown.

Figure 24:
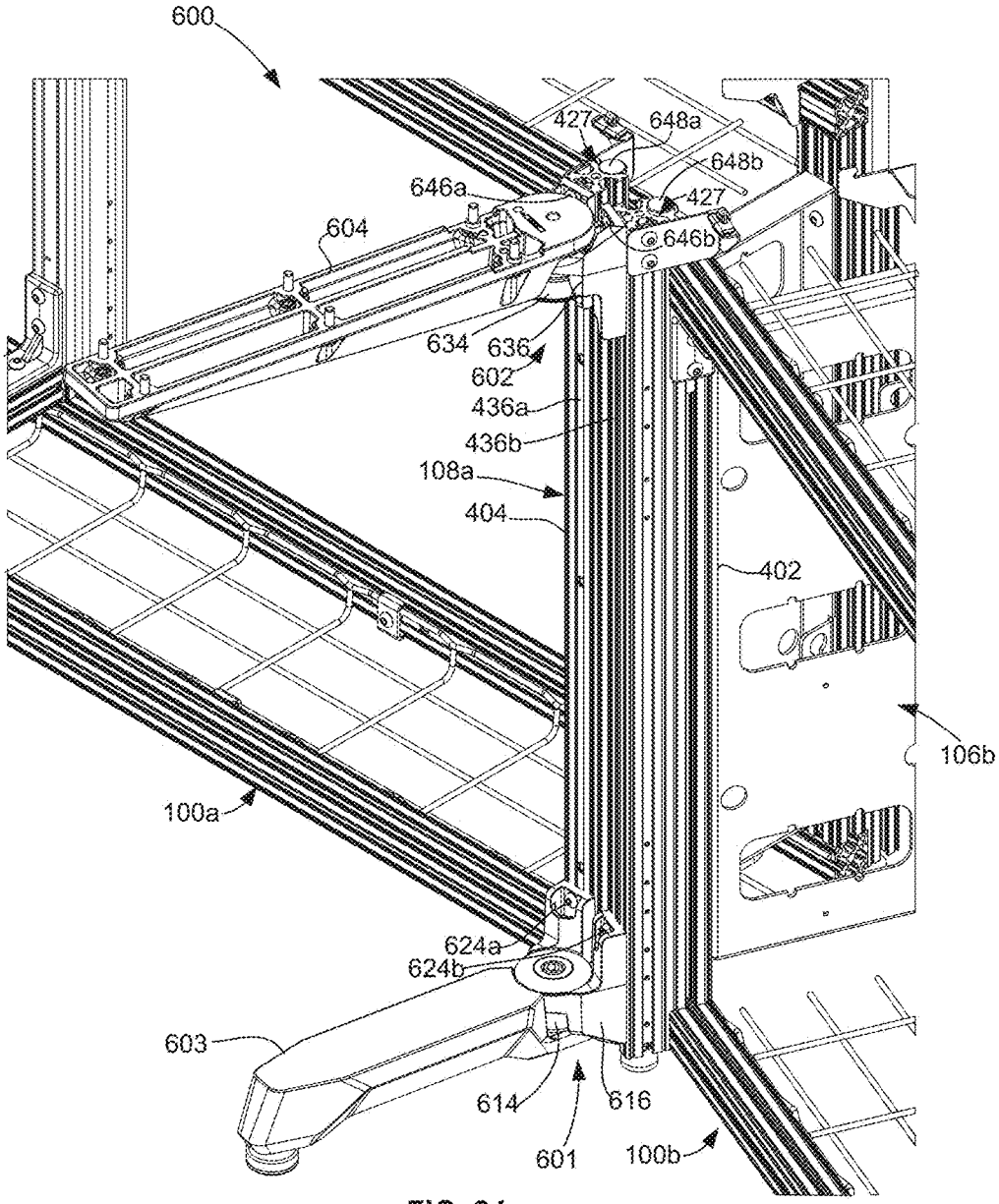
FIG. 24 is an enlarged partial view of the console frame structure of FIG. 19.

FIG. 24 is an enlarged partial view of the console frame structure 600 of FIG. 19. Attachment of the first and second pivot connections 601 and 602 to the first and second frame modules 100*a* and 100*b* will now be described in more detail.

For the first pivot connection 601, the screws 624*a*, 624*b*, 624*c* and 624*d* (shown in FIGS. 20 and 21) attach the first and second hinge pieces 614 and 616 to the corresponding attachment strips 436*a* and 436*b* in the second leg frame 108*a* and the first leg frame 106*b*. The first hinge piece 614 of the first pivot connection 601 is thus secured to the second leg frame 108*a* of the first frame module 100*a*, and the second hinge piece 616 is secured to the first leg frame 106*b* of the second frame module 100*b*.

For the second pivot connection 602, bolt 646*a* extends through the first hinge piece 634 and through hole 429 (shown in FIG. 9) of vertical beam 404 of the second leg frame 108*a* of the first frame module 100*a*. The other bolt 646*b* extends through a corresponding hole of vertical beams 402 of the first leg frame 106*b* of the second frame module 100*b*. The cylindrical block members 648*a* and 648*b* are received in grooves 427 (also shown in FIG. 9) of the vertical beam 402 and 404 and attached to the bolts 646*a* and 646*b*. As mentioned above, attachment strips 436*a* and 436*b* are received in corresponding ports 420*d* of the first and second vertical beams 402 and 404 of the first leg frame 106*b* and the second leg frame 108*a*. The screws 644*a* and 644*b* (shown in FIG. 23) extend through the first and second hinge pieces 634 and 636 of the second hinge connection 602 and attach to corresponding threaded holes (not visible) in the attachment strips 436*a* and 436*b*.

Figure 25:
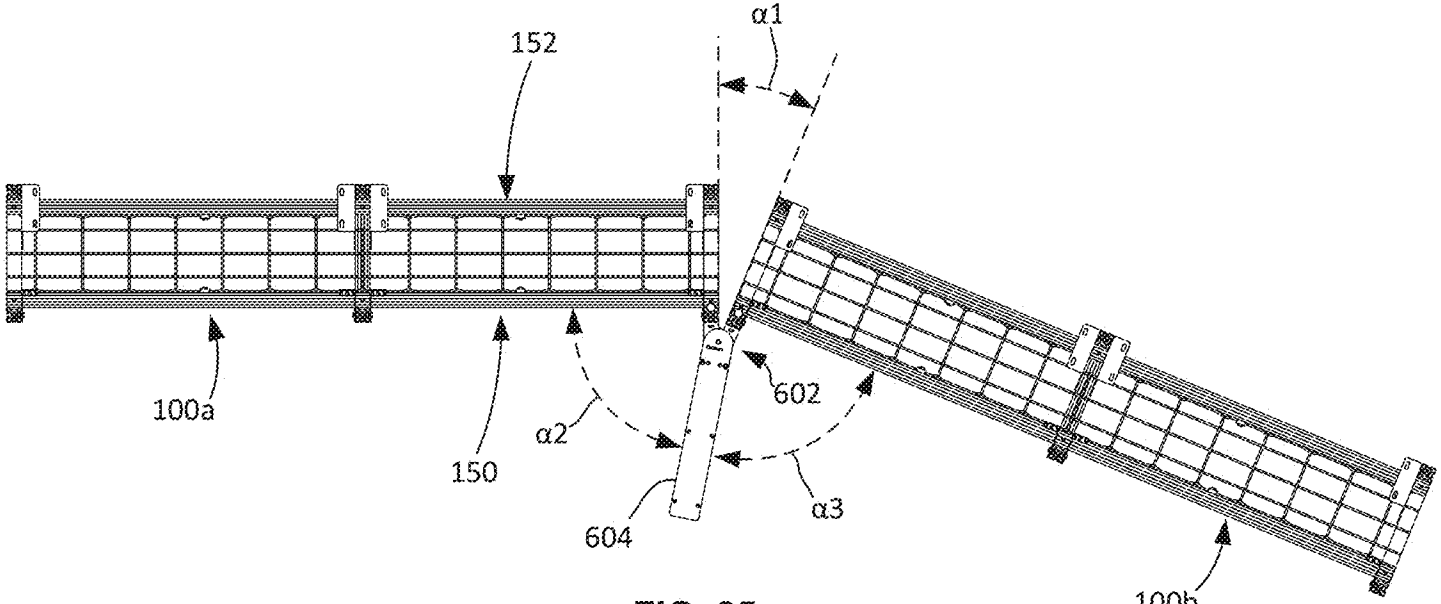
FIG. 25 is a top view of the console frame structure of FIG. 19.

FIG. 25 is a top view of the console frame structure 600 illustrating a first relative angle α1 between the first and second frame modules 100*a* and 100*b*; a second relative angle α2 between the first frame module 100*a* and the support arm 604; and a third relative angle α3 between the second frame module 100*b* and the support arm 604. These angles α1, α2 and α3 are adjustable due to the pivoting provided by the first pivot connection 601 (FIGS. 19 and 22 to 24) and the second pivot connection 602. The foot 603 (FIGS. 19 to 21 and 24) is similarly adjustable.

In the example of FIGS. 19, 24 and 25, the first and second frame modules 100*a* and 100*b* have a "forward" angle with respect to one another (i.e. the first and second pivot connections 601 and 602 are at the front 150 of the frame modules 100*a* and 100*b*. However, the pivot connections 601 and 602 may alternately be made at the rear 152 of the frame modules 100*a* and 100*b*, to provide a "reverse" angle.

Figure 26:
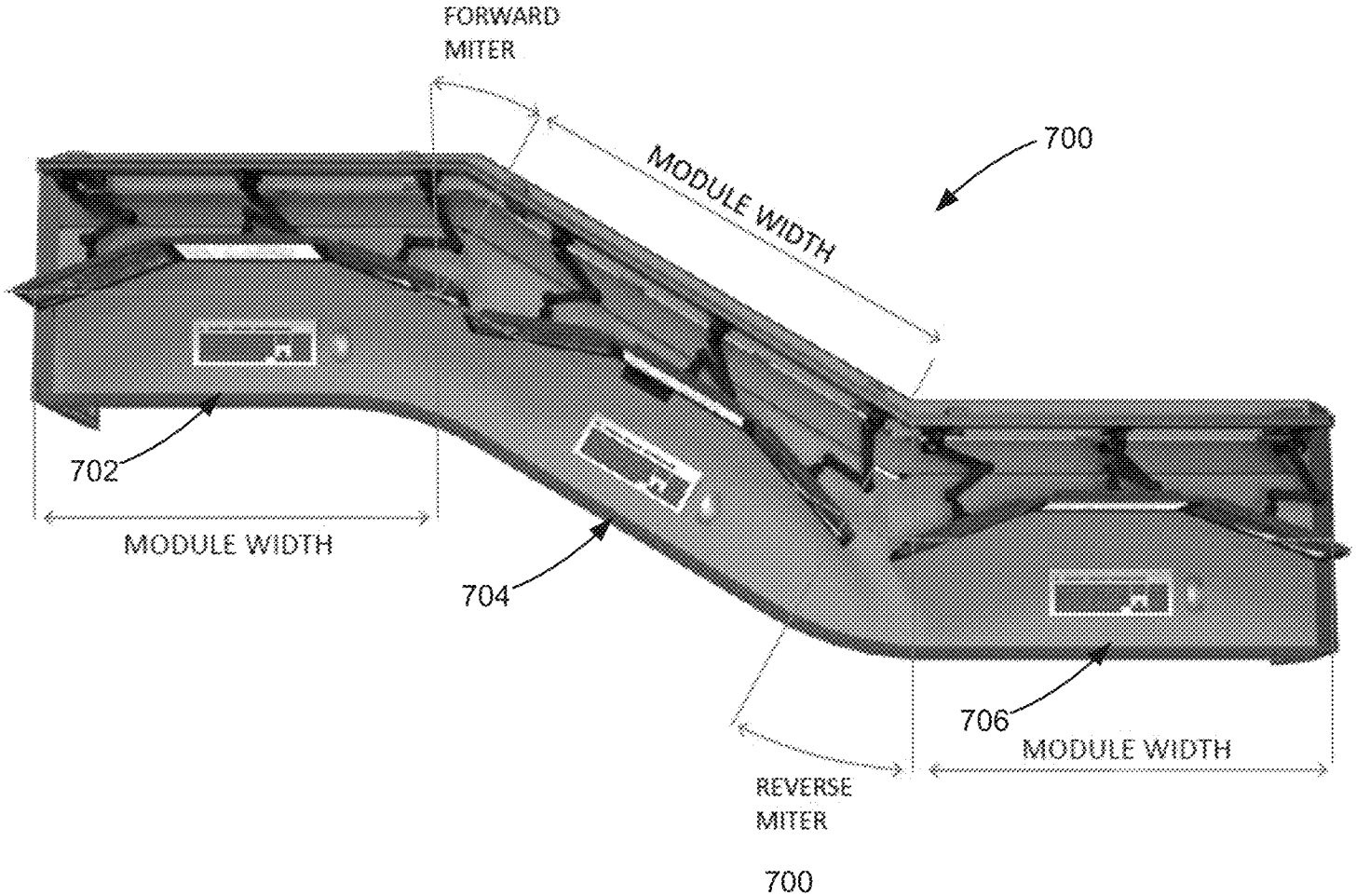
FIG. 26 is a top view of an example console according to another embodiment.

For other embodiments including three or more frame modules, a combination of forward and reverse angles may be used. Thus, the angles and the of console frame structures that may be provided is variable and customizable. For example, FIG. 26 is a top view of an example console 700 that includes three sections 702, 704 and 706, with each section including a frame module (not shown) as described herein. The first and second console sections 702 and 704 have a forward angle with respect to each other, while the second and third console sections 704 and 706 have a reverse angle with respect to each other.

Figure 27:
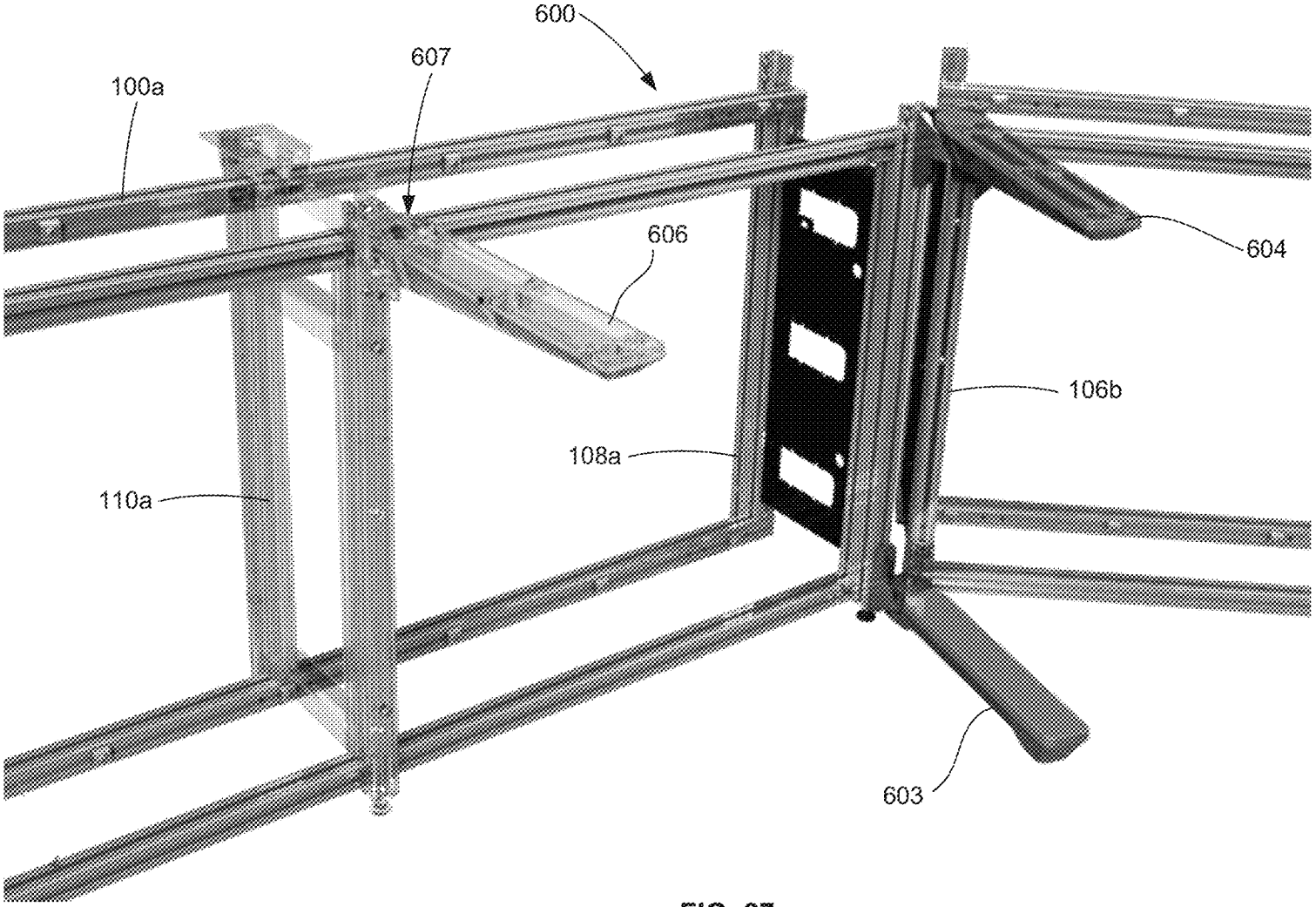
FIG. 27 is a partial perspective view of the console frame structure of FIGS. 19 and 25.

FIG. 27 is a partial perspective view of the console frame structure 600 of FIG. 25, but showing the intermediate frame section 110*a* of the first frame module 100*a* with a second support arm 606 attached thereto. The support arm is connected by a pivot hinge 607 to the first vertical beam 502 of the intermediate frame 110*a* (at its top) and extends forward from the intermediate frame 110*a*. The horizontal position of the second support arm 606 may be adjusted by adjusting the horizontal position of the intermediate frame 110. The angle of the second support arm 606 is also adjustable via the pivot hinge 607. A pivoting foot, similar to foot 603, may be connected to the bottom of the vertical beam 502 of the intermediate frame 110.

Similarly, one or more support arms or feet (not shown) may be attached, possibly with pivot hinges, to the leg frames 106*a*, 108*a*, 106*b* and/or 108*b* of the console frame structure.

Figure 28:
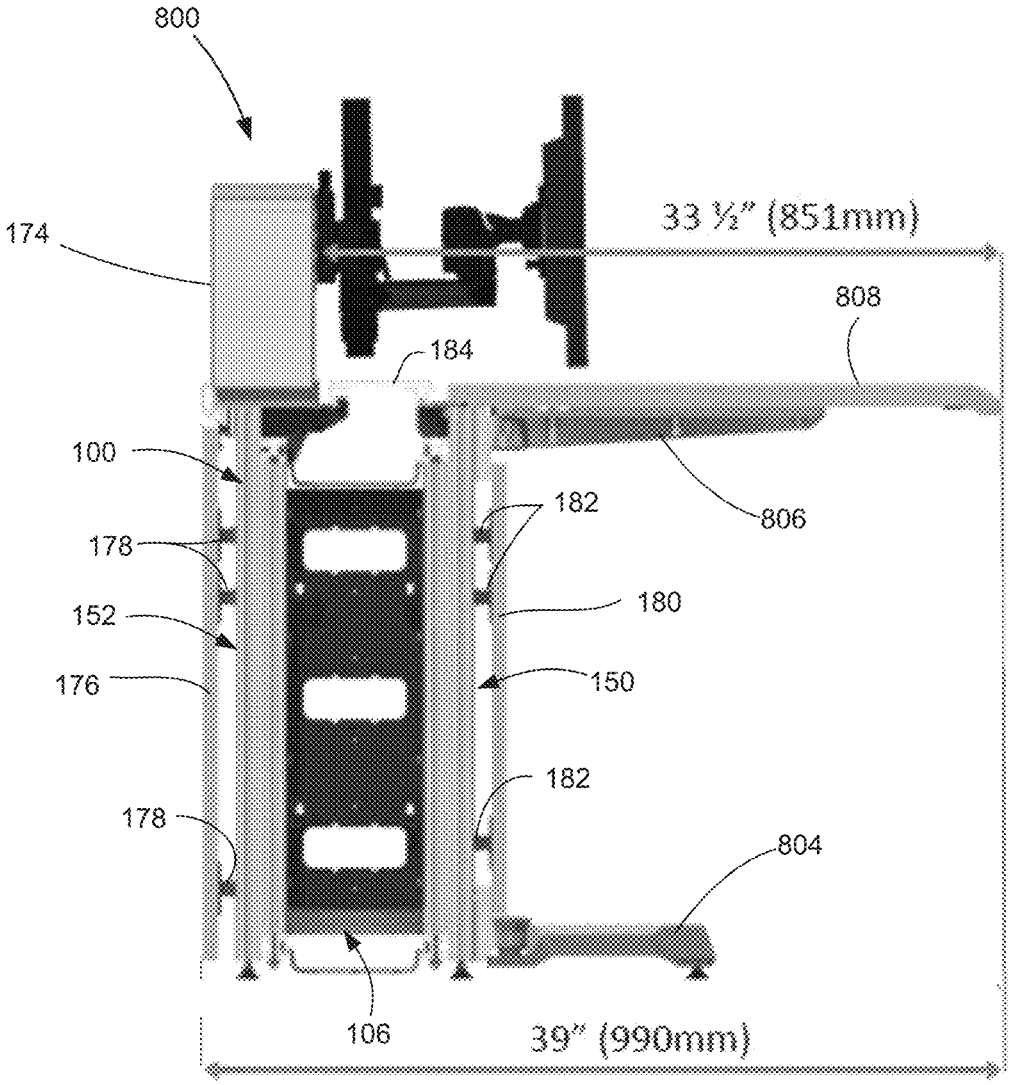
FIG. 28 is a side view of another example console according to another embodiment.

FIG. 28 is a side view of another example console 800 that includes the frame module 100 of FIG. 1. The console 800 includes feet 804 attached to and extending forward from the frame module 100. The console 800 also includes spaced apart support arms 806 (similar to the support arm 606 in FIG. 19) attached to and extending forward from the frame module 100. Only one of the support arms 806 is visible in FIG. 28 and is attached to the leg frame 106 as shown. The support arms 806 may be positioned to support work surface panel 808, which is mounted thereon. An optional slat wall assembly 174 is also mounted over the frame module 100 and positioned toward the its back 152. Rear panels or covers 176 are mounted to the frame module 100 by brackets 178. Front panels or covers 180 are mounted to the front 150 of the frame module 100 by brackets 182. The brackets 178 and 182 may attach to the frame module 100 by means of fastening hardware that engages the leg frames 106 and 108 (FIG. 1) and/or an intermediate frame section 110 (FIG. 1). Additional components (e.g. storage components, aesthetic components, cladding, etc.) may also be secured to the frame module 100 using the ports 220, 320 and/or 420 (FIG. 8) described above. The rear panel 176 and/or front panel 180 be openable to function as doors providing access to storage spaces or other components within the console 800. An access cover 184 is also shown in FIG. 28, which may attach to the snap clips 153 shown in FIGS. 15 and 16. The access cover 184 may be removed or have ventilation holes to provide for heat ventilation. The access cover 184 may provide for routing of cables from surface mounted equipment. Side panels (not shown) or end panel assemblies (not shown) may also be included.

Figure 29:
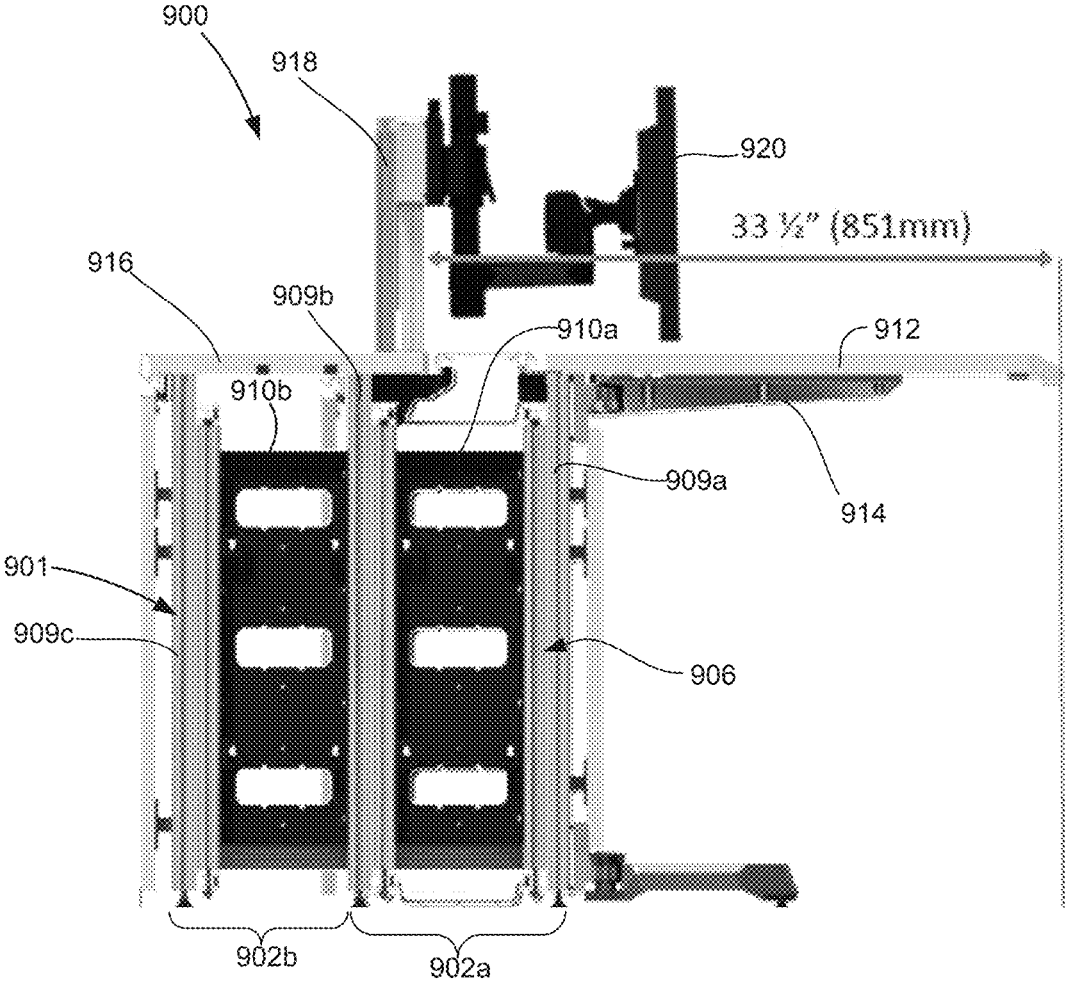
FIG. 29 is a side view of another example console according to another embodiment.

FIG. 29 is a side view of another example console 900 similar to the console 800 in FIG. 28, but with a frame module 901 that has extra depth. The frame module 901 includes a front section 902*a* and a rear section 902*b*. The front section 902*a* is similar to the frame module 100 in FIG. 1. The rear section 902*b* is, in effect, an expansion to the front section 902*a*. The first leg frame 906 of the frame module 901 is similar to the first leg frame 106 in FIG. 1 including first and second vertical beams 909*a* and 909*b* with a first frame panel 910*a* therebetween. However, the first leg frame 906 further includes a third vertical beam 909*c* and a second frame panel 910*b* between the second and third vertical beams 909*b* and 909*c*. The second leg frame (not visible) and intermediate frame (not visible) are similarly expanded. The frame module 901 may also include additional upper and lower beams (not shown) interconnecting the third vertical beams 908*c* of the first leg frame 906 and the second leg frame.

A first work surface panel 912 is mounted on two or more spaced apart support arms 914 of the console 900. In this example, a second work surface panel 916 is mounted generally over the second portion 902*b* of the frame module 901 (and partially over the first portion 902*a*). An optional slat rail 918 with display 920 attached thereto is also shown mounted on the frame module 901.

Figure 31:
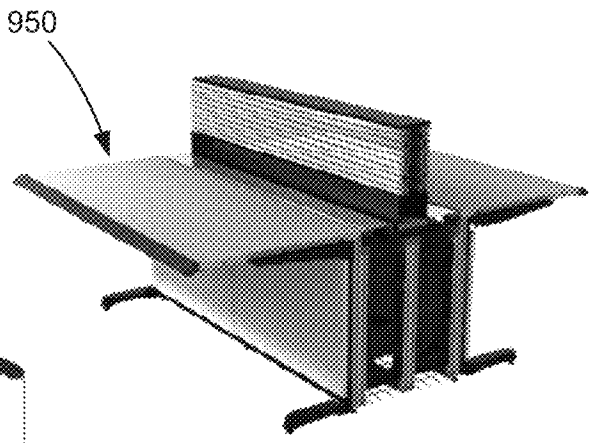
FIG. 31 is a perspective view of the console of FIG. 30.
Figure 30:
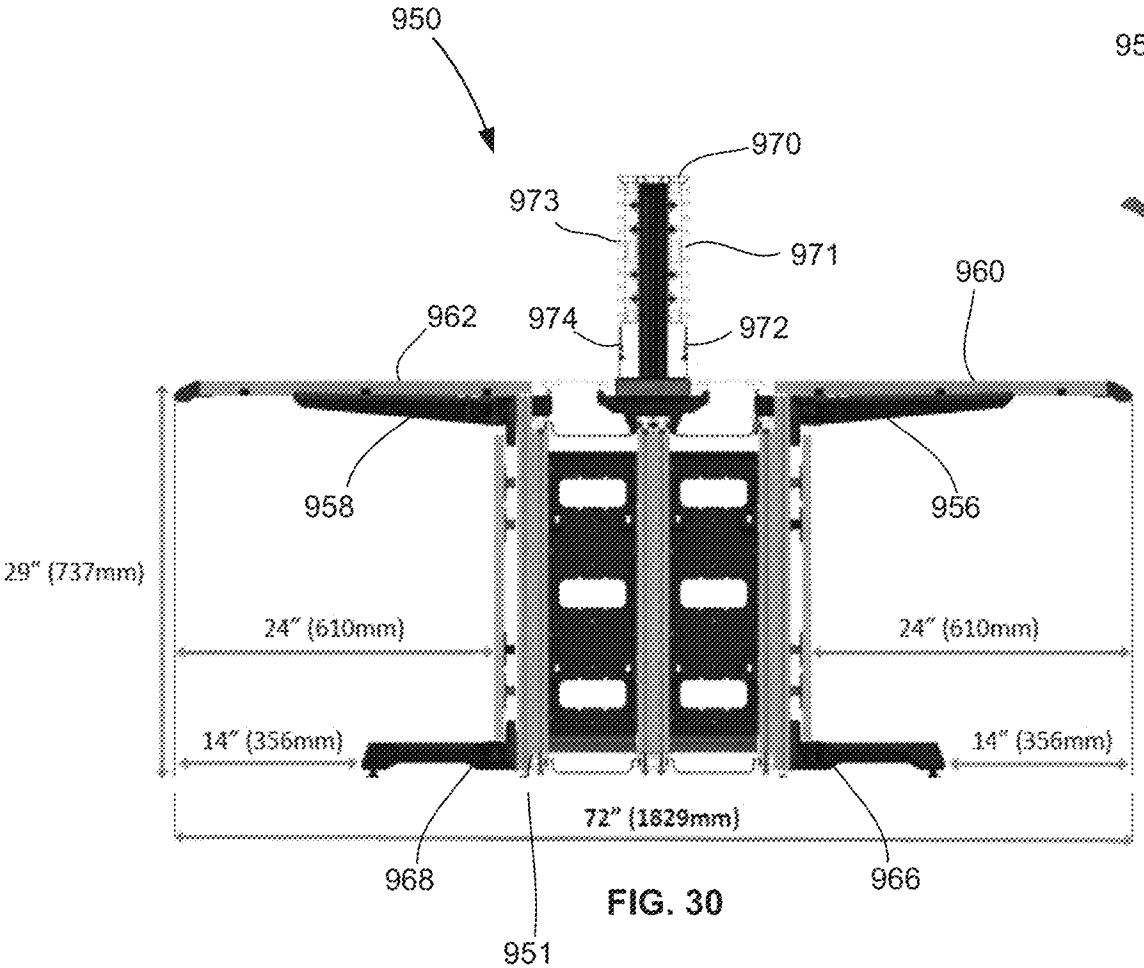
FIG. 30 is a side view of a console according to yet another embodiment having a "back-to-back" configuration.

FIG. 30 is a side view of a console 950 according to yet another embodiment having a "back-to-back" configuration. The console 950 includes an expanded depth frame module 901 similar to the frame module 951 in FIG. 29. The console 950 also includes one or more front support arms 956 and one or more rear support arms 958 attached to the frame module 951. The front support arms 956 support a first work surface panel 960 mounted thereon, and the rear support arms 958 support a second work surface panel 962 mounted thereon. The second work surface panel 962 and the rear support arms 958 essentially mirror the first work surface panel 960 and the front support arms 956 in this example, although embodiments are not so limited. Mirrored front feet 966 and back feet 968 are also provided. A back-to-back slat wall assembly 970 (having forward and rear facing slat walls) is mounted centrally on the frame module 951. The slat wall assembly has a front facing slat wall 971 and cover 972 under the slat wall 971. The slat wall assembly also has a rear facing slat wall 973 and cover 974 under the rear facing slat wall 973. The front and rear facing covers 972 and 974 may include openings or a brush grommet providing passage for cables, air circulation etc. FIG. 31 is a perspective view of the console 950 of FIG. 30.

The modular console frame system described herein may be easily customized to provide various storage space configurations and features. Some example storage space configurations are described below with reference to FIGS. 32 to 36.

Figure 32:
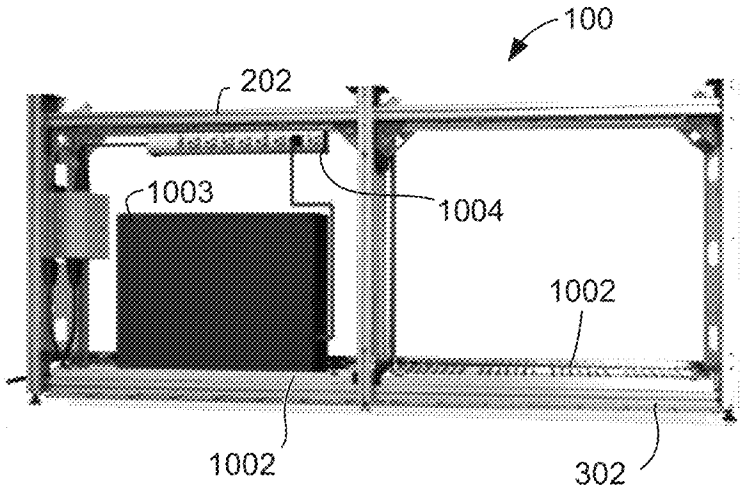
FIG. 32 is a perspective view of the frame module of FIG. 1 having a fixed shelf according to an embodiment.

FIG. 32 is a perspective view of the frame module 100, further including a fixed shelf 1002 installed between the first lower beam 302 and the second lower beam 304 (not visible in FIG. 32, but shown in FIG. 6), according to one embodiment. A personal computer (PC) type computer 1003 is shown on the shelf 1002. A power bar 1004 is also shown in an example horizontal arrangement attached to the first upper beam 202.

Figure 33:
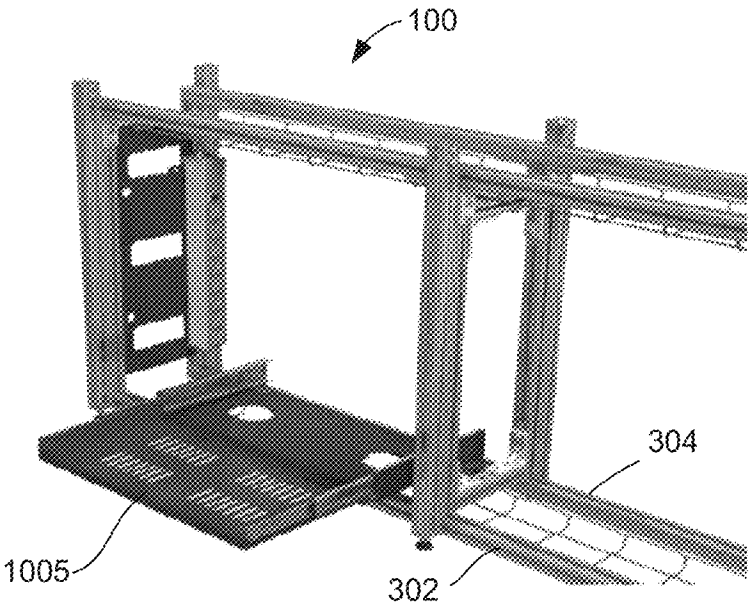
FIG. 33 is a perspective partial view of the frame module of FIG. 1 having a slide-out shelf, according to another embodiment.

FIG. 33 is a perspective partial view of the frame module 100, further including a slide-out shelf 1005 installed between the first and second lower beams 302 and 304, according to another embodiment. The power bar 1003 is shown in an example vertical arrangement attached to the first upper beam 202.

Figure 34:
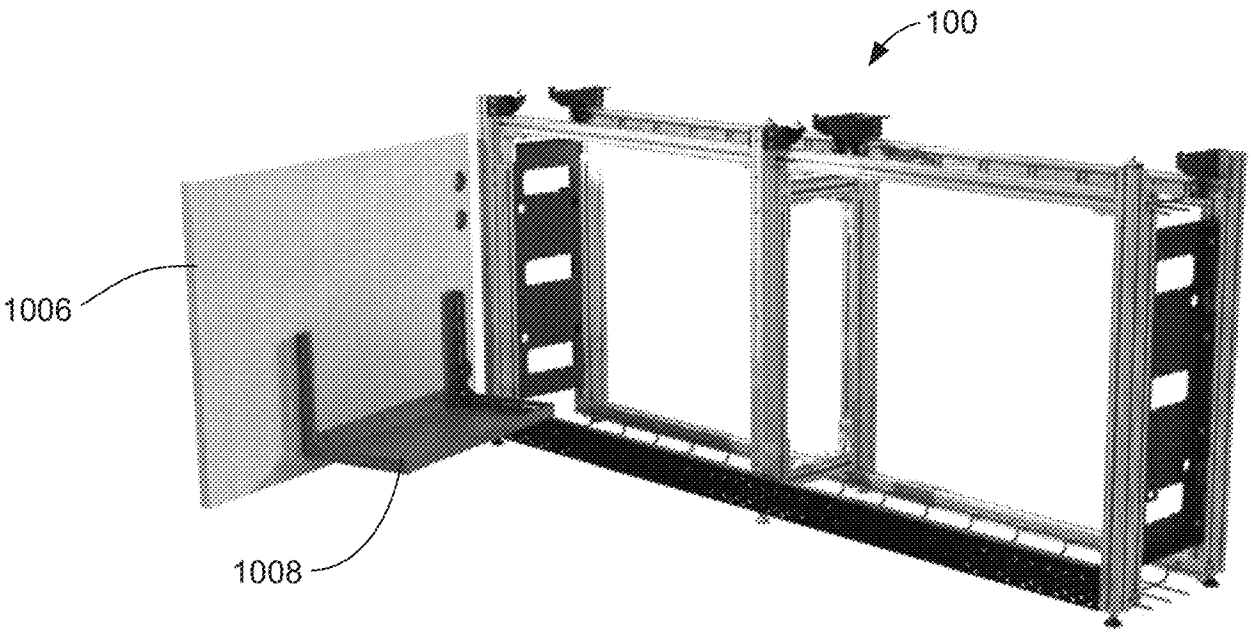
FIG. 34 is a perspective view of the frame module of FIG. 1 with a hinged door panel 1006 attached to the first leg frame, according to another embodiment.

FIG. 34 is a perspective view of the frame module 100, further including a hinged door panel 1006 attached to the first leg frame 106. The door panel is openable and includes shelf 1008 mounted thereon. Equipment, such as a computer, may be stored on the shelf 1008.

Figure 36:
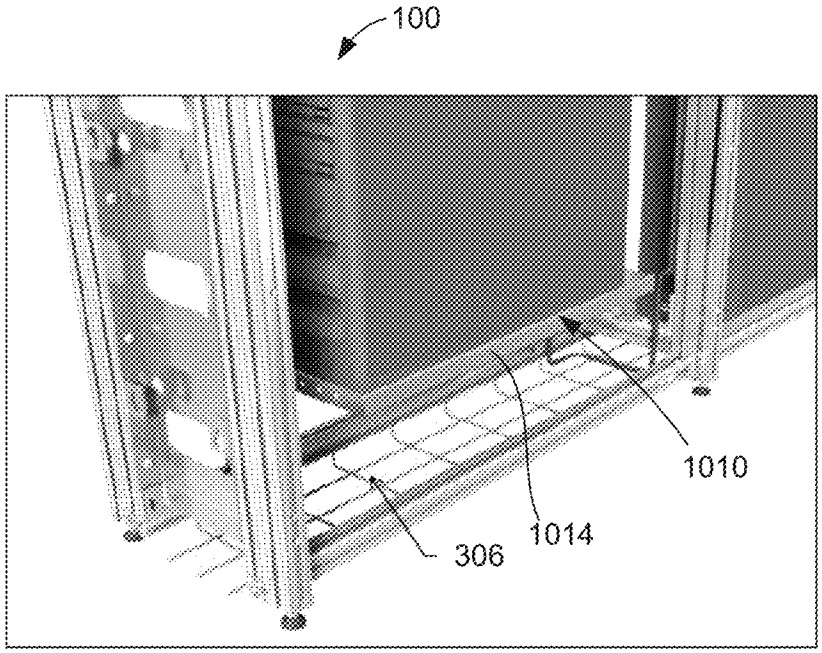
FIGS. 35 and 36 are front and partial rear perspective views, respectively, of the frame module of FIG. 1, with a vertically adjustable suspended shelf assembly, according to another embodiment.
Figure 35:
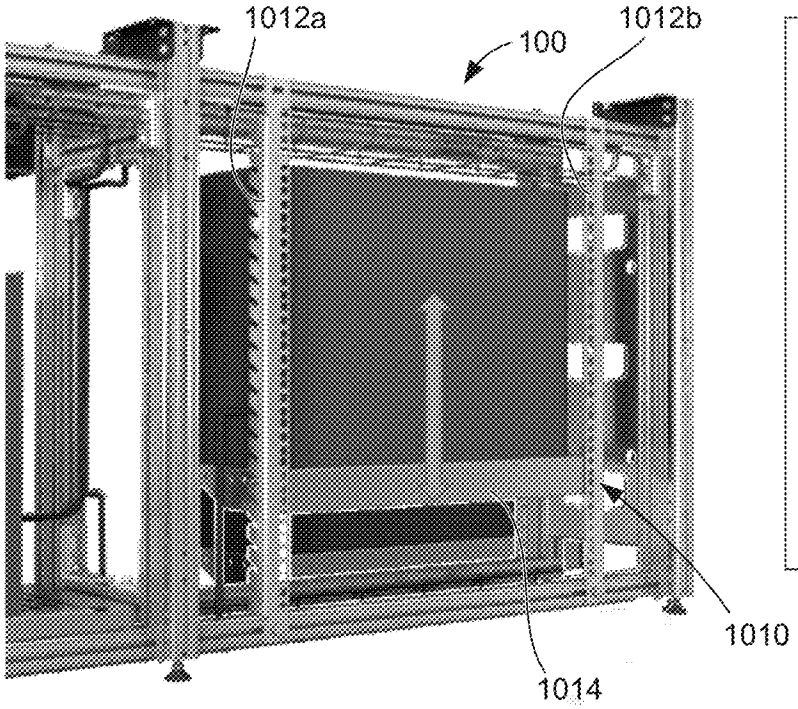

FIGS. 35 and 36 are front and partial rear perspective views of the frame module 100, respectively, with a vertically adjustable suspended shelf assembly 1010 installed therein, according to another embodiment. The suspended shelf assembly 1010 comprises spaced apart brackets 1012*a* and 1012*b* attached between the upper frame section 102 and the lower frame section 104. The shelf assembly 1010 also includes a shelf 1014 that is selectively mountable at various heights to the brackets 1012*a* and 1012*b*. As shown in FIG. 36, the suspended shelf 1014 may provide easy access to the lower cable basket 306, and may be ideal for smaller PCs, thin clients, Kernel-based Virtual Machines (KVMs), etc.

In still other embodiments, rackmount storage (not shown) may also be provided in the frame module 100 to support rack equipment within the frame module 100 of FIG. 1. Cable raceway elements such as horizontal cable trays (e.g. baskets 206 and 306 in FIGS. 2 and 6) and/or vertical cable trays (not shown) may be included for cable management.

Combinations of the various storage configurations described above and shown in the drawings may be used in various embodiments. Embodiments are not limited only to the particular equipment storage configurations shown in FIGS. 32 to 36.

Figure 37:
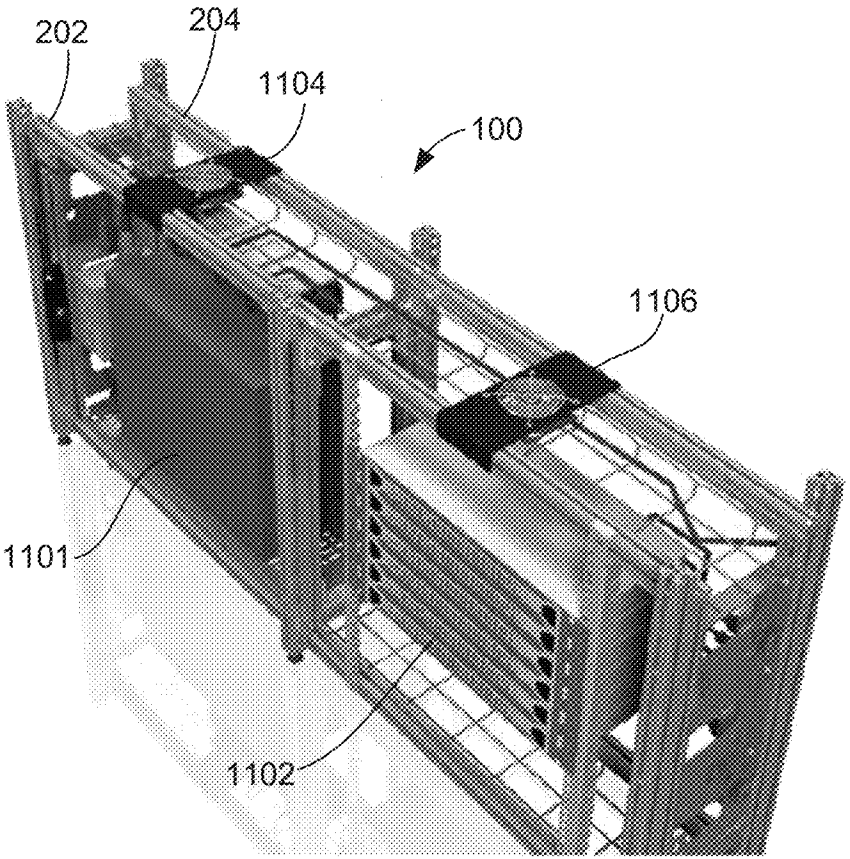
FIG. 37 is a partial perspective view of the frame module of FIG. 1 with a PC tower and racks installed therein.

The modular console frame system described herein may also provide for efficient and/or flexible air circulation configurations. FIG. 37 is a partial perspective view of the frame module 100 of FIG. 1 with a PC tower 1101 and racks 1102 installed therein. In this example, two spaced apart fans 1104 and 1106 are attached between the first and second upper beams 202 and 204 for ventilating heat generated by the computer tower 1100 and racks 1102 (or other equipment that may be mounted within the frame module 100). Embodiments are not limited to the number or placement of the fans 1104 and 1106 in FIG. 37. For example, one or more door-mounted fans may be used.

Figure 38:
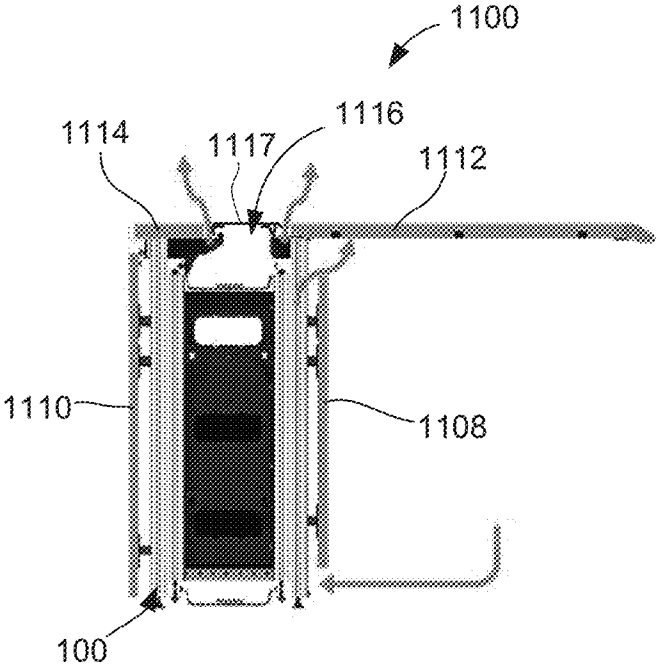
FIG. 38 is a side view of a console according to yet another embodiment, including the frame module of FIG. 1.

FIG. 38 is a side view of a console 1100 including the frame module 100. The console 1100 has front and rear panels 1108 and 1110 and a work surface panel 1112 (similar to the console 700 of FIG. 28). An upper cover or panel 1114 is mounted generally over the second upper beam 204. A gap 1116 extends between the upper panel 1114 and the work surface panel 1112. Heated air may rise naturally and/or aided by the fans 1104 and 1106 through the gap 1116, while cool air intake may occur through the bottom 1118 of the frame module 100. Optionally, a removable access cover 1117 may cover the gap 1116. The access cover 1117 may define one or more openings (not shown) to facilitate air circulation and may also be removable.

Figure 39:
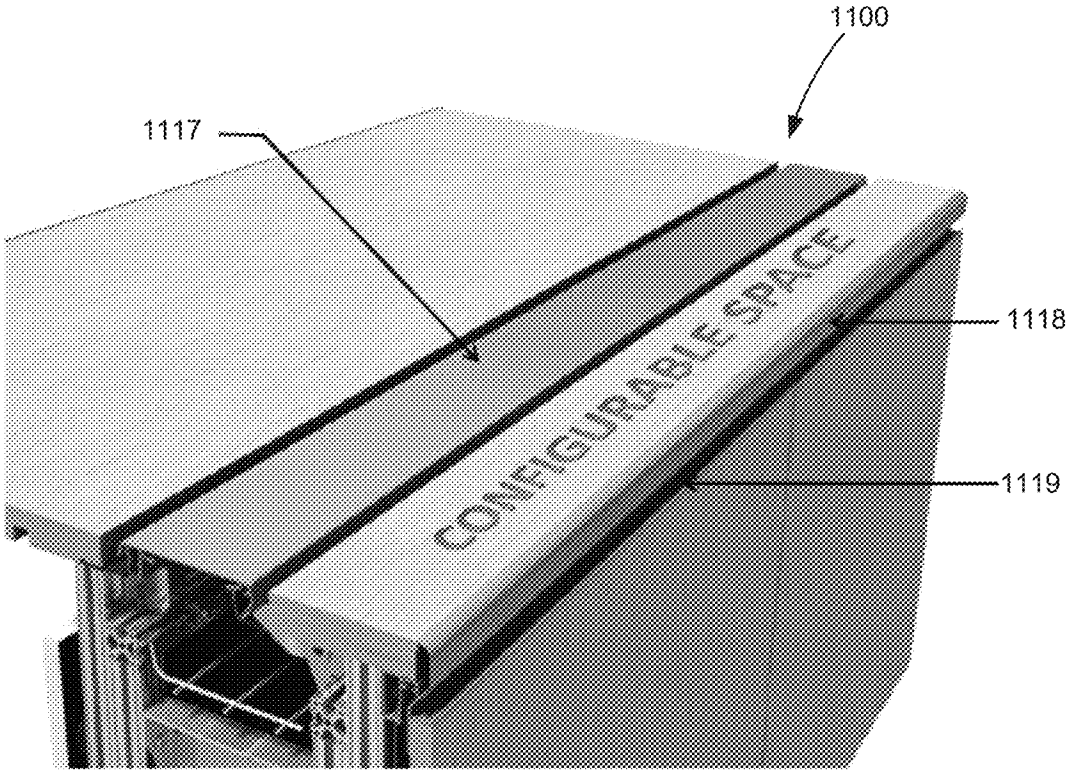
FIG. 39 shows a perspective view of the console of FIGS. 37 and 38.

FIG. 39 shows a perspective view of the console 1100 of FIGS. 37 and 38. The access panel 1117 is more clearly visible in FIG. 39. Rear trim 1118 on panel 1114 and door pull trim 1119 on rear panels 1108 and 1110 are also shown.

In some embodiments, a console with the modular frame system described herein may include one or more end panel assemblies (such as end panel assembly 554*a* and 554*b* in FIGS. 17 and 18) attached to one or more frame modules. For example, the end panel assembly 554*a* and 554*b* of FIGS. 17 and 18, or other end panel assemblies, may be attached to the first leg frame 106*a* of the first module 100*a* and the second leg frame 108*b* of the second frame module 100*b* in FIG. 19.

Some example embodiments of end panel assemblies will now be described with reference to FIGS. 40 to 58. The various end panel assemblies may provide structural support to a console.

Figure 40:
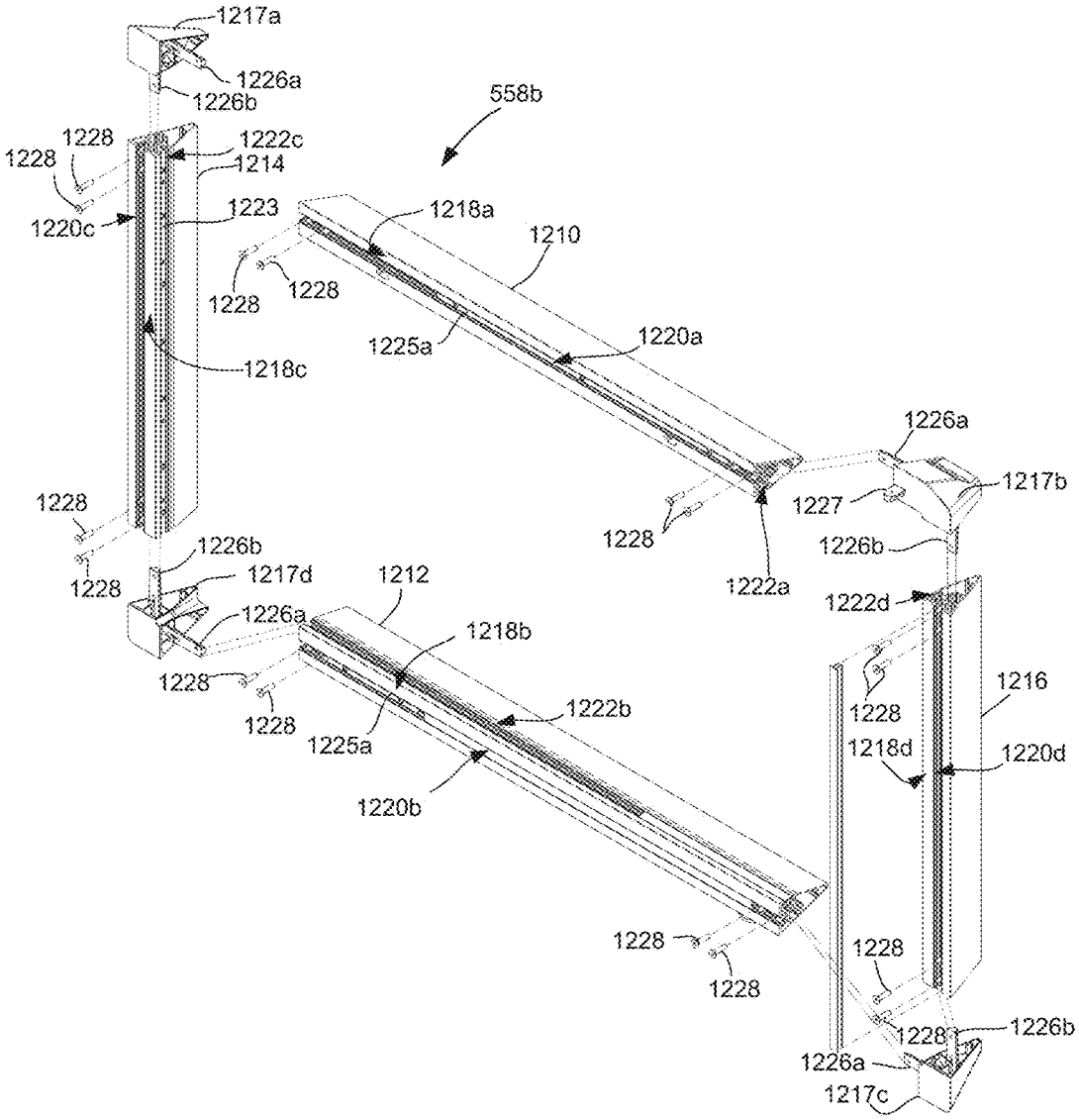
FIG. 40 is an exploded perspective view of an example loop-shaped end panel frame, according to an embodiment.

FIG. 40 is an exploded perspective view the example end panel frame 558*b* in FIGS. 17 and 18. The end panel frame 558*b* is generally loop-shaped, although embodiments are not limited to this shape. The end panel frame 558*b* includes an upper frame piece 1210, a lower frame piece 1212 and two opposing side frame pieces 1214 and 1216. Corner frame connectors 1217*a* to 1217*d* interconnect the upper frame piece 1210 and the lower frame piece 1212 with the side frame pieces 1214 and 1216 to form a loop configuration. The upper frame piece 1210, the lower frame piece 1212 the side frame pieces 1214 and 1216 each have a generally triangular cross-sectional profile (as a non-limiting example), with side faces 1218*a*, 1218*b*, 1218*c* and 1218*d* respectively. The side faces 1218*a* to 1218*d* face toward a console frame module (such as module 100 in FIG. 1) when attached. Ports 1220*a* to 1220*d* are defined in and along the length of the side faces 1218*a* to 1218*d* respectively.

The upper frame piece 1210, the lower frame piece 1212 and the side frame pieces 1214 and 1216 also define ports 1222*a* to 1222*d*, respectively, which face inward relative to the loop shape. The ports 1220*a* to 1220*d* may receive fastening hardware for attachment of the end panel frame 558*b* to a frame module (e.g. frame module 100*a* of FIG. 1). The ports 1222*a* to 1222*d* may receive fastening hardware for attaching one or more end panel inserts. For example, attachment strips 1223, 1225*a* and 1225*b* are shown in FIG. 40 received in ports 1222*c*, 1220*a* and 1220*b* respectively for receiving fastening hardware such as screws etc. However, any suitable method may be used to attach the end panel frame 558*b* to a console frame structure and/or end panel.

Tab 1227 shown in FIG. 40 may align with the underside of a work surface panel (not shown), and thus may assist with assembly and positioning of the end panel assembly on the console.

The corner connectors 1217*a* to 1217*d* each include a respective horizontal extension 1226*a* and a respective vertical extension 1226*b* that are received in the corresponding ports 1220*a* to 1222*d* and are secured in place by screws 1228 that secure the corner connectors 1217*a* to 1217*d* and the corresponding frame pieces 1210, 1212, 1214 and 1216 together.

Figure 42:
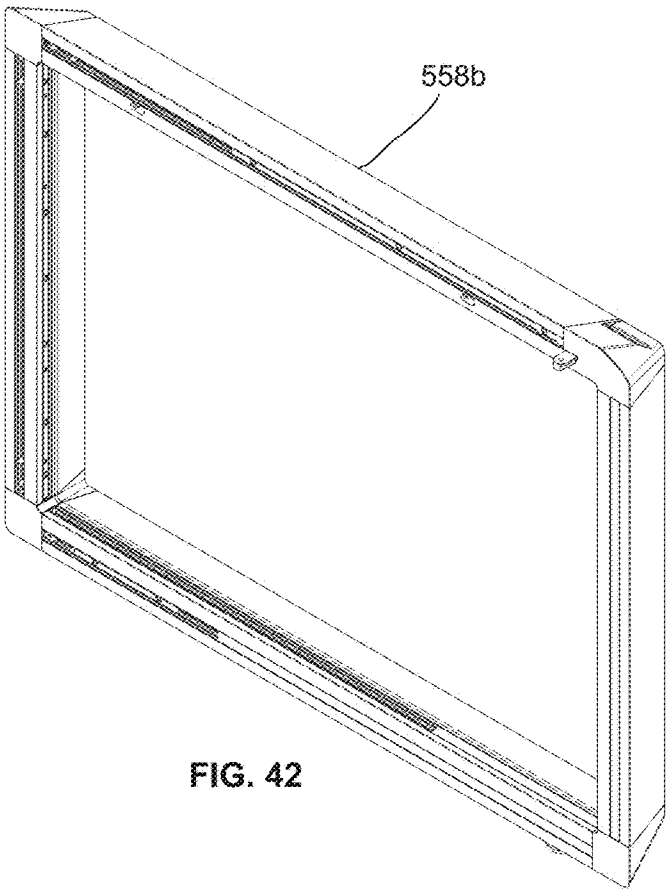
FIGS. 41 and 42 are front and rear perspective views, respectively, of the assembled end panel frame of FIG. 40.
Figure 41:
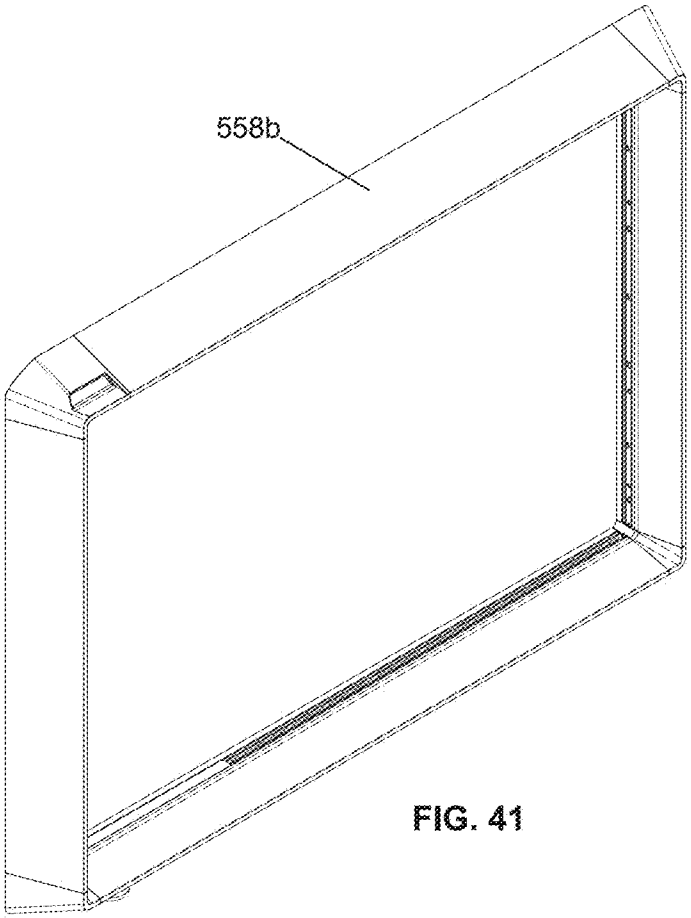

FIGS. 41 and 42 are front and rear perspective views of the assembled end panel frame 558*b* of FIG. 40.

Figure 43:
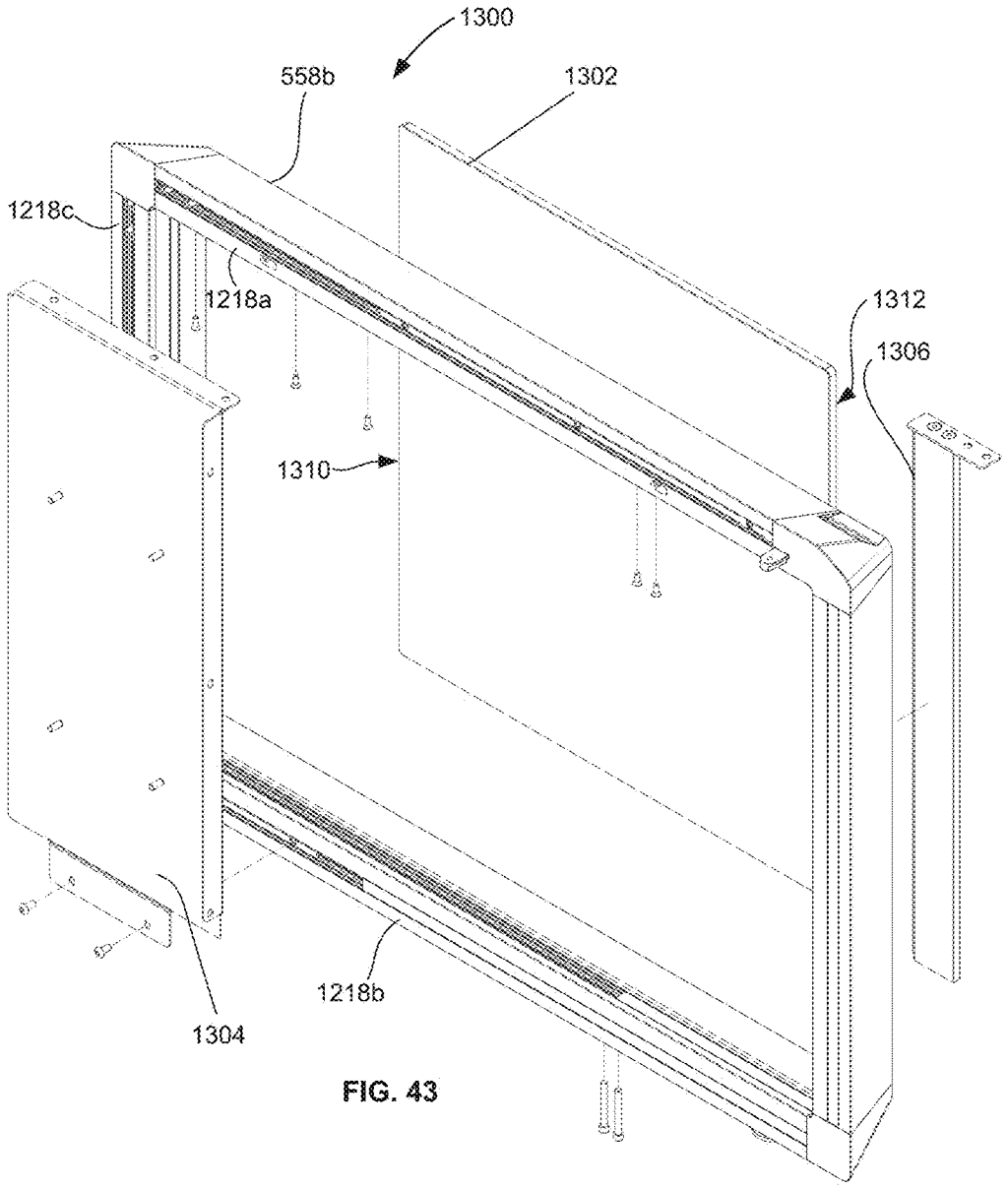
FIG. 43 is an exploded perspective view of an end panel assembly, including the end panel frame of FIGS. 40 to 42, according to another embodiment.

As mentioned above, various end panel inserts may be used in the end panel assemblies described herein, and the end panel inserts may be swappable and/or replaceable. FIG. 43 is an exploded perspective view of an end panel assembly 1300 including the end panel frame 558*b* of FIGS. 40 to 42 and a end panel insert 1302 according to one embodiment. A backing plate 1304 and vertical stanchion support 1306 are used for mounting the end panel insert 1302 within the end panel frame 558*b* as shown. More specifically, the backing plate 1304 attaches to the side faces 1218*a* to 1218*c* of the end panel fame 558*b* and secures a first side 1310 of the glass end panel insert 1302. The vertical stanchion support 1306 is likewise mounted to the end panel frame 558*b* and secures a second side 1312 of the end panel insert 1302 (opposite to the first side).

Figure 45:
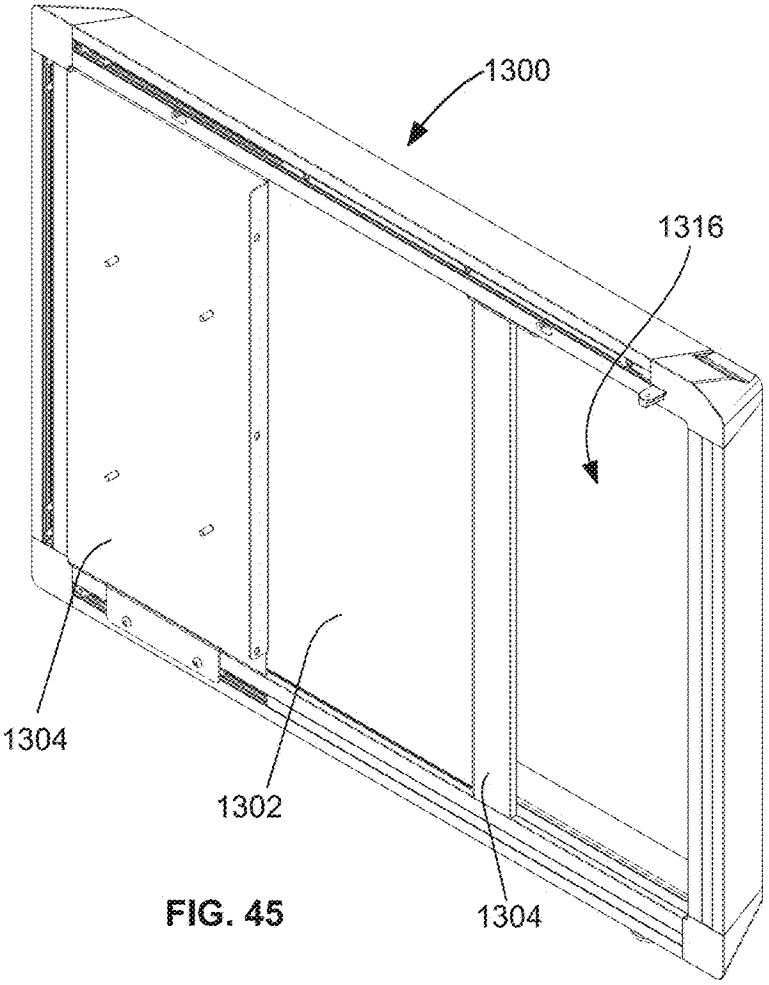
FIGS. 44 and 45 are front and rear perspective views, respectively, of the assembled end panel assembly of FIG. 43.
Figure 44:
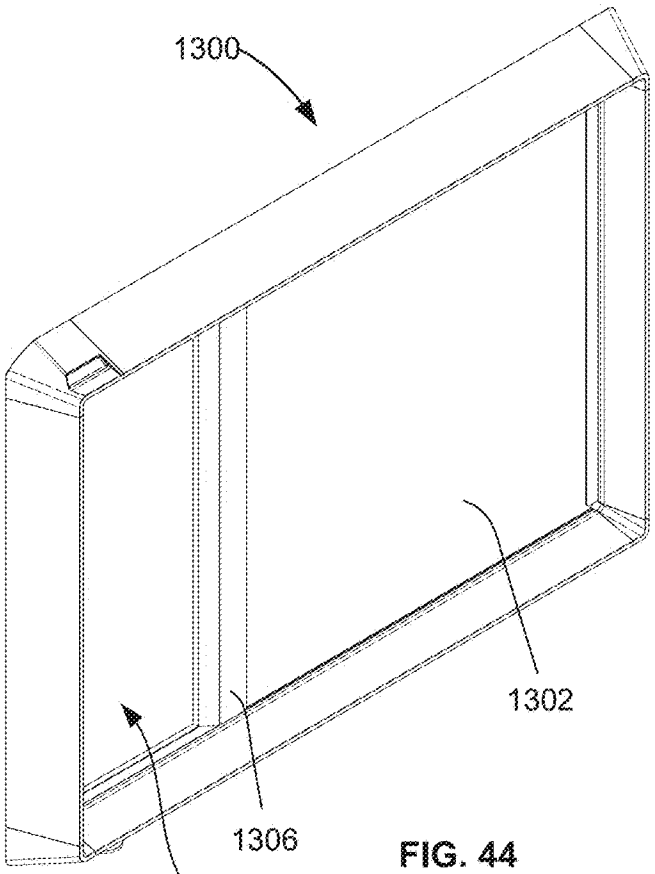

FIGS. 44 and 45 show front and rear perspective views, respectively, of the assembled end panel assembly 1300 with the end panel insert 1302, the backing plate 1304 and the vertical stanchion support 1306. The end panel insert 1302 may be glass, acrylic, plastic, wood, metal or any other suitable material. The end panel insert 1302 may include a visual design and may also be equipped with lighting (e.g. back-lit or edge-lit LED lighting), for example. The end panel insert 1302 may be removable and/or replaceable with one or more different end panel inserts.

As shown in FIGS. 44 and 45, the end panel insert 1302 only partially fills the end panel frame 558*b*, leaving open portion 1316. In other embodiments, the end panel frame 558*b* may be completely filled by one or more other end panel inserts.

Figure 46:
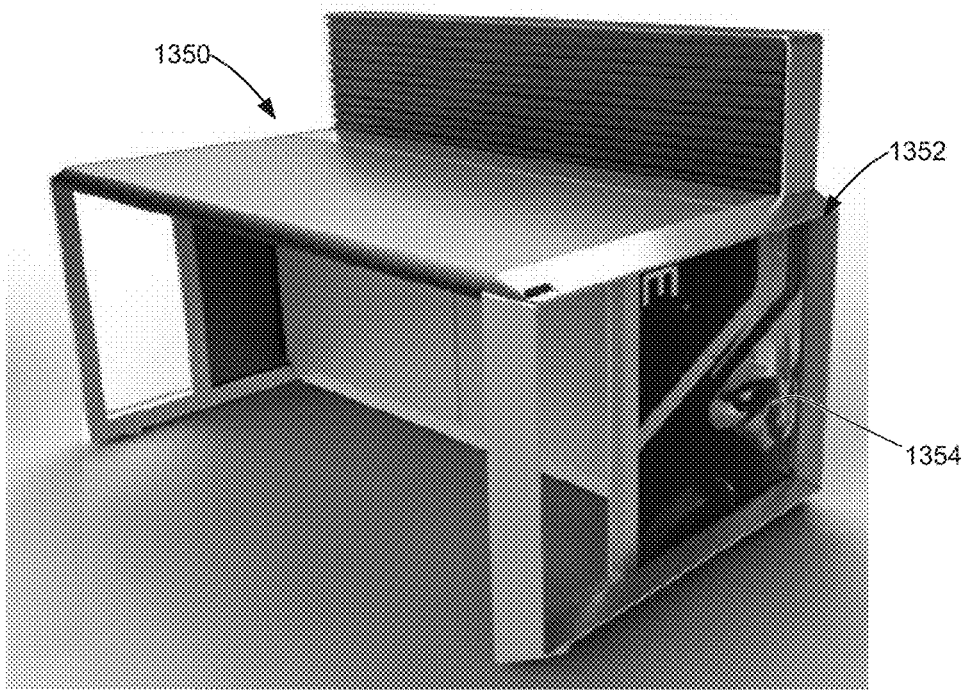
FIGS. 46 and 47 are front and rear perspective views, respectively, of a console according to yet another embodiment.
Figure 47:
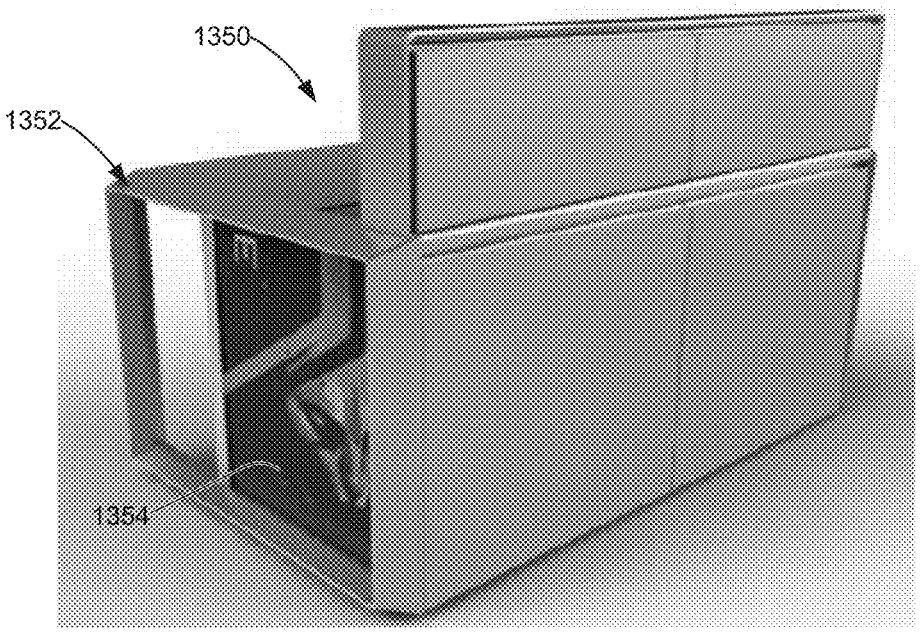

FIGS. 46 and 47 are front and rear perspective views, respectively, of a console 1350 having two end panel assemblies 1352 with glass end panel insert 1354 (with a visual design thereon). Each end panel assembly 1352 has essentially the same structure as the end panel assembly 1300 in FIGS. 43 to 45. The console 1350 may include a console frame module (not visible) as described herein, such as the frame module 100 of FIG. 1. In other embodiments, a console including a multi-frame module structure (such as the console 700 in FIG. 26) may include the end panel assembly 1300, or other end panel assemblies described herein.

Figure 48:
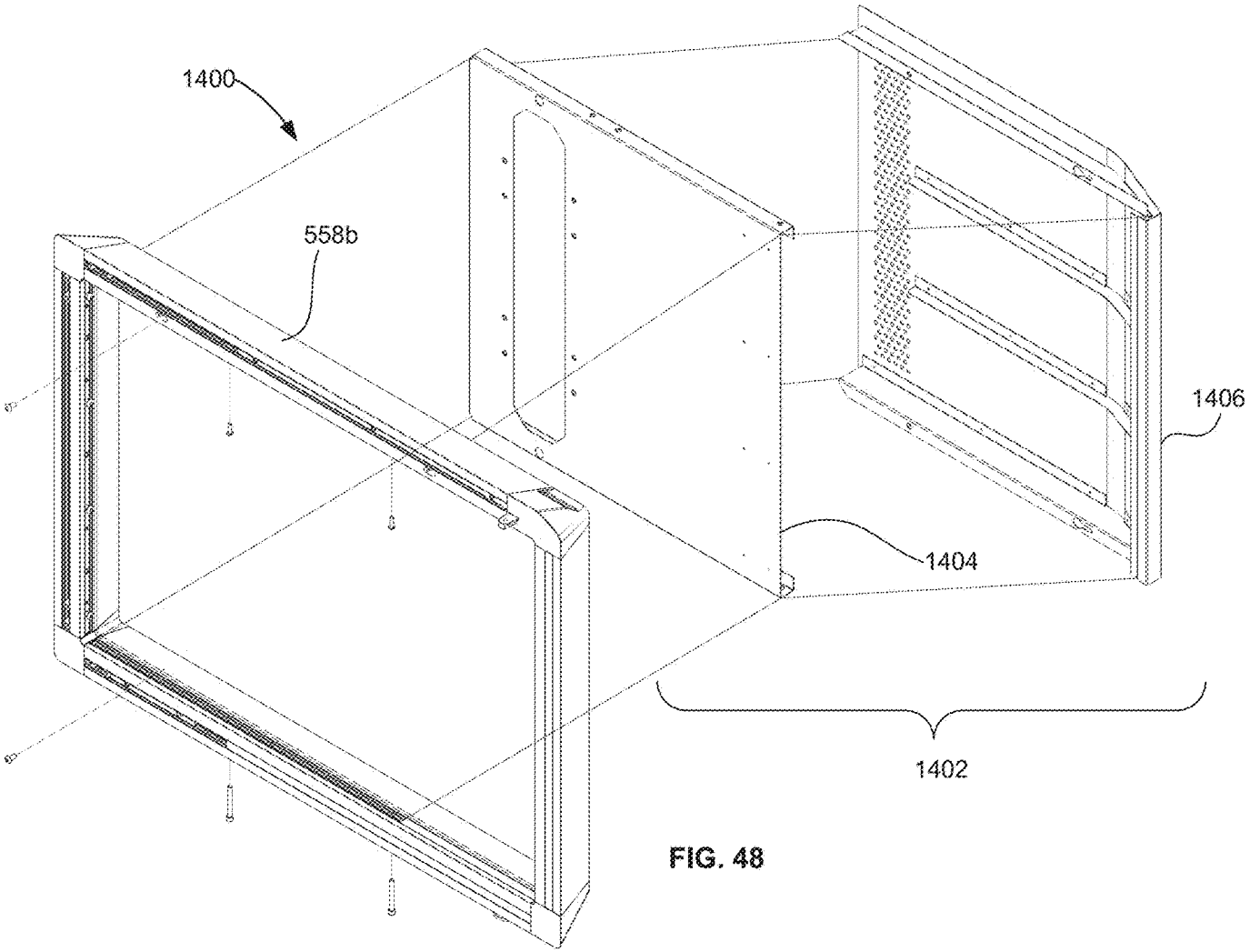
FIG. 48 is an exploded perspective view of an end panel assembly according to another embodiment.
Figure 50:
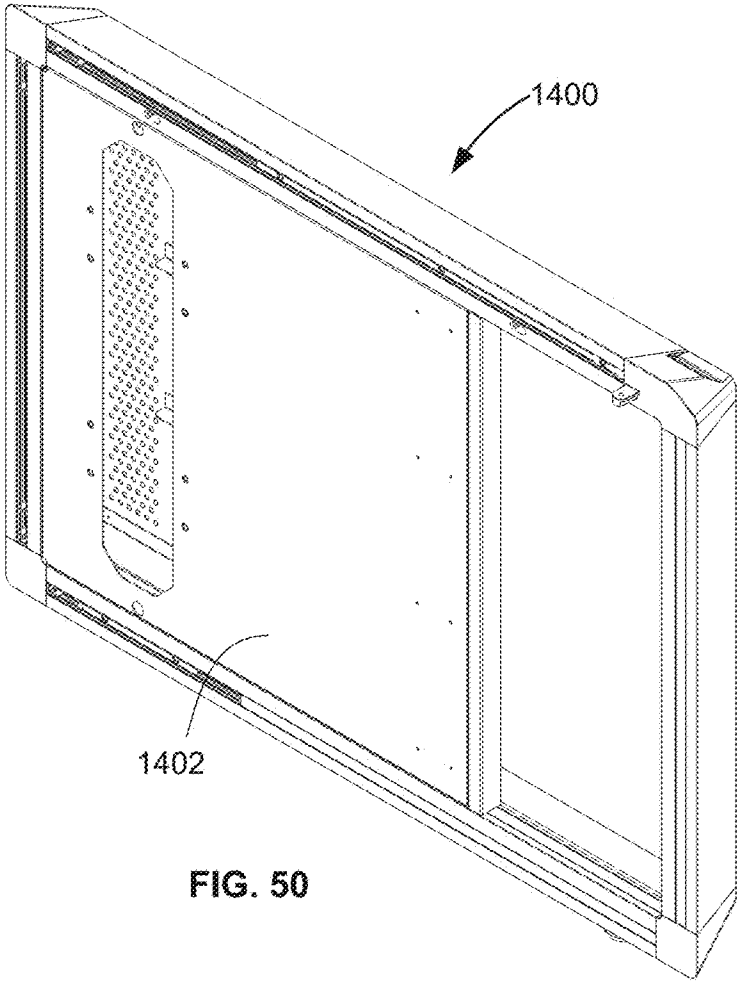
FIGS. 49 and 50 show front and rear perspective views, respectively, of the assembled end panel assembly of FIG. 48.
Figure 49:
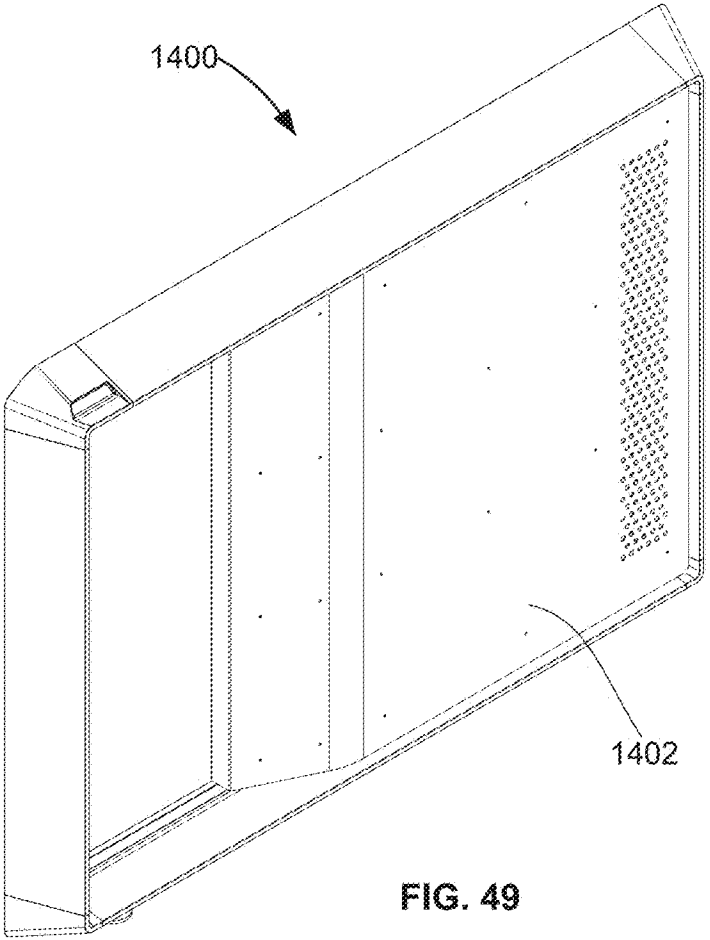

FIG. 48 is an exploded perspective view of an end panel assembly 1400 according to another embodiment that also includes the end panel frame 558*b*. The end panel assembly 1400 includes an end panel insert 1402, which may be metal or any other suitable material. The end panel insert 1402 includes a back plate 1404 and a panel cover 1406. FIGS. 49 and 50 are front and rear perspective views, respectively, of the assembled end panel 1400 with end panel insert 1402. The end panel insert 1402 may include a visual design and may also be equipped with lighting (e.g. LED lighting). The end panel assembly 1400 may be used with the various consoles and console frame structures described herein, including but not limited to the console 1350 shown in FIGS. 46 and 47.

Figure 51B:
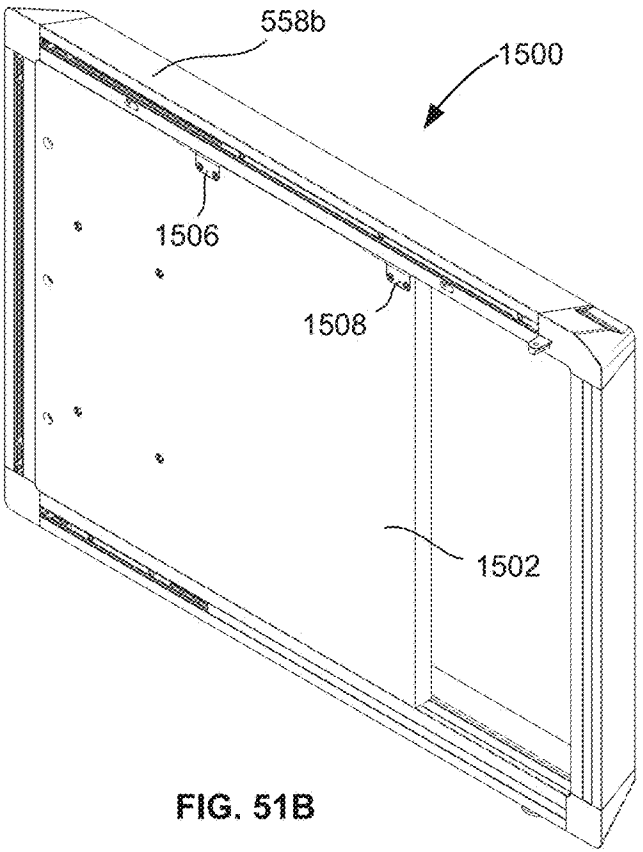
FIGS. 51A and 51B are front and rear perspective views, respectively, of an end panel assembly according to yet another embodiment
Figure 51A:
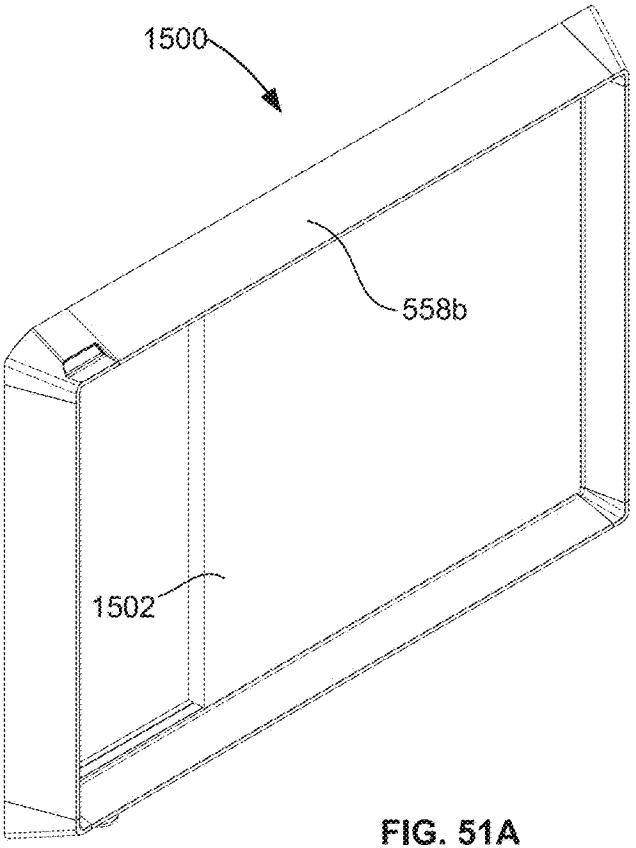
Figure 52:
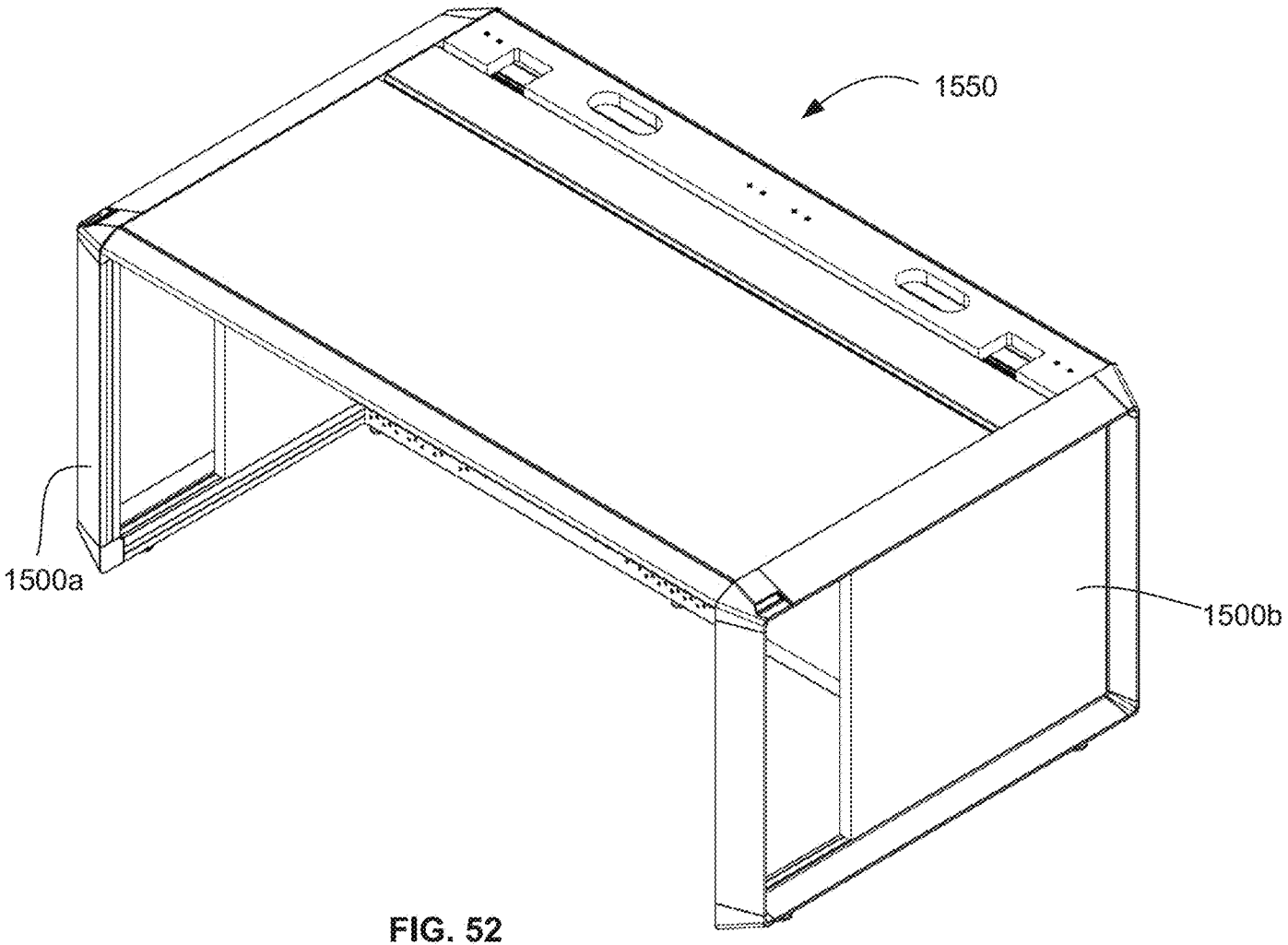
FIG. 52 is an example console according to another embodiment, including the end panel assembly of FIGS. 51A and 51B.

FIGS. 51A and 51B are front and rear perspective views, respectively, of an end panel assembly 1500 according to yet another embodiment. The end panel assembly 1500 again includes the end panel frame 558*b*. End panel insert 1502 is held within the end panel frame 558 by a pair of L-shape brackets 1506 and 1508, which are secured to the end panel insert 1502 and to upper port 1222*a* (FIG. 40). The end panel assembly 1500 may be used with the various consoles and console frame structures described herein, including but not limited to the console 1350 shown in FIGS. 46 and 47.

FIG. 51 is a front perspective view of a console 1550 according to yet another embodiment having first and second end panel assemblies 1500*a* and 1500*b* (which are each similar to end panel assembly 1500 in FIGS. 51A and 51B).

As shown in FIGS. 40 to 52, a loop shaped end panel assembly, such as end panel assembly 558*b* may be customized with end panel inserts of various sizes, shapes, materials, visual designs, etc. However, embodiments are not limited to the particular end panel frame 558*b* shown in FIGS. 40 to 52. For example, the shape or size of the end panel frame may vary in other embodiments.

Figure 53:
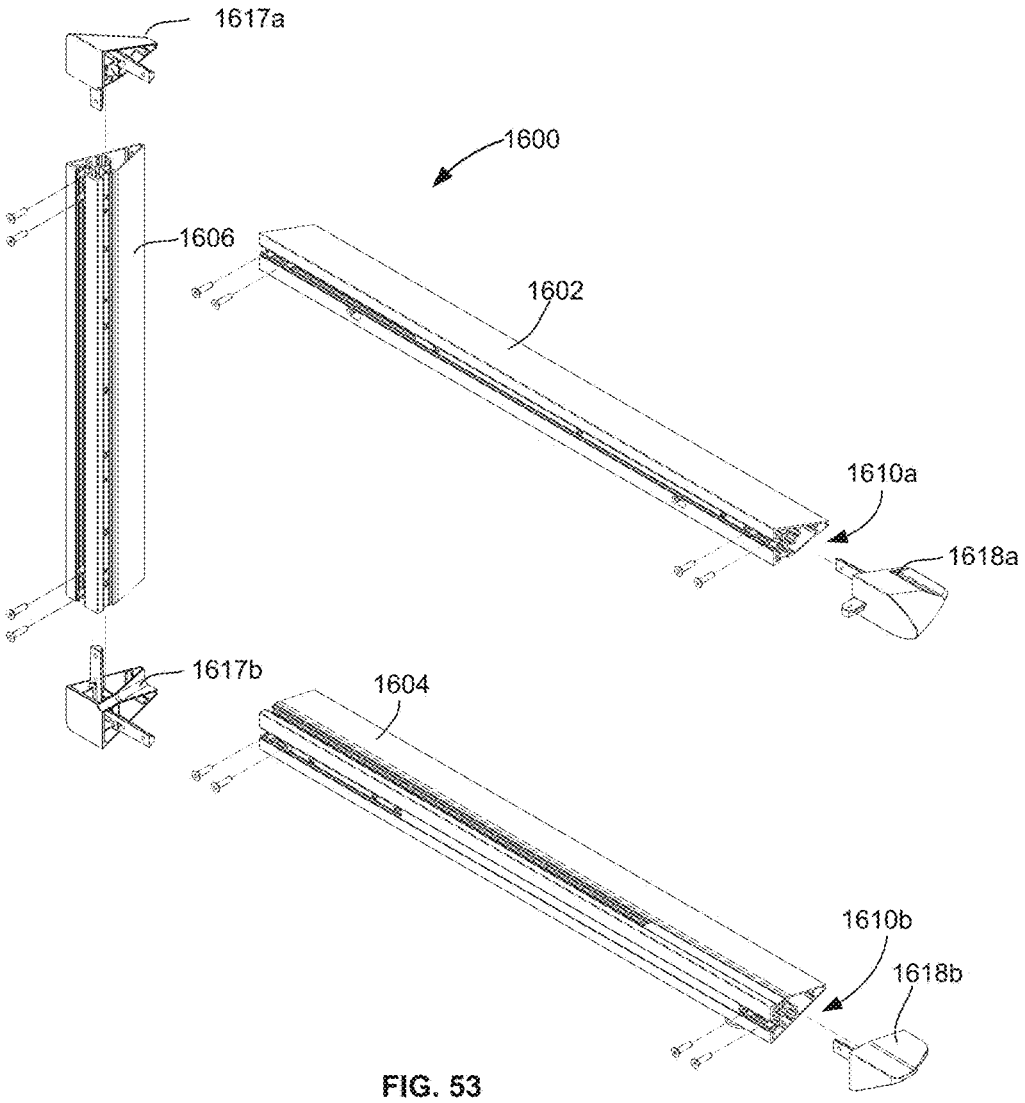
FIG. 53 is an exploded perspective view of a C-shaped end panel frame according to another embodiment.

FIG. 53 is an exploded perspective view of a C-shaped end panel frame 1600 according to another embodiment. The end panel frame 1600 includes upper and lower frame pieces 1602 and 1604 and a single side frame piece 1606. Two corner connectors 1617*a* and 1617*b* connect the side frame piece 1278 to the upper and lower frame pieces 1602 and 1604. Frame 1618*a* and 1618*b* are connected to free ends 1610*a* and 1610*b* of the upper and lower frame pieces 1602 and 1604 respectively. The upper, lower and side frame pieces 1602, 1604 and 1608 are similar in structure and function to the upper and lower frame pieces 1210, 1212 and 1214 of the end panel frame 558*b* shown in FIGS. 40 to 52. The structure of the C-shaped end panel frame 1600 is, thus, similar to the end panel frame 558*b* in FIGS. 40 to 52, but with an open side 1612.

Figure 55:
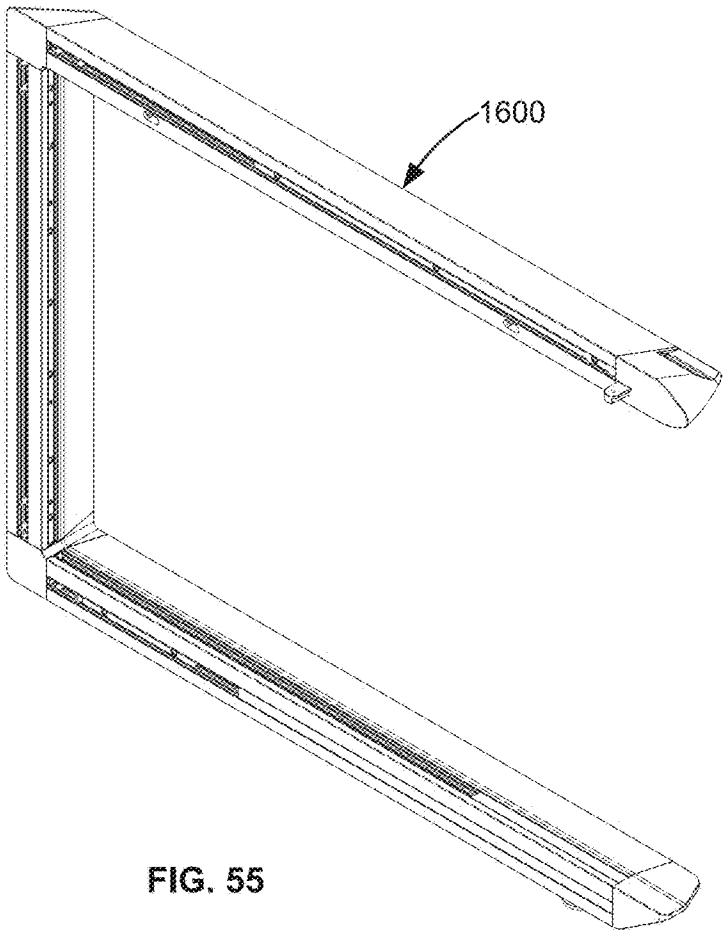
FIGS. 54 and 55 are front and rear perspective views, respectively, of the assembled C-shaped end panel frame of FIG. 53.
Figure 54:
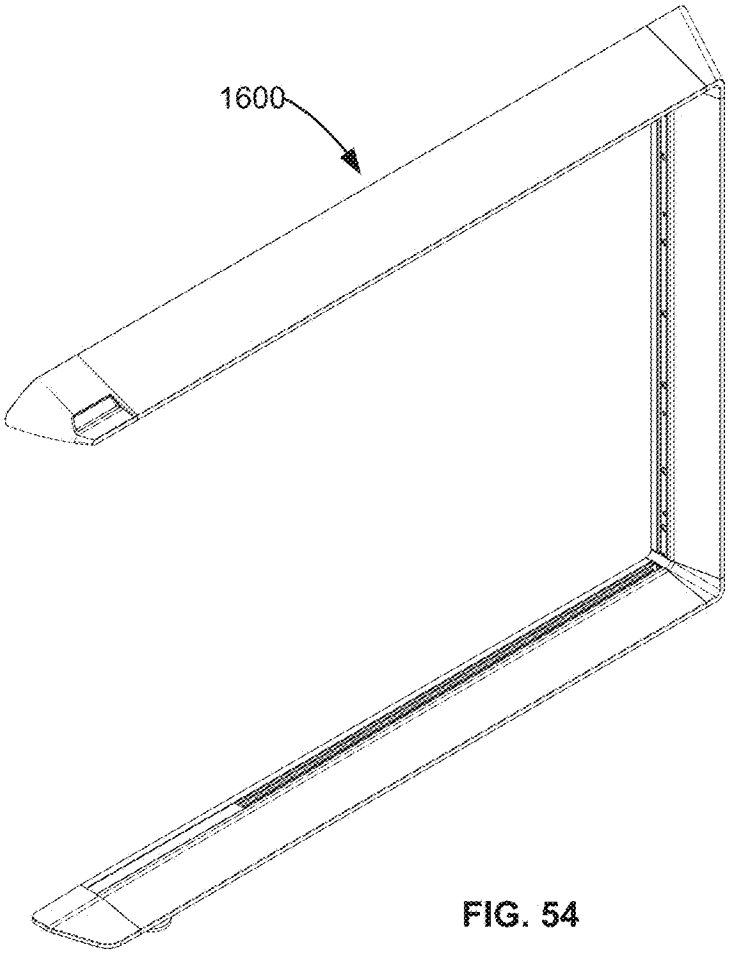

FIGS. 54 and 55 are front and rear perspective views, respectively, of the assembled C-shaped end panel frame 1600 of FIG. 53. Various end panel inserts (such as those shown in FIGS. 41 to 52) may be used with the C-shaped end panel frame 1600.

Figure 56:
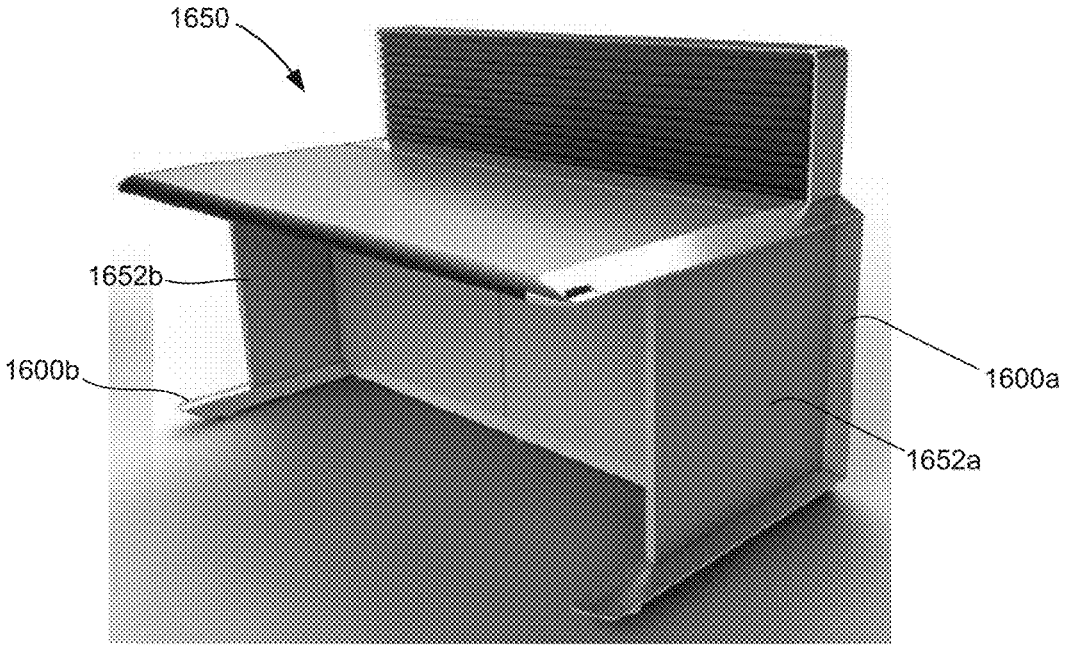
FIGS. 56 and 57 are front and rear perspective views, respectively, of an example console according to another embodiment, including the C-shaped end panel frame of FIGS. 53 to 54.
Figure 57:
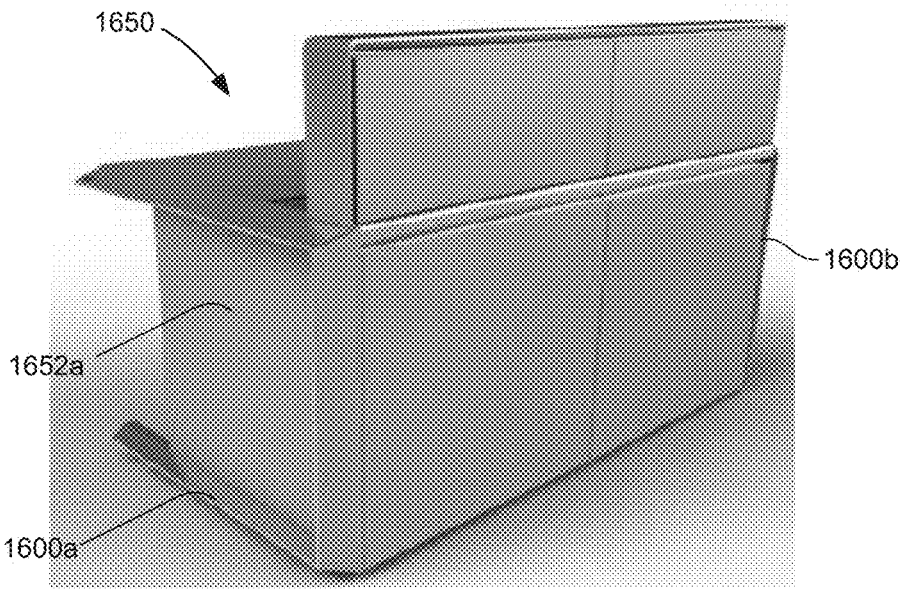
Figure 58:
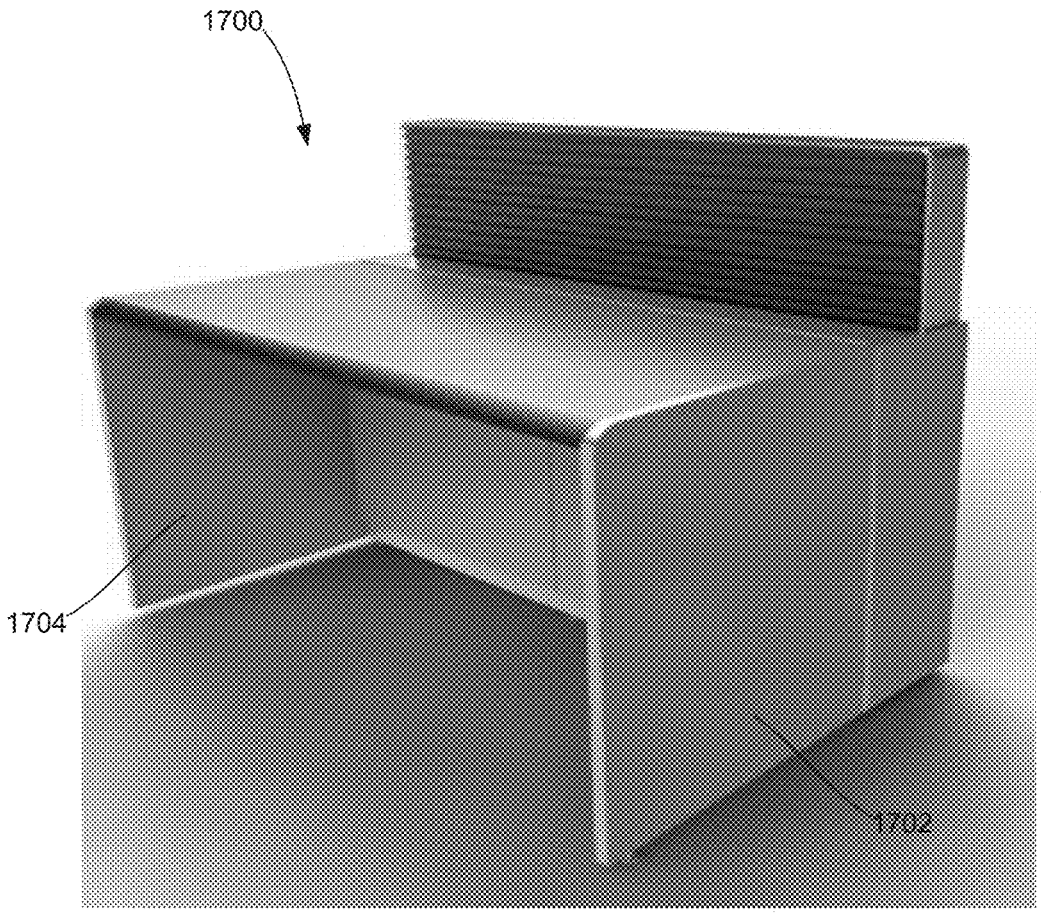
FIG. 58 is a perspective view of a console, according to still another embodiment.

FIGS. 56 and 57 are front and rear perspective views, respectively, of another example console 1650 according to another embodiment including C-shaped end panel frames 1600*a* and 1600*b* with end panel inserts 1652*a* and 1652*b*. The end panel inserts 1652*a* and 1652*b* are each similar to the end panel insert 1500 in FIGS. 51 and 52 in this example.

Embodiments are not limited to the end panel assemblies described above. In some embodiments, rather than a frame/panel insert structure, one or more end panel assemblies may comprise a side wall panel or similar. See, for example, FIG. 58, which is a perspective view of a console 1700, according to still another embodiment, having a side walls 1702 and 1704. In other embodiments, some or all end panel assemblies may be omitted. The console 1700 may include a console frame module (not visible) as described herein, such as the frame module 100 of FIG. 1.

As described above, consoles according to some aspects may include a slat wall or a slat rail, or other equipment mounting structure. The module frame system including frame modules (such as the frame module 100 in FIG. 1) may facilitate easy, customizable, and secure mounting of such equipment mounting structure.

Figure 59:
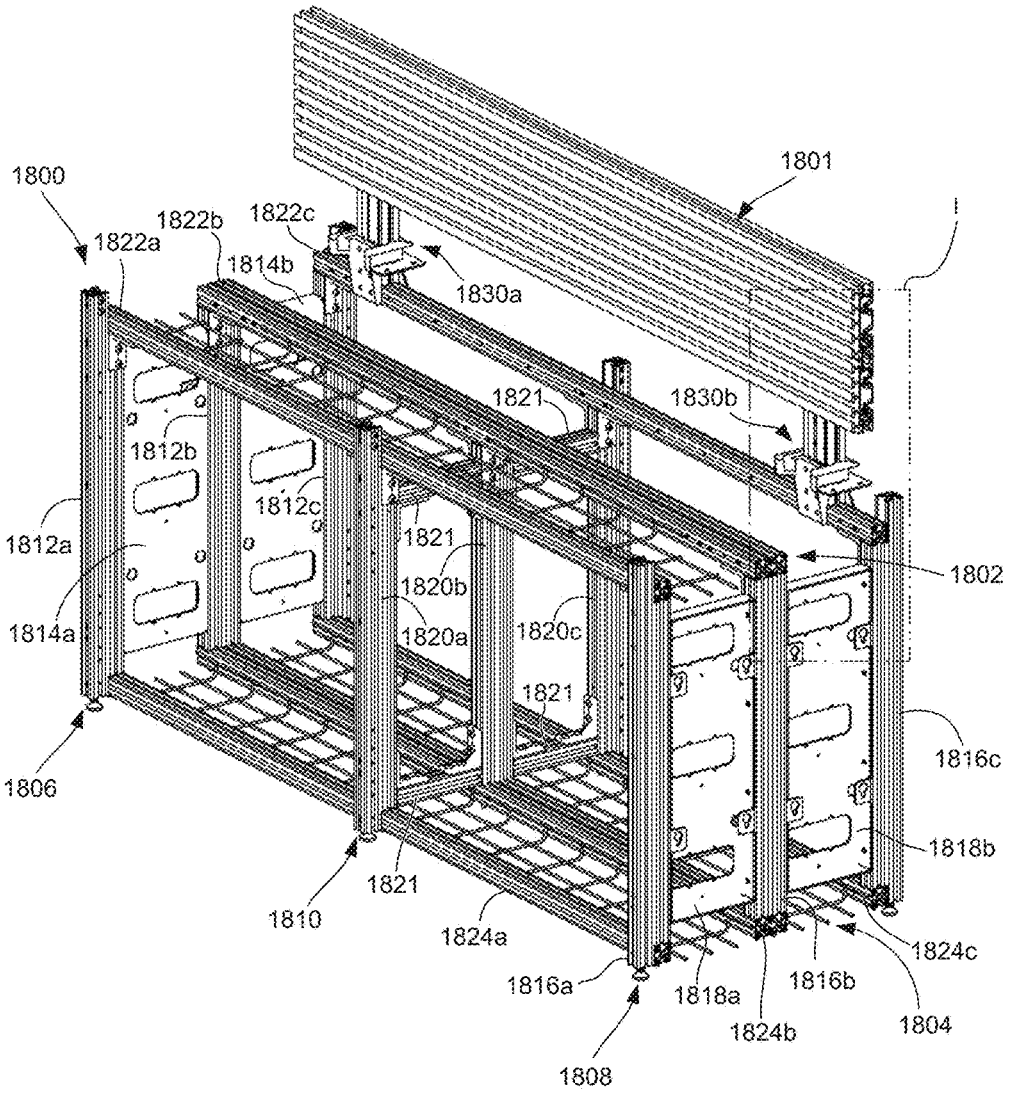
FIGS. 59 and 60 are front and rear perspective views, respectively, of a frame module and a slat wall, according to some embodiments.
Figure 60:
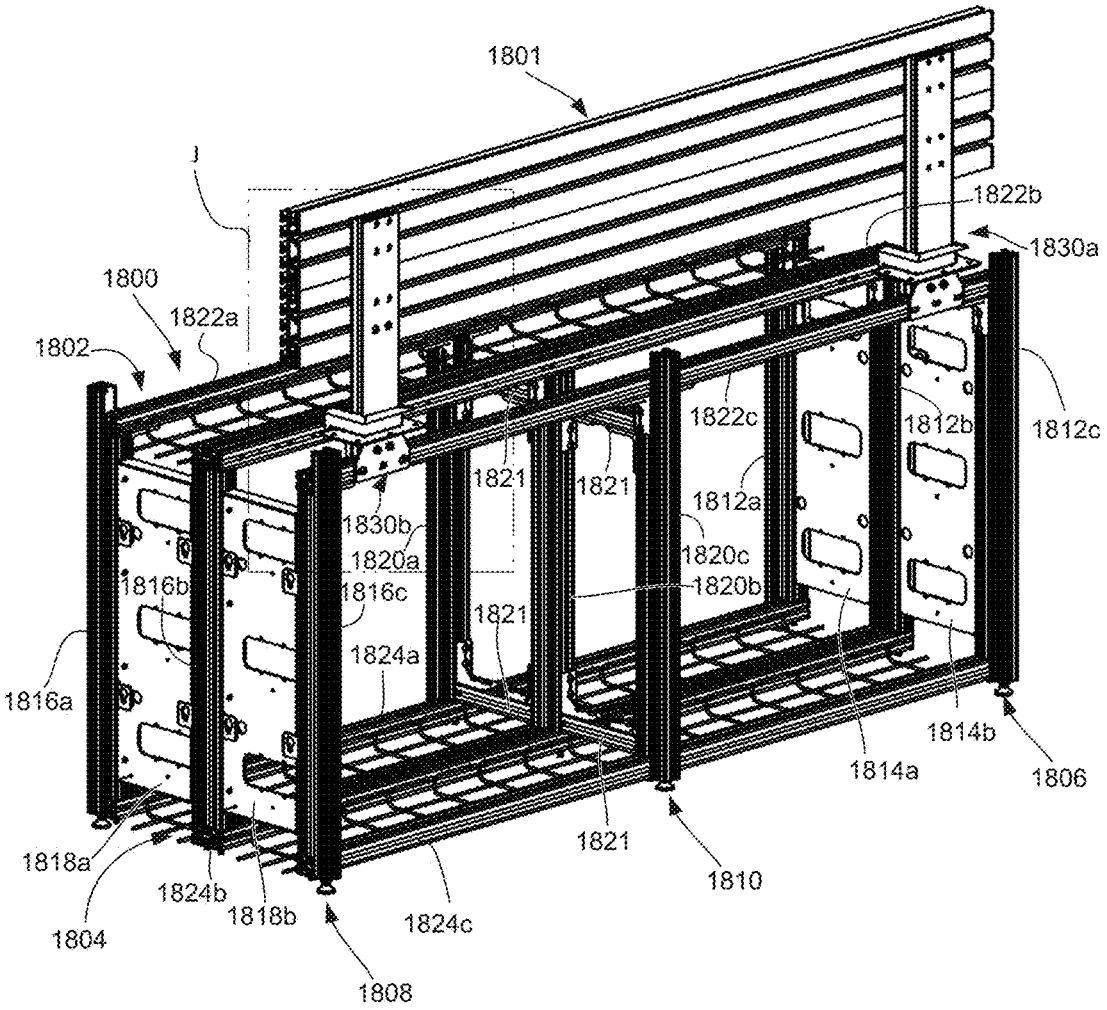

FIGS. 59 and 60 are front and rear perspective views, respectively, of a frame module 1800 and a slat wall 1801 attached to the frame module 1800, according to some embodiments.

The frame module 1800 is similar to the expanded depth frame module 901 shown in FIG. 29. The frame module 1800 includes an upper frame section 1802, a lower frame section 1804, and first and second leg sections 1806 and 1808 interconnected by the upper and lower frame sections 1802 and 1804. The frame module 1800 also includes an intermediate frame section 1810. The first leg frame 1806 includes first, second and third vertical beams 1812*a*, 1812*b* and 1812*c* spaced apart and interconnected by first and second panels 1814*a* and 1814*b*. The second leg frame 1808 has a similar structure with first, second and third vertical beams 1816*a*, 1816*b* and 1816*c* spaced apart and interconnected by first and second panels 1818*a* and 1818*b*. Likewise, the intermediate frame section 1810 includes spaced apart first, second and third vertical beams 1820*a*, 1820*b* and 1820*c* interconnected by cross beams 1821. The upper frame section 1802 includes first, second and third upper beams 1822*a*, 1822*b* and 1822*c*. The first upper beam 1822*a* interconnects the first vertical beams 1812*a* and 1816*a* of the first and second leg sections 1806 and 1808. The second upper beam 1822*b* interconnects the second vertical beams 1812*b* and 1816*b* of the first and second leg sections 1806 and 1808. The third upper beam 1822*c* interconnects the third vertical beams 1812*c* and 1816*c* of the first and second leg sections 1806 and 1808. The lower frame section 1804 likewise includes first, second and third lower beams 1824*a*, 1824*b* and 1824*c* that similarly interconnect the first and second leg frames 1806 and 1808. The intermediate frame section 1810 is selectively attachable to the upper and/or lower frame sections 1802 and 1804 at various positions along their length.

The various horizontally aligned upper and lower beams (1822*a* to 1822*c*, and 1824*a* to 1824*c*) are in the form of extrusions similar to the upper beam 204 shown in FIGS. 3 and 4. The second upper beam 1822*b* and the second lower beam 1824*b* have a paired or double extrusion structure. The vertical beams (1812*a* to 1812*c*, 1816*a* to 1816*c*, 1820*a* to 1820*c*) are also extrusions, similar in structure to the vertical beams 402 and 404 shown in FIGS. 8 and 9. However, embodiments are not limited to such extrusion structures.

As shown, the slat wall 1801 mounted to the third upper beam 1822*c* by first and second mounting assemblies 1830*a* and 1830*b*. However, the slat wall may be mounted in a different position, such as to second upper beam 1822*b*. The slat wall 1801 and mounting assemblies 1830*a* and 1830*b* are also not limited to the particular frame module 1800 shown in FIGS. 59 and 60. The slat wall 1801 or other equipment mounting structure (such as a slat rail) may be mounted on other frame modules described herein.

Figure 61:
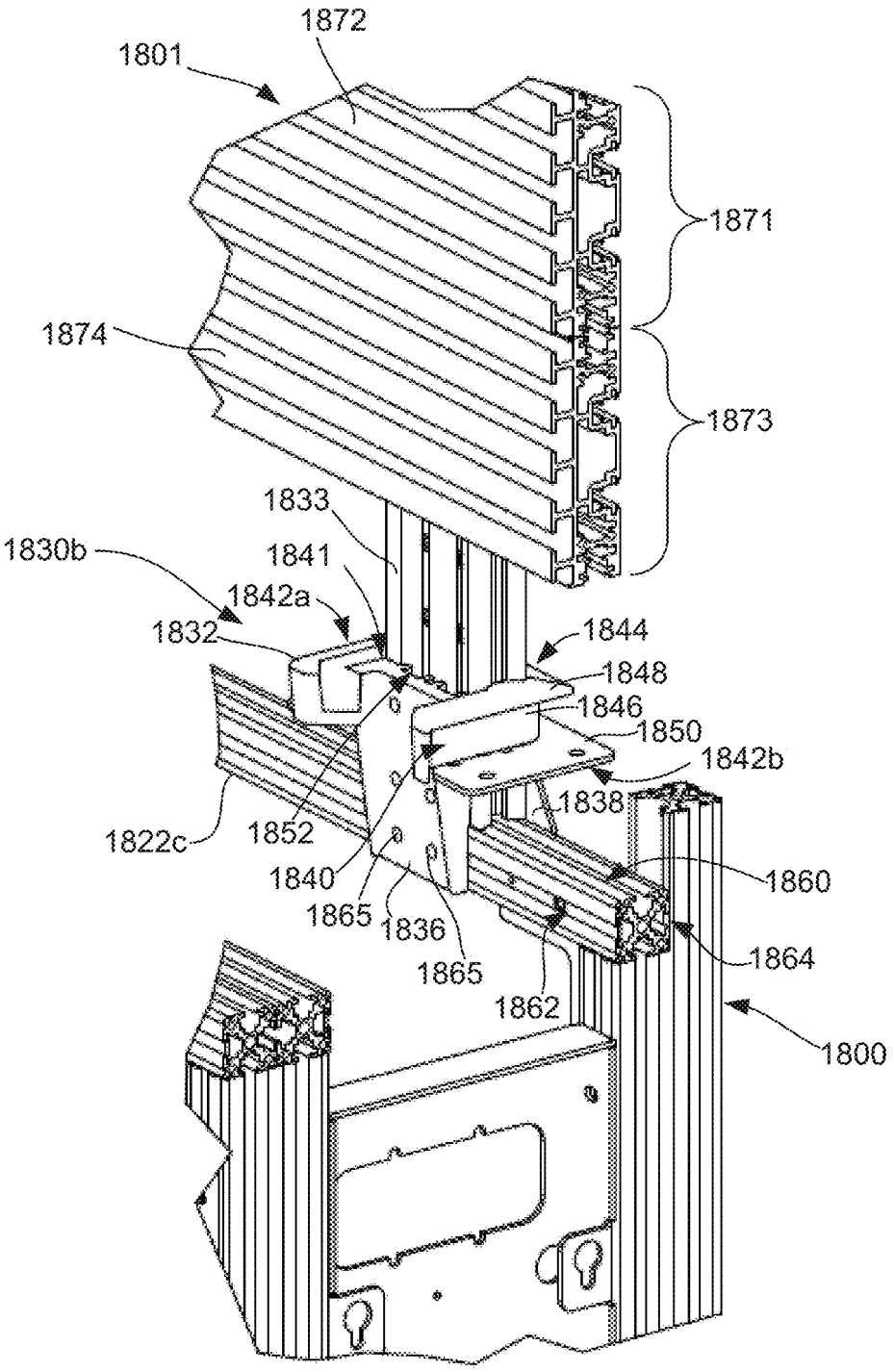
FIG. 61 is an enlarged partial view of the frame module and slat wall, generally within the area "I" identified in FIG. 59.
Figure 62:
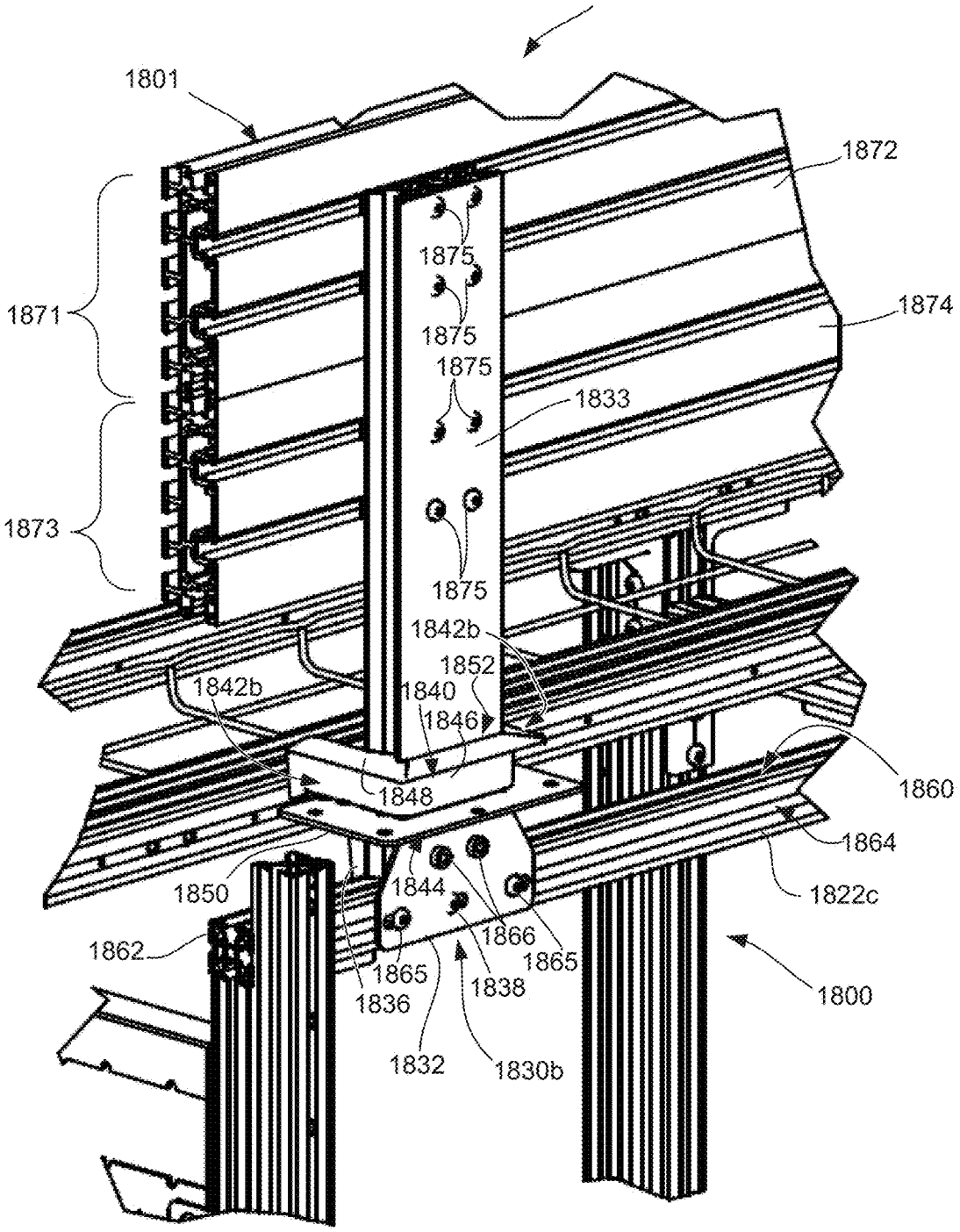
FIG. 62 is an enlarged partial view of the frame module and slat wall, generally within the area "J" identified in FIG. 60.

The connection between the slat wall 1801 and the frame module 1800 in FIGS. 59 and 60 will now be described in more detail with reference to FIGS. 61 and 62. FIG. 61 is an enlarged partial view of the frame module 1800 and slat wall 1801, generally within the area "I" identified in FIG. 59. FIG. 62 is an enlarged partial view of the frame module 1800 and slat wall 1801, generally within the area "J" identified in FIG. 60.

The second mounting assembly 1830*b* is shown in FIGS. 61 and 62. The first mounting assembly 1830*a* (FIGS. 59 and 60) has the same structure. The mounting assembly 1830*b* includes a connector 1832 and an upright support member 1833. In this example, the upright support member is in the form of a post or beam. The connector 1832 includes a front plate 1836, a back plate 1838 and a collar 1840 at a top end 1841 thereof. The collar 1840 has first and second sides 1842*a* and 1842*b*, extending between the front and back plates 1836 and 1838, connected by a back 1844. The collar 1840 includes a wall 1846 (extending along the sides 1842*a* and 1842*b* and back 1844). The collar 1840 also includes an upper lip 1848 that extends outward from the wall 1846. The connector 1832 further includes a lower plate 1580 under the wall 1846 that extends horizontally outward (generally parallel to the upper lip 1848 in this embodiment. The front and back plates 1836 and 1838, the collar 1840 and the lower plate 1850 together define a generally vertical passage 1852 sized to receive the upright support member 1833.

The connector 1832 may be formed in any suitable manner. For example, the front and back plates 1836 and 1838 and the collar 1840 may be integrally formed by molding or another process. Alternatively, the front and back plates 1836 and 1838 and the collar 1840 may be formed separately and then connected (e.g. by welding or any other suitable means). The connector 1832 may be metal or any other suitable material for supporting the weight of the slat wall and equipment that may be mounted thereto.

The upright support member 1833 is received in the passage 1852 and sits on the top face 1860 of the third upper beam 1822*c*. The front and back plates 1836 and 1838 of the bracket 1832 extend downward over the front and back faces 1862 and 1864, respectively, of the third upper beam 1822*c*. The front and back plates 1836 and 1838 are secured to the third upper beam 1822*c* using screws or bolts 1865 (possibly in combination with one or more attachment strips received in lengthwise ports of the third upper beam 1822*c*). Any suitable attachment means may be used. Optionally, additional bolts 1866 (FIG. 62) or other fastening hardware attach the front and back plates 1836 and 1838 directly to the upright support member 1833. Any suitable method of attachment may be used. The front and back plates back plates 1836 and 1838 together with the rectangular shape of the upper beam 1822*c* of the frame module 1800 may help prevent rotational or angular movement or misalignment of the mounting assembly 1830*b* and the upright support member 1833. As also described above, the elongated ports of the various extrusions (including third upper beam 1822*c*) described herein may allow attachment at various positions, thereby allowing for customization. For example, the second mounting assembly 1830*b* may be placed in various positions along the length of the third upper beam 1822*c* as desired for various configurations.

The slat wall 1801 in this example comprises an upper section 1871 including a first slat wall panel 1872 and a lower section 1873 including a second slat wall panel 1874. The first and second slat wall panels 1872 and 1874 are stacked and both extend most of the width of the frame module 1800. The first and second slat wall panels 1872 and 1874 are both attached to the mounting assemblies 1830*a* and 1830*b* (FIGS. 59 and 60). More specifically, each slat wall panel 1872 and 1874 is attached to the upright support member 1833 by respective a plurality of bolts 1875, although any suitable attachment means may be used in other embodiments.

The first and second slat wall panels 1872 and 1874 may be extrusions (such as aluminum or other metal extrusions) although embodiments are not limited to such. More or fewer slat sections may be used and/or stacked in other embodiments to create slat walls of various heights. In some embodiments, the slat wall 1801 and mounting assemblies 1830*a* and 1830*b* may be a single section rather than multiple stacked sections. The slat wall 1801 described above may provide sufficient structural support and load capacity for equipment to be mounted on the slat wall.

The collar 1840 and lower plate 1850 may receive a work surface panel or other panel (not shown) between the upper lip 1848 and lower plate 1850. The work surface panel or panel may be secured to the upper lip 1848 and/or the lower plate 1850. The upper lip 1848 and the lower plate 1850 may, thus, provide additional structural support.

Figure 63:
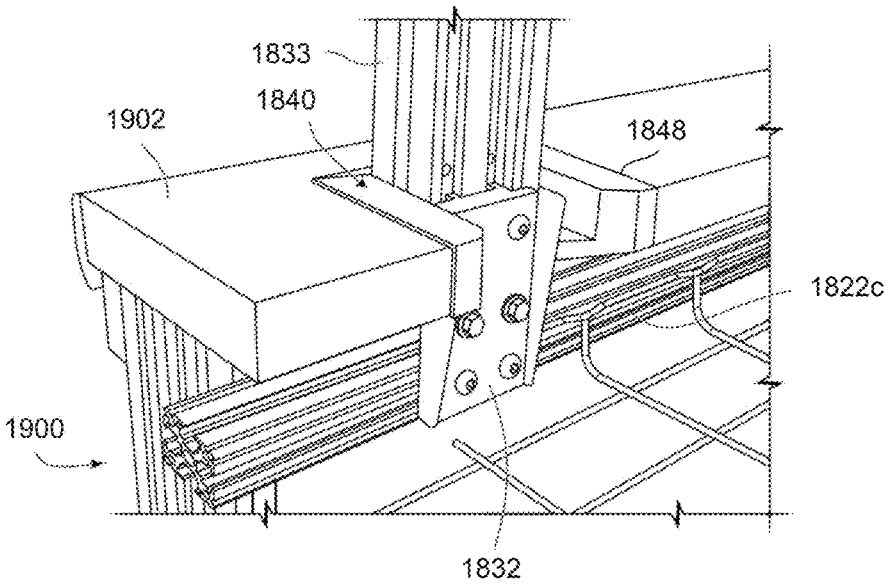
FIG. 63 is a partial perspective view showing an upright support member and connector from FIGS. 61 and 62 mounted to a frame module, according to some embodiments.

FIG. 63 is a partial perspective view showing the upright support member 1833 and connector 1832 from FIGS. 61 and 62 mounted to a frame module 1900. As shown, an upper panel 1902 (similar to the upper panel 1114 in FIG. 38) is mounted on the frame module 1900 and is received in the collar 1840 between the upper lip 1848 and the lower plate 1850 (FIG. 62). The connector 1832 connects to the upper beam 1822*c* and the upper panel 1902.

Embodiments are not limited to the particular mounting assemblies 1830*a* and 1830*b* shown in FIGS. 59 to 62. For example, in other embodiments, different styles of brackets may be used. Alternatively, one or more upright support member may connect directly to the third upper beam 1822*c* or to other parts of the frame module 1800 without additional brackets. Any suitable means for mounting a slat wall may be used.

Embodiments are also not limited to the slat wall 1801 shown in FIGS. 59 to 62. In other embodiments, a slat rail or other structural means for mounting and attaching equipment for a console may be used. In other embodiments, the slat wall (or slat rail, etc.) is omitted.

Figure 64:
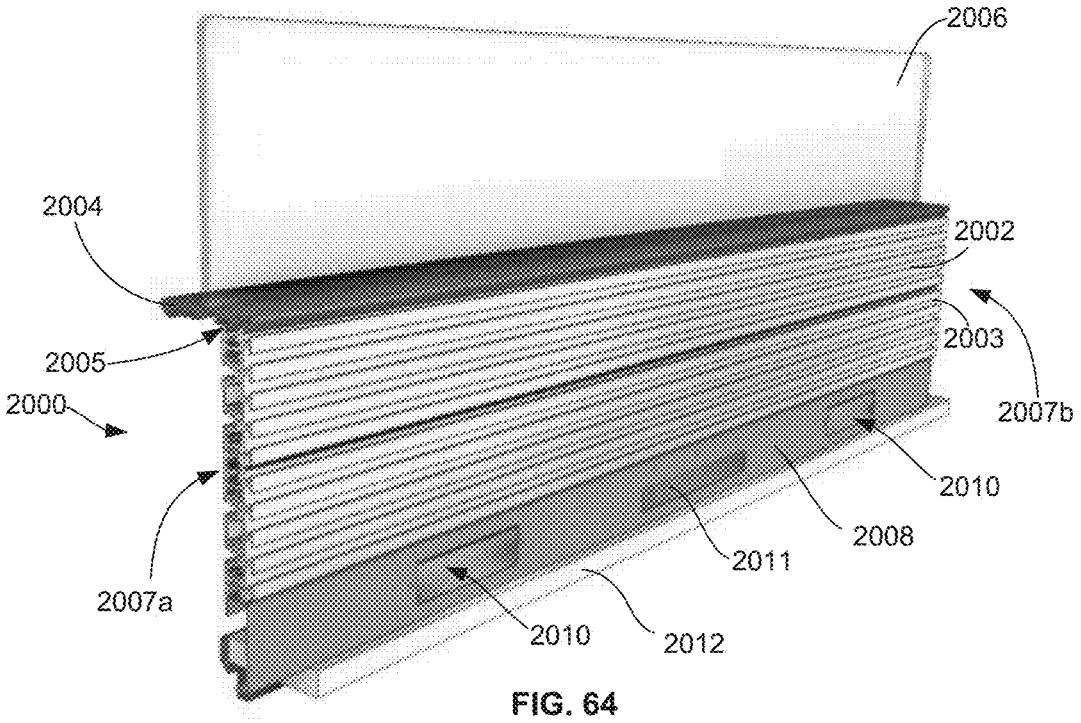
FIG. 64 is a perspective view of a slat wall according to another embodiment.

FIG. 64 is a perspective view of a slat wall assembly 2000 according to another embodiment. The slat wall assembly 2000 includes upper and lower slat wall panels 2002 and 2003, which are stacked (similar to the slat wall 1800 in FIGS. 59 to 62). The slat wall 2000 also includes an upper cladding or strip 2004 along its top edge 2005, which extends along the full length of the slat wall assembly 2000. The strip may be an extrusion, such as a plastic extrusion. Additional strips (not shown) may continue over the sides 2007*a* and 2007*b* of the slat wall and may connect with the upper strip 2004. A clear or semi-transparent panel 2006 (e.g. glass, Plexiglas™, plastic, etc.) is mounted on the strip 2004. The panel 2006 may be lit (e.g. edge-lit) and may be configured to provide information (e.g. by colors, patterns or other visual indications). A lower cover 2008 is also shown that may hide mounting assemblies (such as assemblies 1830*a* and 1830*b* in FIGS. 59 to 62) from view. The cover 2008 includes openings 2010 and brush grommet 2011 that may be used for cable routing or ventilation, for example. An upper console panel 2012 similar to panel 1902 in FIG. 63 is also shown, on which the slat wall assembly 2000 sits.

Figure 65:
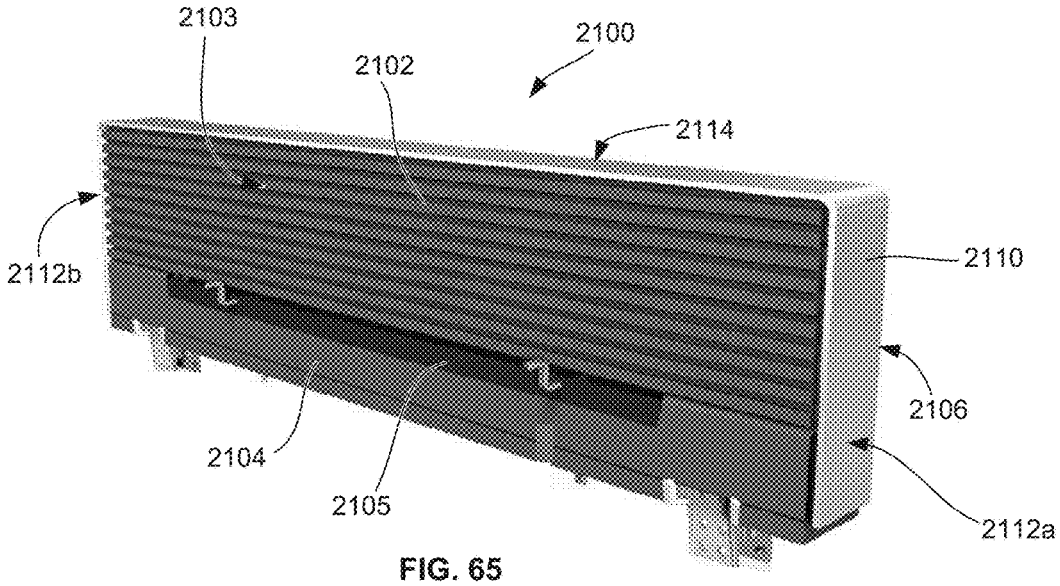
FIG. 65 is a front perspective view of a slat wall assembly according to some embodiments.

FIG. 65 is a front perspective view of a slat wall assembly 2100 according to some embodiments. The slat wall assembly 2100 includes a slat wall 2102 at the front 2103 of the assembly 2100 and a lower front cover 2104 under the slat wall 2102. A brush grommet 2105 for cable management is included between the lower front cover 2104 and the slat wall 2102. The slat wall assembly further includes a housing 2106. The housing 2106 includes a rear panel 2108 (shown in FIG. 67) and a strip 2110 forming sides 2112*a* and 2112*b* and a top 2114 of the housing.

Figure 66:
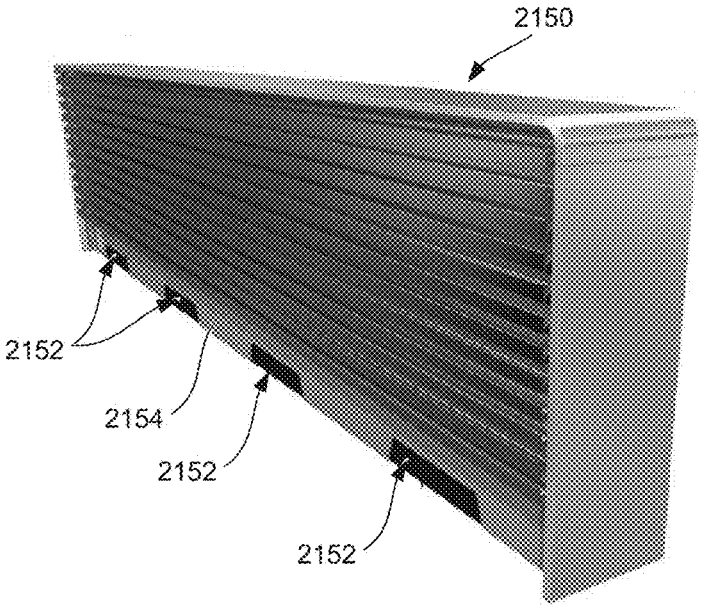
FIG. 66 is a front perspective view of another example slat wall assembly according to some embodiments.

FIG. 66 is a front perspective view of another example slat wall assembly 2150 according to another embodiment. The slat wall assembly 2150 in this example is similar to the slat wall assembly 2100 of FIG. 65, but without the brush grommet 2105 (FIG. 65). Cables may pass through openings 2152 in the front lower cover 2154.

Figure 67:
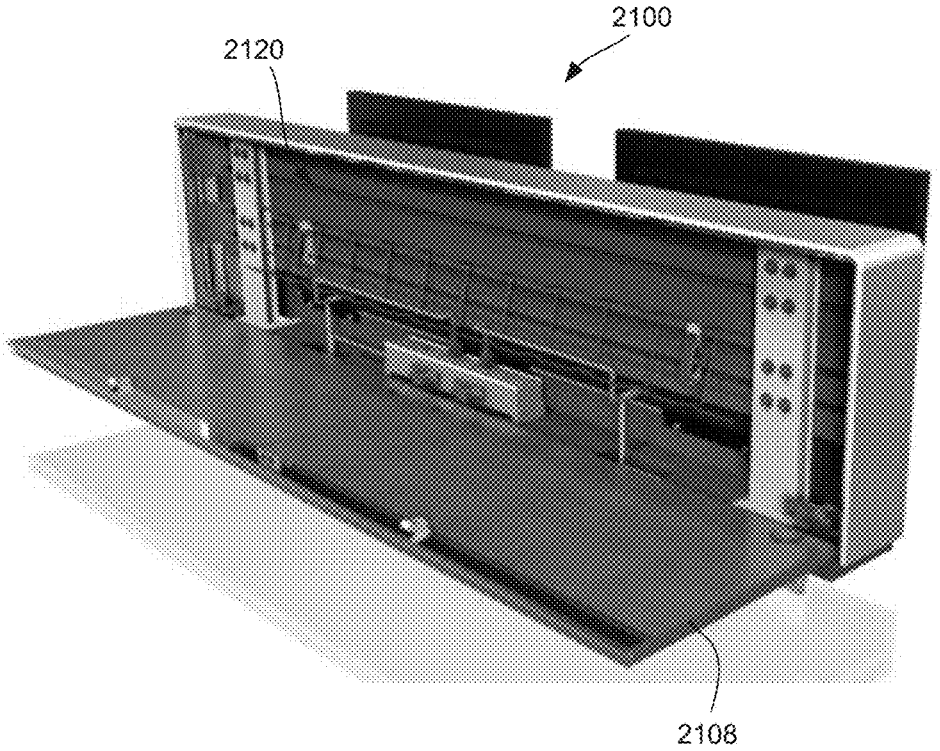
FIG. 67 is a is a rear perspective view of the slat wall assembly of FIG. 65.

FIG. 67 is a is a rear perspective view of the slat wall assembly 2100 of FIG. 65, showing rear panel 2108. As shown, the rear panel opens (e.g. via hinges) to provide access to the interior 2120 of the assembly 2100. Equipment, cables, etc. may be stored in the interior 2110.

The slat wall assemblies 2100 and 2150 in FIGS. 65 to 67 may be mounted on the various frame modules, frame structures (including two or more frame modules) and consoles described herein.

In other embodiments, a slat wall assembly may have front and rear facing slat walls.

Figure 68:
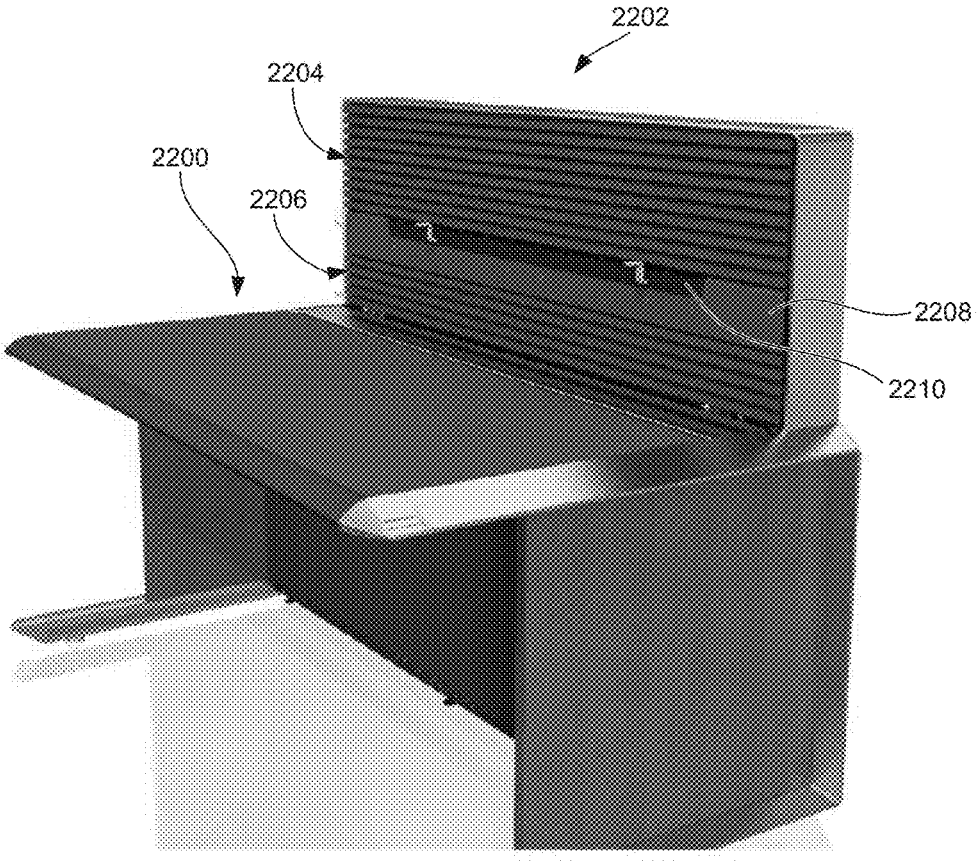
FIG. 68 is a front perspective view of an example console with a slat wall assembly mounted thereon.

As mentioned above, the slat walls described herein may comprise multiple stacking pieces, thus allowing customization of the height of the slat wall. FIG. 68 is a front perspective view of an example console 2200 with a slat wall assembly 2202 mounted thereon. The slat wall assembly 2202 in this example is similar to the slat wall assembly 2100 of FIG. 65. However, the slat wall assembly 2200 includes an upper slat wall section 2204 and a lower slat wall section 2206, with a cover 2208 and brush grommet 2210 therebetween. The upper slat wall 2204 may, for example, comprise two stacked pieces, each having a shape similar to the lower slat wall section 2206. Other configurations are also possible, and embodiments are not limited to a particular slat wall arrangement shown in the drawings.

Figure 69:
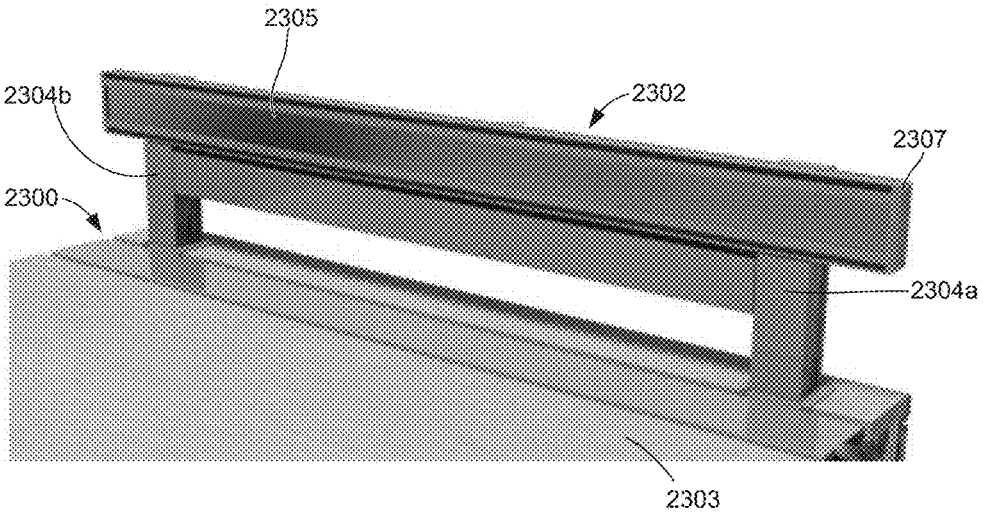
FIG. 69 is a partial front perspective view of a console having an example slat rail assembly mounted thereon according to another yet embodiment.

FIG. 69 is a partial front perspective view of a console 2300 having an example slat rail assembly 2302 mounted over a work surface panel 2303 according to another yet embodiment. The slat rail assembly 2302 is mounted on first and second a vertical supports 2304*a* and 2304*b* that connect to and extend upward from the console 2300. The slat rail may be attached to and mounted on the console in any suitable manner, and embodiments are not limited to the particular example in FIG. 69. Various equipment, such as one or more displays, may be mounted to the slat rail.

The slat rail assembly 2302 in this example includes a slat rail 2305 and a cover 2307 that covers sides and rear of the slat rail 2305.

Figure 70:
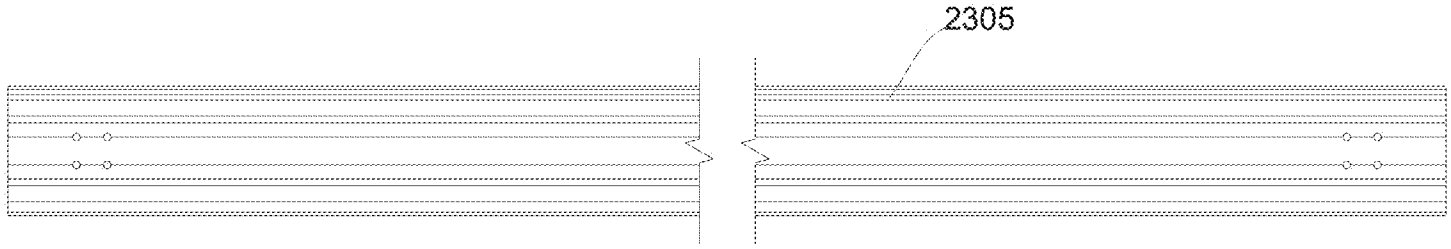
FIG. 70 is a front view of the example slat rail of the slat rail assembly of FIG. 69.

FIG. 70 is a front view of the example slat rail 2305. The slat rail may, for example, be approximately 60 inches in length. However, embodiments are not limited to any particular dimensions.

Figure 71:
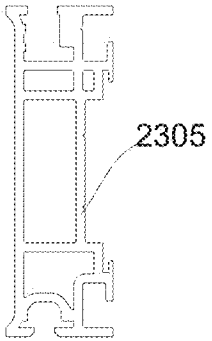
FIG. 71 is a cross-sectional view of the example slat rail of the slat rail assembly of FIG. 69.

FIG. 71 is a cross-sectional view of the slat rail 2305. The slat rail 2305 may be formed as an extrusion (e.g. aluminum or other metal).

The various consoles, and console frame structures and modules described herein may be configured to satisfy ergonomic guidelines, including but not limited to: BIFMA G1-2002 95$^{th}$ Male (sitting); BIFMA G1-2002 5$^{th}$ Female (sitting); ANSI HFES 100-2007 (sitting); or BS EN ISO 9241-5 (sitting).

Elements of the embodiments described above may be combined. It is to be understood that embodiments are not limited to the particular combinations of features shown in the Figures. For example, various modifications to the frame module 100 shown in FIG. 1 may be implemented in the various consoles and console frame structures shown and described. Similarly, the slat wall and slat rail features described herein may be combined with any of the frame modules, console frame structures or consoles, or may be omitted.

What has been described is merely illustrative of the application of the principles of the disclosure. Other arrangements and methods can be implemented by those skilled in the art without departing from the scope of the present disclosure.

The invention claimed is:

1. A console frame structure comprising:

first and second frame modules, each said frame module comprising respective first and second spaced apart leg frames and respective upper and lower elongated frame sections extending between and interconnecting the first and second leg frames;

at least one pivot connection between the second leg frame of the first frame module and the first leg frame of the second frame module, thereby allowing adjustment of a relative angle between the first and second frame modules, the at least one pivot connection comprising at least three pivot hinge pieces; and for each at least one pivot connection, a respective support member pivotably connected to the first and second frame modules by the pivot connection, thereby allowing adjustment of relative angles between each of the support member, the first frame module, and the second frame module, each respective support member comprising one of said at least three pivot hinge pieces.

2. The console frame structure of claim 1, wherein the at least one support member comprises at least one of: a floor-engaging foot; and a support arm for supporting a work surface panel.

3. The console frame structure of claim 1, each said pivot connection comprises:

a respective first pivot hinge piece attached to the second leg frame of the first frame module;

a respective second pivot hinge piece attached to the first leg frame of the second frame module, a respective third pivot hinge piece, the corresponding support member comprising the third pivot hinge piece, wherein the first, second and third pivot hinge pieces are pivotably connected.

4. The console frame structure of claim 3, wherein each said pivot connection further comprises a pin pivotably connecting the first, second and third pivot hinge pieces.

5. The console frame structure of claim 4, wherein:

the first hinge piece comprises a first generally horizontal extension having a first generally vertical hole defined therethrough;

the second hinge piece comprises a second generally horizontal extension having a second generally vertical hole defined therethrough, the first and second vertical holes being aligned and the pin extending through the holes.

6. The console frame structure of claim 1, wherein each of the first and second frame modules further comprises:

a respective intermediate frame positioned between the respective first and second leg frames, the intermediate frame being selectively fixable to the at least one of the upper and lower elongated frame sections such that a position of the intermediate frame is adjustable lengthwise along the upper and lower elongated frame sections.

7. The console frame structure of claim 6, further comprising at least one additional support member pivotably connected to at least one of: one or more of the leg frames; and one or both of the intermediate frames.

8. A console frame module, comprising:

first and second spaced apart leg frames;

respective upper and lower elongated frame sections extending between and interconnecting the first and second leg frames; and an intermediate frame positioned between the first and second leg frames, the intermediate frame being selectively fixable to the at least one of the upper and lower elongated frame sections such that a position of the intermediate frame is adjustable lengthwise along the upper and lower elongated frame sections, wherein the upper frame section comprises at least one upper beam interconnecting the first and second leg frames, wherein the lower frame section comprises at least one lower beam interconnecting the first and second leg frames, wherein at least one of said at least one upper beam and at least one lower beam comprises at least one elongated port oriented along a length of said upper beam or said lower beam, said port having a profile shaped for securely receiving fastening hardware at any point along a length of said port, wherein said intermediate frame is selectively fixable to said at least one upper beam or said at least one lower beam by said fastening hardware received in said at least one port; wherein the at least one upper beam comprises first and second horizontally spaced apart upper beams, and the at least one lower beam comprises first and second horizontally spaced apart lower beams, wherein the intermediate frame comprises at least first and second spaced apart generally vertical beams, the first and second spaced apart generally vertical beams each having respective upper and lower ends, the first generally vertical beam of the intermediate frame being aligned with the first upper beam and the first lower beam, the second generally vertical beam of the intermediate frame being aligned with the second upper beam and the second lower beam, and wherein the upper ends of the first and second generally vertical beams of the intermediate frame each define a respective recess, the recess in the upper end of the first generally vertical beam being aligned with and receiving the first upper beam, the recess in the upper end of the second generally vertical beam being aligned with and receiving the second upper beam.

9. The console frame module of claim 8, wherein the intermediate frame further comprises at least one cross beam interconnecting the first and second generally vertical beams of the intermediate frame.

10. The console frame module of claim 8, wherein:

the lower ends of the first and second generally vertical beams of the intermediate frame each defining a respective recess, the recess in the lower end of the first generally vertical beam being aligned with and receiving the first lower beam, the recess in the lower end of the second generally vertical beam being aligned with and receiving the second lower beam.

11. The console frame module of claim 8, wherein each of the first and second generally vertical beams of the intermediate frame comprises at least one respective elongated port oriented along a length of the generally vertical beam for receiving fastening hardware.

12. The console frame module of claim 8, further comprising at least one support arm for supporting a work surface panel, each said support arm attached to a respective one of: the first leg frame, the second leg frame, and the intermediate frame.

13. The console frame module of claim 8, further comprising at least one floor-engaging foot, each said foot attached to a respective one of: the first leg frame, the second leg frame, and the intermediate frame.

14. A console comprising:

at least one console frame module as claimed in claim 8; and at least one work surface panel mounted on the at least one console frame module.

15. The console of claim 14, further comprising at least one end panel assembly connected to the at least one console frame module.

16. The console of claim 15, wherein each said end panel assembly comprises a respective end panel frame and a respective end panel insert.

17. The console of claim 16, wherein the end panel insert for each end panel assembly is removable and replaceable.

18. The console of claim 14, further comprising a slat wall mounted to the at least one console frame module.

19. The console of claim 14, further comprising a slat rail mounted to the at least one console frame module.

* * * * *